US007307605B2

(12) United States Patent
Shimoda et al.

(10) Patent No.: US 7,307,605 B2
(45) Date of Patent: Dec. 11, 2007

(54) DRIVING CIRCUIT OF CURRENT-DRIVEN DEVICE, CURRENT-DRIVEN APPARATUS, AND METHOD OF DRIVING THE SAME

(75) Inventors: Masamichi Shimoda, Tokyo (JP); Katsumi Abe, Tokyo (JP); Koichi Iguchi, Tokyo (JP)

(73) Assignee: NEC Corporation and NEC Electronics Corporation (JP)

( * ) Notice: Subject to any disclaimer, the term of this patent is extended or adjusted under 35 U.S.C. 154(b) by 554 days.

(21) Appl. No.: 11/001,593

(22) Filed: Dec. 1, 2004

(65) Prior Publication Data

US 2005/0116747 A1 Jun. 2, 2005

(30) Foreign Application Priority Data

Dec. 1, 2003 (JP) ..... 2003-402277

(51) Int. Cl.
*G09G 3/30* (2006.01)

(52) U.S. Cl. ..... 345/76; 345/82; 315/169.1

(58) Field of Classification Search ..... 345/76–83; 315/169.1–169.4; 327/108
See application file for complete search history.

(56) References Cited

U.S. PATENT DOCUMENTS

| | | | | |
|---|---|---|---|---|
| 6,594,606 | B2 * | 7/2003 | Everitt | 702/107 |
| 2002/0031032 | A1 * | 3/2002 | Ooishi | 365/226 |
| 2002/0040420 | A1 * | 4/2002 | Yamauchi et al. | 711/118 |
| 2003/0010897 | A1 * | 1/2003 | Miida | 250/208.1 |
| 2003/0137503 | A1 * | 7/2003 | Kimura et al. | 345/212 |
| 2003/0231527 | A1 * | 12/2003 | Nakase et al. | 365/196 |
| 2006/0125739 | A1 * | 6/2006 | Tsutsui | 345/76 |
| 2006/0152449 | A1 * | 7/2006 | Norimatu | 345/76 |

FOREIGN PATENT DOCUMENTS

| | | |
|---|---|---|
| CN | 1278635 | 1/2001 |
| CN | 1417767 | 5/2003 |
| JP | 2003-195812 | 7/2003 |

OTHER PUBLICATIONS

Office Action issued by the Chinese Patent Office dated Mar. 30, 2007 in connection with corresponding Chinese Patent Application No. 200410098284.

Translation of the Office Action issued by the Chinese Patent Office dated Mar. 30, 2007 in connection with corresponding Chinese Patent Application No. 200410098284.

* cited by examiner

*Primary Examiner*—Richard Hjerpe
*Assistant Examiner*—Kimnhung Nguyen
(74) *Attorney, Agent, or Firm*—Ostrolenk, Faber, Gerb & Soffen, LLP

(57) ABSTRACT

A precharge circuit is provided with an N-channel transistor intended for switching. A reference potential is applied to either one of the source and drain of this N-channel transistor. The other of the source and drain is connected to a node. A precharge signal is applied to the gate of the N-channel transistor. The reference potential is set to a precharge output potential for the case of displaying black on a pixel, i.e., the potential when a minimum current flows through a P-channel transistor connected to the other of the source and drain of the N-channel transistor.

45 Claims, 26 Drawing Sheets

DRIVING CIRCUIT OF CURRENT-DRIVEN DEVICE, CURRENT-DRIVEN APPARATUS, AND METHOD OF DRIVING THE SAME

BACKGROUND OF THE INVENTION

1. Field of the Invention

The present invention relates to a driving circuit of a current-driven device for driving a current-driven device which is driven by supply of an electric current, a current-driven apparatus having this driving circuit and a current-driven device, and a method of driving this current-driven apparatus.

The present invention is applicable to an organic EL display, as well as such current-driven displays as an inorganic EL display and an LED, such current-driven memories as an MRAM, and driving circuits thereof.

2. Description of the Related Art

Current-driven apparatuses which are controlled in operation by electric currents supplied thereto have been developed heretofore. Among such current-driven apparatuses is an organic electro luminescence (EL) display.

With the advance of development, organic EL devices to be used in organic EL displays have improved in efficiency, contributing to reduced power consumption of the organic EL displays. The improved efficiency of the organic EL devices, however, makes the currents to be passed through the organic EL devices smaller, which requires a driving circuit for supplying (writing) the organic EL devices with these small currents accurately at speed. The inventors have formerly invented such a driving circuit, and disclosed it in Japanese Patent Laid-Open Publication No. 2003-195812.

FIG. 1 is a block diagram showing a conventional EL display described in Japanese Patent Laid-Open Publication No. 2003-195812. FIG. 2 is a circuit diagram showing a current source and a precharge circuit for each single data line, and a pixel circuit for each single pixel in the organic EL display shown in FIG. 1.

As shown in FIG. 1, the organic EL display 500 has a display unit 400. The display unit 400 is provided with a plurality (Y) of control lines 110 which extend in the horizontal direction, and a plurality (X) of data lines 120 which extend in the vertical direction. Pixels 100 are arranged at respective intersections of the control lines 110 and the data lines 120. Consequently, the display unit 400 has (X×Y) pixels 100 which are arranged in a matrix. Incidentally, when the organic EL display 500 is a color display, three adjoining pixels 100 arranged in the horizontal direction constitute a single group in which the pixels 100 emit light in red (R), blue (B), and green (G), respectively. The pixels 100 each have an organic EL device as its light-emitting device.

In addition, the organic EL display 500 has a vertical scanning circuit 300 which lies along a vertical side of the display unit 400 and is connected with the control lines 110. The vertical scanning circuit 300 selects the control lines 110 in succession. The organic EL display 500 also has a horizontal driving circuit 200 which lies along a horizontal side of the display unit 400 and is connected with the data lines 120. The horizontal driving circuit 200 supplies current signals to the pixels 100 that are connected to a control line 110 selected by the vertical scanning circuit 300. The light-emitting devices arranged in the pixels 100 have a proportional relationship between the currents supplied thereto and the luminances thereof. The currents supplied to the pixels 100 through the data lines 120 are adjusted in intensity so that the pixels 100 achieve display with tone levels. Note that the horizontal driving circuit 200 and the vertical scanning circuit 300 constitutes the driving circuit of the organic EL display 500.

As shown in FIG. 2, the horizontal driving circuit 200 is provided with a plurality (X) of current sources 220 for outputting current signals Iout to the respective data lines 120 of the display unit 400 (see FIG. 1). Precharge circuits 250 for precharging the data lines 120 are connected between the current sources 220 and the data lines 120.

Each pixel 100 has a pixel circuit in which a P-channel transistor T21 intended for current storage, a P-channel transistor T24 intended for switching, and a light-emitting device or organic EL device 130 are connected in series in this order between a supply voltage Ve1 and a ground potential GND. The gate of the current storing P-channel transistor T21 is connected to a data line 120 through N-channel transistors T22 and T23 intended for switching. The gates of the switching transistors T22 to T24 are connected to a control line 110. Besides, a capacitor C1 is arranged between the gate of the current storing transistor T21 and the supply voltage Ve1. The node between the switching transistors T22 and T23 is connected to the node between the current storing transistor T21 and the switching transistor T24, whereby the gate of the current storing P-channel transistor T21 is connected to the drain of the transistor T21 through the switching transistor T22. A parasitic capacitance Cp1 lies between the data line 120 and the ground potential.

Each precharge circuit 250 undergoes the supply voltage Ve1. For a potential generating circuit, a P-channel transistor T35 intended for driving and an N-channel transistor T31 intended for switching are connected in series in this order between the terminal to which the supply voltage Ve1 is applied and the current source 220. More specifically, either one of the source and drain (hereinafter, referred to as one terminal) of the N-channel transistor T31 is connected to the driving P-channel transistor T35. The other of the source and drain (hereinafter, referred to as the other terminal) is connected to the ground potential through the current source 220. Incidentally, the driving P-channel transistor T35 has the same size as that of the current storing P-channel transistor T21 of the pixel 100. The two transistors thus have substantially the same characteristics. The precharge circuit 250 also has N-channel transistors T32 and T33 and a P-channel transistor T34 which are intended for switching. The gates of these switching transistors T31 to T34 are connected to wiring 252. A precharge signal PC2 is input to the wiring 252 from exterior.

Then, the node A between the driving P-channel transistor T35 and the switching N-channel transistor T31 is connected to one terminal of the N-channel transistor T33 intended for switching. The other terminal of this transistor T33 is connected to the gate of the driving P-channel transistor T35. A voltage follower amplifier 251 is arranged between the node A and the switching transistor T32. The node A is connected to the noninverting input terminal of this voltage follower amplifier 251. The output of the amplifier 251 is connected to one terminal of the transistor T32 and the inverting input terminal of the amplifier 251. The other terminal of the transistor T32 is connected to the data line 120. Moreover, one terminal of the switching P-channel transistor T34 is connected to the current source 220. The other terminal of the transistor T34 is connected to the data line 120.

Next, description will be given of the operation of the organic EL display which is configured as described above. Initially, the vertical scanning circuit 300 shown in FIG. 1 scans the control lines 110. More specifically, the vertical scanning circuit 300 selects the first control line 110 to the Yth control line 110 in succession, applying a signal of high level to the selected control line 110.

Then, the current sources 220 in the horizontal driving circuit 200 output the current signals to the respective data lines 120. At this time, the horizontal driving circuit 200 passes currents corresponding to the tone levels to be displayed on the pixels 100 that are connected to the control line 110 selected by the vertical scanning circuit 300, through the data lines 120 in connection with the pixels 100. Consequently, as shown in FIG. 2, the current signal Iout is supplied to the switching N-channel transistor T31 and the switching P-channel transistor T34 in each precharge circuit 250. If the precharge signal PC2 is not selected, i.e., at low level, the switching N-channel transistors T31 and T32 turn off and the switching P-channel transistor T34 turns on. The current signal Iout is thus supplied from the current source 220 to the data line 120 through the transistor T34. In this way, the horizontal driving circuit 200 outputs the current signals Iout to the data lines 120.

In each of the pixels 100 that are selected by the vertical scanning circuit 300 (see FIG. 1), the signal of high level, indicating selection, is applied to the control line 110. This turns on the switching N-channel transistors T22 and T23. As a result, the data line 120 is connected to the gate of the current storing P-channel transistor T21 and one end of the capacitor C1 through the transistors T23 and T22. Moreover, the switching P-channel transistor T24 is turned off. This determines the amount of the current to flow through the current storing P-channel transistor T21, and charges the capacitor C1. The pixel 100 is thus written with the current signal Iout.

Then, the vertical scanning circuit 300 scans the next control line, and the potential of the control line 110 shown in FIG. 2 is switched from high level (selected) to low level (not selected). Then, the switching N-channel transistors T22 and T23 turn off, and the switching P-channel transistor T24 turns on. As a result, the current path consisting of a series connection of the current storing P-channel transistor T21, the switching P-channel transistor T24, and the organic EL device 130 in this order is formed from the supply voltage Ve1 to the ground potential GND independent of the data line 120. More specifically, the supply voltage Ve1 is applied to one terminal of the current storing P-channel transistor T21. The other terminal of this transistor T21 is connected to one terminal of the switching P-channel transistor T24. The other terminal of this transistor T24 is connected to the input terminal of the organic EL device 130. The output terminal of this organic EL device 130 is subjected to the ground potential GND. As a result, the current written in the current storing P-channel transistor T21 flows through this current path, and the organic EL device 130 emits light at a tone level corresponding to this current. In this case, the capacitor C1 maintains the gate potential of the current storing P-channel transistor T21 at a constant value. The amount of the current flowing through the transistor T21 is thus maintained at a constant value, so that the luminance of the organic EL device 130 is maintained at a predetermined tone level.

The vertical scanning circuit 300 thus scans the control lines 110 to select the Y control lines 110 one by one in succession. Upon each selection, the horizontal driving circuit 200 outputs the current signals Iout corresponding to intended tone levels to the pixels 100 that are in connection with the control line 110 selected by the vertical scanning circuit 300. An image is displayed on the display unit 400 in this way.

As above, the display unit 400 can theoretically display images without the precharge circuits 250. Nevertheless, since the data lines 120 are accompanied with the parasitic capacitances Cp1, the parasitic capacitances Cp1 must be charged and discharged each time the potentials of the data lines 120 are changed. Setting the data lines 120 to a desired value of potential thus requires a certain amount of write time. Besides, the smaller the current signals Iout to be supplied to the data lines 120 are, the longer the write time becomes. Meanwhile, in order to display flicker-free images to viewers, the vertical scanning circuit 300 must scan the control lines 110 at or above a certain speed. This means an upper limit to the duration for each single control line 110 to be selected for. On this account, excessive write time can result in insufficient write operations, with the problem of degraded image quality.

Then, in the conventional example described in Japanese Unexamined Patent Application Publication No. 2003-195812, the precharge circuits 250 are provided between the current sources 220 and the data lines 120. As shown in FIG. 2, in each of the precharge circuits 250, the precharge signal PC2 is switched to high level (selected) immediately after a new control line 110 is selected. Consequently, the switching N-channel transistors T31 to T33 turn on, and the switching P-channel transistor T34 turns off. As a result, the current signal Iout output from the current source 220 is supplied to the driving P-channel transistor T35 through the transistors T31 and T33. This determines the amount of the current to flow through the driving P-channel transistor T35, and sets the potential of the node A to a potential corresponding to the current signal Iout. Incidentally, the transistor T35 has substantially the same size and characteristics as those of the transistor T21 in each pixel 100. The potential of the node A mentioned above thus becomes substantially the same as that of the gate of the transistor T21 when the current signal Iout is applied to the transistor T21. Then, the potential of the node A is applied to the noninverting input terminal of the voltage follower amplifier 251, and the same potential as that of the node A is output from the output terminal of the voltage follower amplifier 251 to the data line 120. The voltage follower amplifier 251 has a high capability for current supply, and can thus charge and discharge the parasitic capacitance Cp1 of the data line 120 quickly. That is, because of the provision of the precharge circuit 250, the potential of the data line 120 can be set to a potential corresponding to the current signal Iout more quickly than when no precharge circuit 250 is provided.

Subsequently, the precharge signal PC2 is switched to low level (unselected), and the current signal Iout is supplied directly to the data line 120. At this time, the data line 120 is already given a potential close to the target value by the foregoing operation of the precharge circuit 250, and the current signal Iout has only to correct a precharge-time error in the potential of the data line 120. This correction requires not much time. As a result, it is possible to reduce the write time of the pixel 100. Incidentally, the precharge-time error in the potential of the data line 120 occurs due to an input offset voltage of the voltage follower amplifier 251 and characteristic differences between the driving P-channel transistor T35 and the driving P-channel transistor T21.

The foregoing conventional technique, however, has the following problems. As shown in FIG. 2, in each precharge circuit 250, parasitic capacitances arise between the wiring for the current signal Iout to flow through and the ground potential. More specifically, the wiring from the transistor T35 to the noninverting input terminal of the voltage follower amplifier 251 is accompanied with a parasitic capacitance Cp2. The wiring from the current source 220 to the transistors T31 and T34 is accompanied with a parasitic capacitance Cp3. Incidentally, the parasitic capacitance Cp2 consists chiefly of the gate capacitor of the driving P-channel transistor T35 when the switching N-channel transistor T33 is on, and the input capacitor of the voltage follower amplifier 251. The parasitic capacitance Cp3 consists chiefly of capacitors occurring between the laid wiring and other wiring. These parasitic capacitances Cp2 and Cp3 are smaller than the parasitic capacitance Cp1 of the data line 120. Nevertheless, these parasitic capacitances Cp2 and Cp3 increase the settling time to elapse between when the precharge signal PC2 is selected, or switched to high level, and when the precharge output potential, or the potential applied to the noninverting input terminal of the voltage follower amplifier 251, converges to a certain value. The reason for this is that the parasitic capacitances Cp2 and Cp3 must be charged and discharged each time the value of the current signal Iout is changed.

FIG. 3 is a chart for showing the effect of the current signal Iout on the settling time of the input potential of the voltage follower amplifier. In the chart, the abscissa indicates the intensity of the current signal Iout, and the ordinate the settling time of the input potential of the voltage follower amplifier. Incidentally, "ΔV" shown in FIG. 3 represents a variation in the input potential of the voltage follower amplifier. The potential variation ΔV shows a difference between the potential of the data line 120 when a control line 110 is selected and the potential of the data line 120 when the next control line 110 is selected.

As shown in FIG. 3, the lower the intensity of the current signal Iout is, the longer the settling time of the input potential of the voltage follower amplifier becomes. In a pixel that emits light of a lower tone level, i.e., darker tone level, the smaller current signal Iout can make the settling time extremely longer. With a level-zero display, or black display, the settling time reaches its maximum. In addition, with recent improvements to the efficiency of the organic EL device, the current signal Iout decreases accordingly. The settling time of the input potential of the voltage follower amplifier is thus becoming increasingly long. Moreover, the greater the potential variation ΔV is, the longer the settling time of the input potential of the voltage follower amplifier becomes. This is equivalent to the case, for example, where the current signal Iout has a higher intensity when a control line 110 is selected, and the current signal Iout has a lower intensity when the next control line 110 is selected.

The longer settling time of the input potential of the voltage follower amplifier then increases the time necessary for precharge. This accordingly decreases the time for outputting the current signal Iout directly to the pixel 100, thereby hindering sufficient correction on precharge-time errors in the potentials of the data line 120. Consequently, the accuracy in writing the current signal Iout to the pixel 100 lowers with a drop in image quality. Specifically, trailing defects can occur from writing failures, for example.

SUMMARY OF THE INVENTION

It is an object of the present invention to provide a driving circuit of a current-driven device which can settle the potential of a current controlling transistor of the current-driven device quickly and can write a signal accurately, a current-driven apparatus having this driving circuit and a current-driven device, and a method of driving the same.

A first driving circuit of a current-driven device according to the present invention is one for driving a current-driven device to be controlled in operation depending on the intensity of a current input thereto. The driving circuit of a current-driven device comprises: a current controlling transistor for determining the intensity of the current to be supplied to the current-driven device based on its gate potential, the current controlling transistor being connected in series with the current-driven device; and a potential output circuit for setting a gate potential of the current controlling transistor to a potential so that the current flows through the current-driven device. Moreover, the potential output circuit includes a potential generating circuit for generating the potential, and an initialization circuit for initializing this potential generating circuit to an initialization potential before the potential generating circuit generates the potential.

According to the present invention, the initialization circuit initializes the potential generating circuit to the initialization potential before the potential generating circuit generates the potential. This initialization can charge and discharge parasitic capacitances accompanying the potential generating circuit, thereby allowing quick potential generation. That is, it is possible to reduce the time necessary for potential settlement.

The gate potential of the current controlling transistor may be determined by input of a current signal. The potential output circuit may be a precharge circuit for precharging the gate potential of the current controlling transistor to a potential determined by the input of the current signal to the current controlling transistor before the current signal is input to the current controlling transistor.

Consequently, the initialization circuit initializes the potential generating circuit to the initialization potential before the potential generating circuit generates a precharging potential. This initialization can charge and discharge parasitic capacitances accompanying the potential generating circuit, thereby allowing quick potential generation. That is, it is possible to reduce the time necessary to settle the precharging potential. It is therefore possible to reduce the time necessary for precharge.

A plurality of levels of current signals may be provided. Then, the precharge circuit is one for precharging the gate potential of the current controlling transistor to a plurality of potentials determined by the plurality of levels of current signals. The initialization potential is at least one potential selected from among the plurality of potentials. At this time, the initialization potential is preferably selected from among the plurality of potentials in ascending order of the corresponding current signals. Consequently, it is possible to reduce the time necessary to generate potentials for smaller current signals which require particularly long time for potential generation.

A second driving circuit of a current-driven device according to the present invention is one for driving a current-driven device to be controlled in operation depending on the intensity of a current determined by a current controlling transistor. This driving circuit of a current-driven device comprises: a driving transistor having its gate and drain-short-circuited, causing a gate potential equal to a gate potential of the current controlling transistor when a current signal is passed between its source and drain; a current source for outputting the current signal to the driving transistor; an operational amplifier having a noninverting input terminal connected to the drain of the driving transistor, and an output terminal connected to its inverting input terminal and the gate of the current controlling transistor; an input terminal for receiving a predetermined initialization potential; and a switch connected between this input terminal and the noninverting input terminal of the operational amplifier.

A third driving circuit of a current-driven device according to the present invention is one for driving a current-driven device to be controlled in operation depending on the intensity of a current determined by a current controlling transistor. This driving circuit of a current-driven device comprises: a driving transistor having its gate and drain short-circuited, causing a gate potential equal to a gate potential of the current controlling transistor when a current signal is passed between its source and drain; a current source for outputting the current signal to the driving transistor; an operational amplifier having a noninverting input terminal connected to the drain of the driving transistor, and an output terminal connected to its inverting input terminal and the gate of the current controlling transistor; another current source for outputting an initialization current to be passed through the driving transistor so that the gate potential of the driving transistor is initialized to an initialization potential; and a switch connected between the another current source and the drain of the driving transistor.

According to the present invention, the another current source passes the initialization current through the driving transistor to generate the initialization potential. Thus, even if the driving transistor has characteristic variations, it is possible to reduce an error in the initialization potential.

A fourth driving circuit of a current-driven device according to the present invention is one for driving a current-driven device to be controlled in operation depending on the intensity of a current determined by a current controlling transistor. This driving circuit of a current-driven device comprises: a driving transistor having its gate and drain short-circuited, causing a gate potential equal to a gate potential of the current controlling transistor when a current signal is passed between its source and drain; a current source for outputting the current signal to the driving transistor; an operational amplifier having a noninverting input terminal connected to the drain of the driving transistor, and an output terminal connected to its inverting input terminal and the gate of the current controlling transistor; another current source for outputting a current n times (n is a real number no smaller than 1) as high as an initialization current to be passed through the driving transistor so that the gate potential of the driving transistor is initialized to an initialization potential; another driving transistor connected to the another current source in parallel with the driving transistor, having a driving capability (n−1) times that of the driving transistor; and a switch connected between the another current source and the drains of the driving transistor and the another driving transistor.

According to the present invention, the current n times as high as the initialization current can be used for initialization. The initialization can thus be performed more quickly.

A fifth driving circuit of a current-driven device according to the present invention is one for driving a current-driven device to be controlled in operation depending on the intensity of a current determined by a current controlling transistor. This driving circuit of a current-driven device comprises: a driving transistor having its gate and drain short-circuited, causing a gate potential equal to a gate potential of the current controlling transistor when a current higher than a current signal supplied from the current controlling transistor to the current-driven device is passed between its source and drain; a current source for outputting the higher current to the driving transistor; an operational amplifier having a noninverting input terminal connected to the drain of the driving transistor, and an output terminal connected to its inverting input terminal and the gate of the current controlling transistor; an input terminal for receiving a predetermined initialization potential; and a switch connected between this input terminal and the noninverting input terminal of the operational amplifier.

A current-driven apparatus according to the present invention comprises: a current-driven device to be controlled in operation depending on the intensity of a current input thereto; and any one of the foregoing driving circuits for supplying the current to the current-driven device.

The current-driven device may be an organic EL device, and the current-driven apparatus according to the present invention may be an organic EL display.

A method of driving a current-driven apparatus according to the present invention is one for driving a current-driven apparatus including a current-driven device to be controlled in operation depending on the intensity of a current input thereto. This method of driving a current-driven apparatus comprises the steps of: writing a signal to a current controlling transistor for determining the intensity of the current to be supplied to the current-driven device; supplying the current to the current-driven device based on the written signal, thereby driving the current-driven device. The step of writing includes: setting a gate potential of the current controlling transistor by using a potential generating circuit so that the current flows through the current-driven device; and initializing the potential generating circuit to an initialization potential before the gate potential of the current controlling transistor is set to the potential.

The current controlling transistor may be configured so that its gate potential is determined by input of a current signal. In this case, The step of writing may include a step of inputting the current signal to the current controlling transistor after step of generating the potential. The step of generating potential may be a step of precharging the gate potential of the current controlling transistor to a potential determined by the input of the current signal to the current controlling transistor.

According to the present invention, the initialization circuit initializes the potential generating circuit to the initialization potential before the potential generating circuit generates the potential. The potential generation can thus be performed quickly. It is therefore possible to reduce the time necessary for potential settlement. In particular, when the current controlling transistor is controlled based on the current signal, and the potential output circuit is a precharge circuit of this current controlling transistor, it is possible to reduce the time necessary for precharge. Then, the time for writing the current signal can be extended accordingly, so that the current signal can be written accurately.

DETAILED DESCRIPTION OF THE PREFERRED EMBODIMENTS

Figure 4:
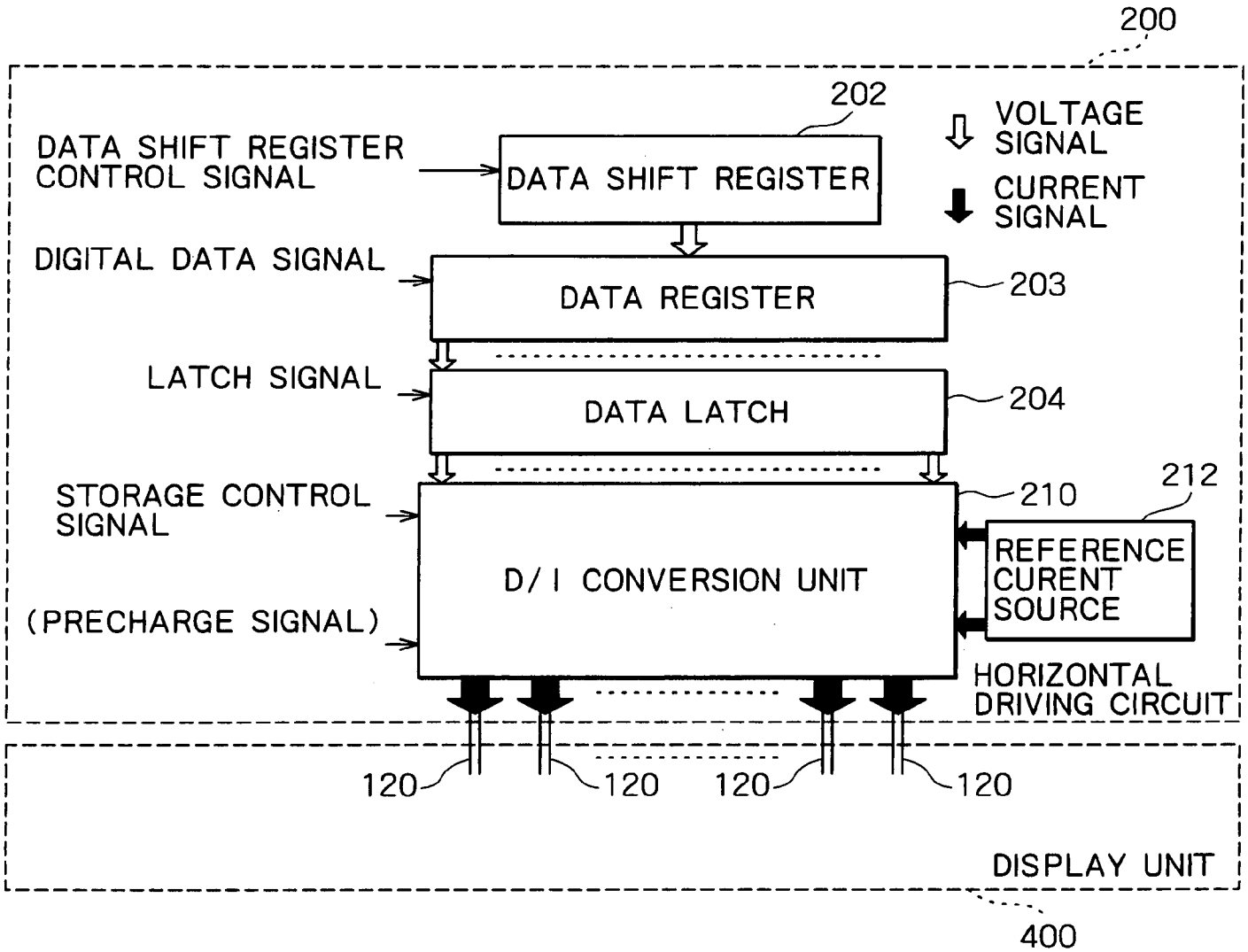
FIG. 4 is a block diagram showing a horizontal driving circuit of the organic EL display according to a first embodiment of the present invention.
Figure 5:
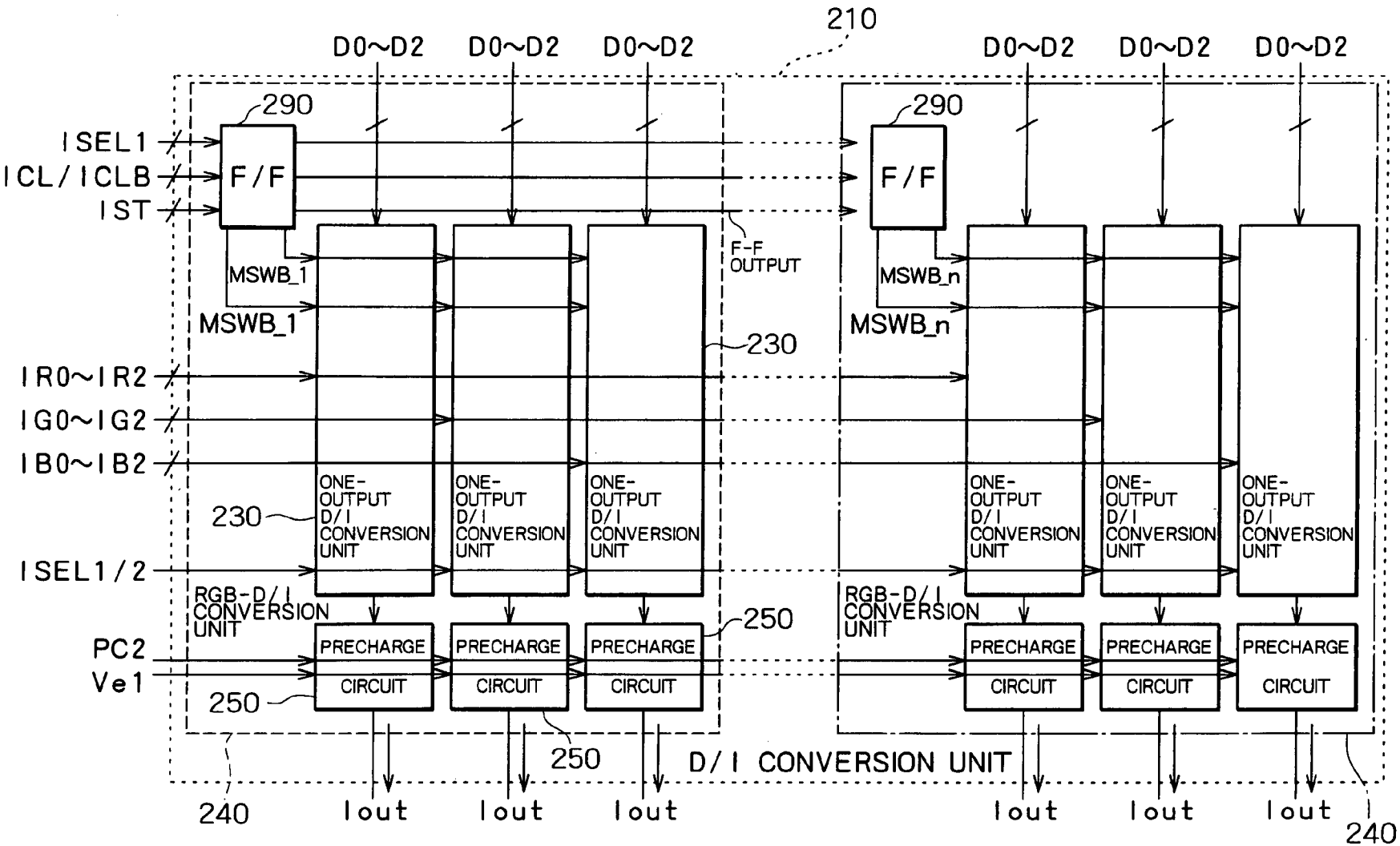
FIG. 5 is a block diagram showing the D/I conversion unit of the horizontal driving circuit shown in FIG. 4.
Figure 6:
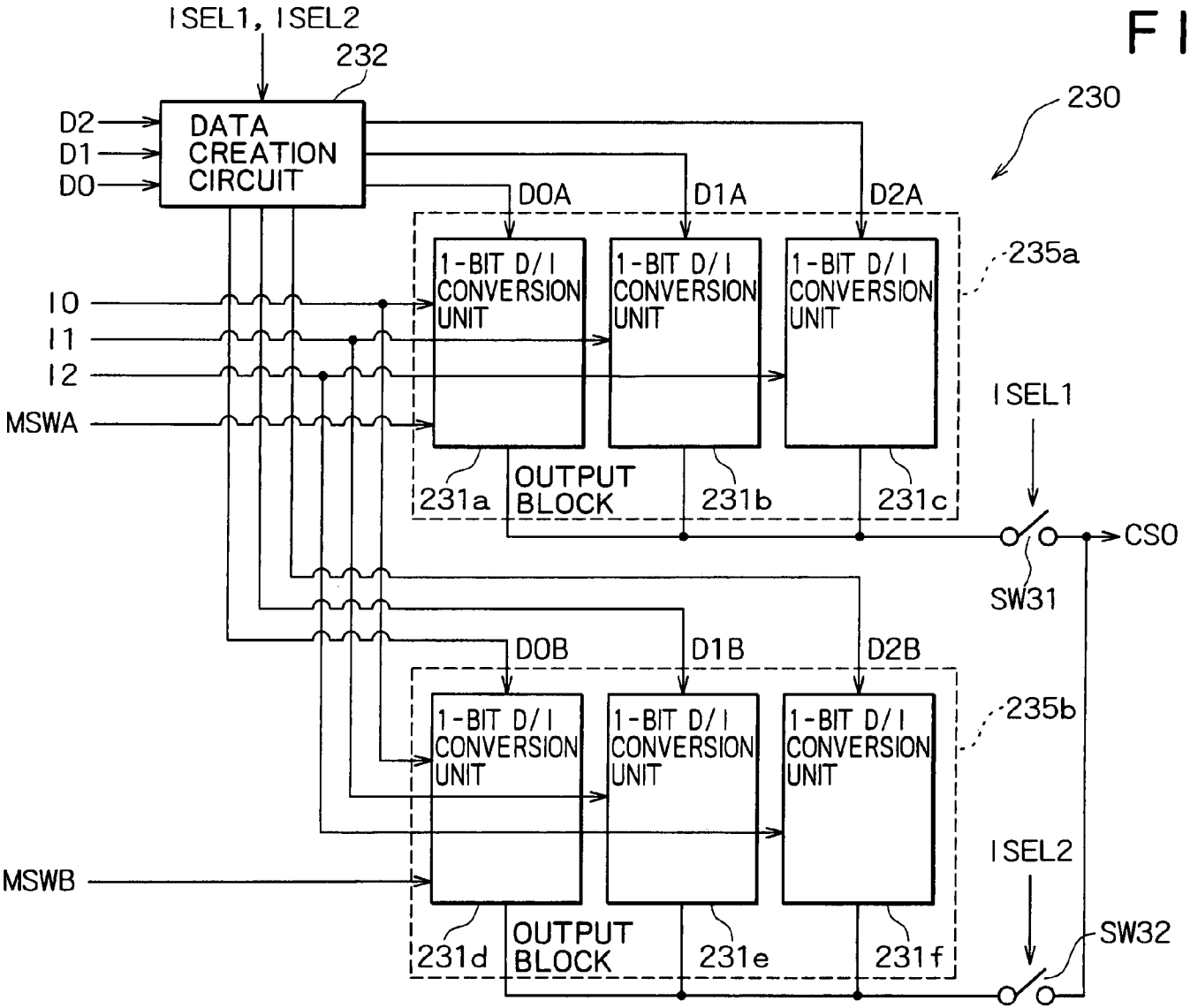
FIG. 6 is a block diagram showing a one-output D/I conversion unit of the D/I conversion unit shown in FIG. 5.
Figure 7:
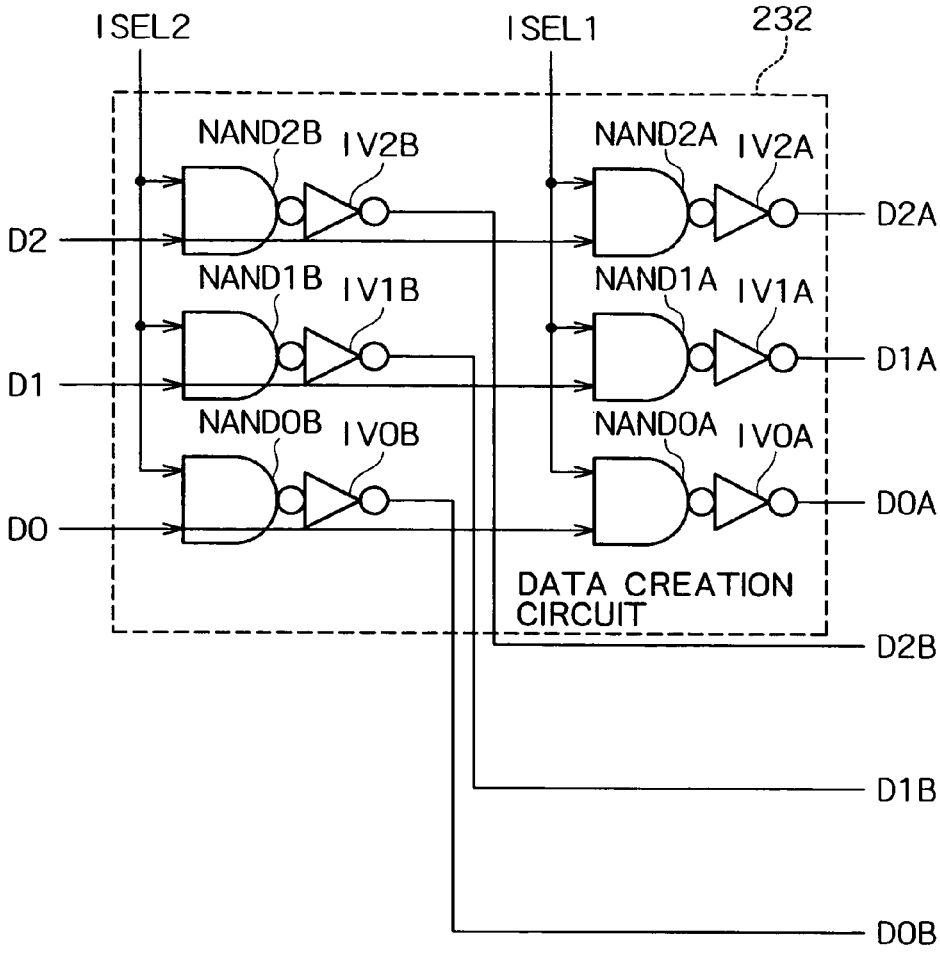
FIG. 7 is a circuit diagram showing the data creation circuit shown in FIG. 6.
Figure 8:
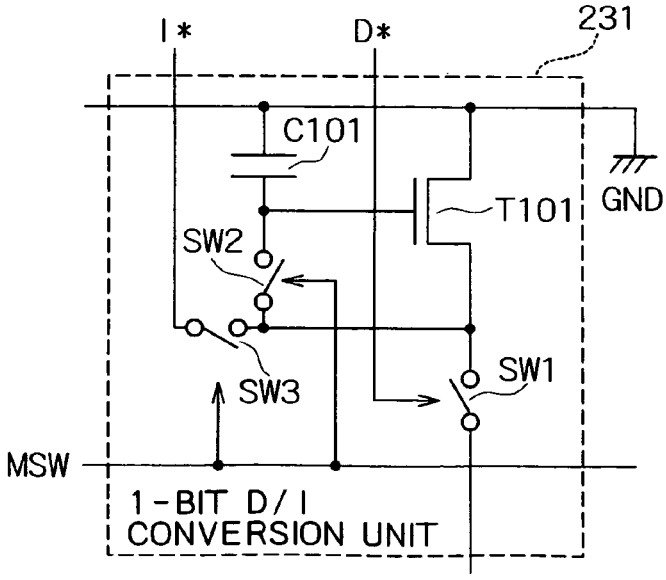
FIG. 8 is a block diagram showing a 1-bit D/I conversion unit shown in FIG. 6.
Figure 9:
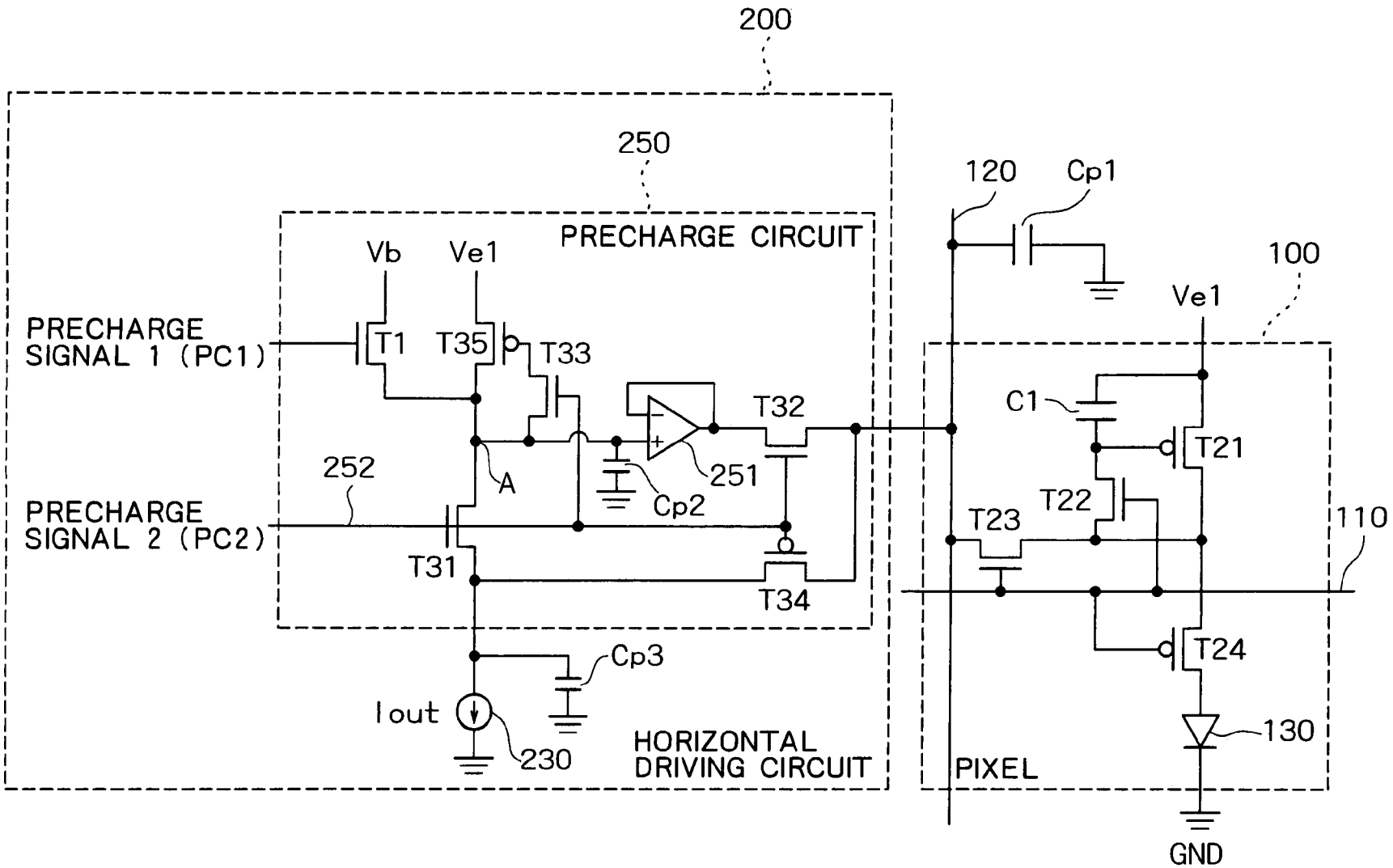
FIG. 9 is a circuit diagram showing a D/I conversion unit and a precharge circuit for each single data line, and a pixel circuit for each single pixel in the organic EL display according to the present embodiment.

Hereinafter, embodiments of the present invention will be described concretely with reference to the accompanying drawings. Initially, description will be given of a first embodiment of the present invention. The current-driven apparatus according to the present embodiment is an organic EL display. FIG. 4 is a block diagram showing a horizontal driving circuit of the organic EL display according to the present embodiment. FIG. 5 is a block diagram showing a D/I conversion unit of the horizontal driving circuit shown in FIG. 4. FIG. 6 is a block diagram showing a one-output D/I conversion unit of the D/I conversion unit shown in FIG. 5. FIG. 7 is a circuit diagram showing the data creation circuit shown in FIG. 6. FIG. 8 is a block diagram showing a 1-bit D/I conversion unit shown in FIG. 6. FIG. 9 is a circuit diagram showing the D/I conversion unit and a precharge circuit for each single data line, and a pixel circuit for each single pixel in the organic EL display according to the present embodiment.

Incidentally, for convenience of explanation, a plurality of identical members may hereinafter be described in a singular form representatively.

Figure 1:
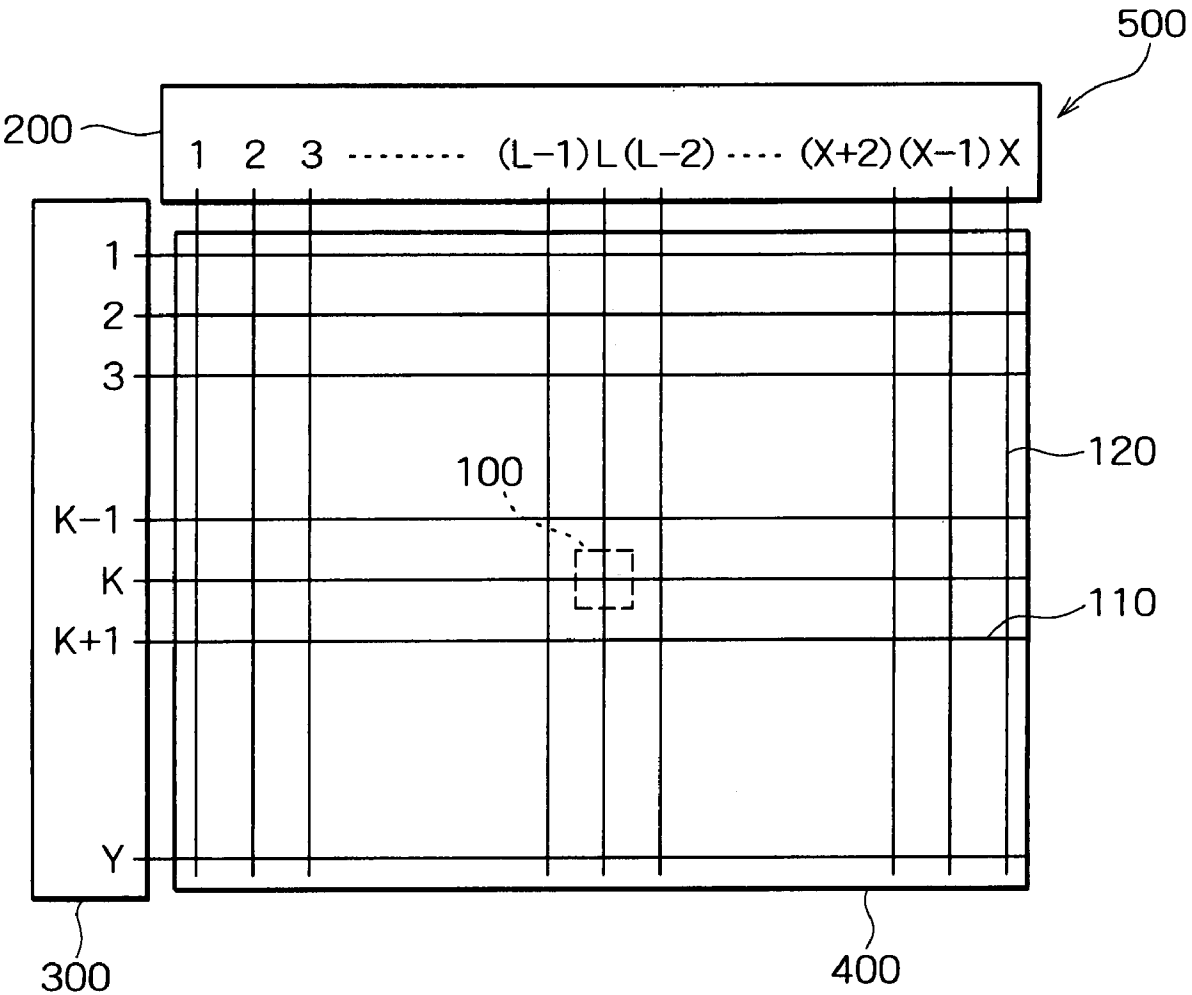
FIG. 1 (PRIOR ART)
FIG. 1 is a block diagram showing a conventional organic EL display.

As shown in FIG. 1, the organic EL display 500 according to the present embodiment is provided with a display unit 400. This display unit 400 has a plurality of pixels 100 which are arranged in a matrix. The organic EL display 500 is also provided with a horizontal driving circuit 200 and a vertical scanning circuit 300 for driving the display unit 400. The horizontal driving circuit 200 is connected to the pixels 100 through data lines 120. The vertical scanning circuit 300 is connected to the pixels 100 through control lines 110.

As shown in FIG. 4, the horizontal driving circuit 200 has a data register 203, to which a digital data signal is input. The data register 203 holds this digital data signal, and outputs it in association with the data lines 120 successively. Incidentally, in FIG. 4, the white arrows represent voltage signals, and the black arrows current signals. The digital data signal is a voltage signal for indicating display data. For example, it is a digital signal having three bits for each color. There is also provided a data shift register 202. The data shift register 202 receives a data shift register control signal, and outputs a scanning signal to the data register 203. This scanning signal is a signal for controlling the timing at which the data register 203 holds the digital data signal. There is also provided a data latch 204, to which a latch signal and the output signal of the data register are input. The data latch 204 holds the output signal of the data register 203 in synchronization with the latch signal, and outputs a lineful of output signals together. There is also provided a D/I conversion unit 210, to which the output signals of the data latch 204, or digital voltage signals, are input. The D/I conversion unit 210 converts these output signals into analog current signals, and outputs the same to the display unit 400 through the data lines 120. There is also provided a reference current source 212, which supplies reference currents to the D/I conversion unit 210.

As shown in FIG. 5, the D/I conversion unit 210 has one-output D/I conversion units 230 as many as the number of data lines 120 (see FIG. 4). Precharge circuits 250 are arranged between the one-output D/I conversion units 230 and the data lines 120. Each of the one-output D/I conversion units 230 is connected to a single data line 120 through a precharge circuit 250, and outputs a current signal to this single data line 120. Corresponding to three pixels for emitting light in R, G, and B colors, respectively, every three one-output D/I conversion units 230 are grouped into an RGB-D/I conversion unit 240. A single flip-flop (F/F) 290 is provided for each RGB-D/I conversion unit 240.

Then, all the F/Fs 290 in the D/I conversion unit 210 constitute a single shift register. This shift register receives a start signal IST, a clock signal ICL, and the inverted signal of the clock signal ICL, or an inverted clock signal ICLB which are intended for control on the timing of current storage. The shift register outputs signals MSWA and MSWB to the one-output D/I conversion units 230.

The precharge circuits 250 receive current signals Iout, a precharge signal PC2, and a supply voltage Ve1. They precharge the data lines 120 to a predetermined potential when the precharge signal PC2 is at high level, and supply the current signals Iout to the data lines 120 when the precharge signal PC2 is at low level.

Next, description will be given in detail of the configuration of the one-output D/I conversion units 230. The one-output D/I conversion units 230 each receive the signals MSWA and MSWB from the F/Fs 290, any one of groups of reference currents IR0 to IR2, IG0 to IG2, and IB0 to IB2 (hereinafter, referred to as reference currents I0 to I2) supplied from the reference current source 212 (see FIG. 4), three bits of digital data signals D0 to D2 from the data latch 204 (see FIG. 4), and current selector signals ISEL1 and ISEL2. Consequently, the one-output D/I conversion units 230 convert the three bits of digital data signal D0 to D2 into eight possible levels of current signals Iout, and output the same to the precharge circuits 250. Incidentally, the start signal IST, the clock signal ICL, the inverted clock signal ICLB, and the current selector signals ISEL1 and ISEL2 will also be referred to collectively as a storage control signal (see FIG. 4).

The reference currents IR0 to IR2 are currents for making red (R) light-emitting devices emit light at predetermined tone levels. The reference current IR0 is equivalent to a current for making a light-emitting device emit light at a tone level of 1. The reference current IR1 is equivalent to a current for making a light-emitting device emit light at a tone level of 2. The reference current IR2 is equivalent to a current for making a light-emitting device emit light at a tone level of 4. Then, these reference currents can be combined arbitrary to produce eight possible levels of values as the values of the current signals Iout, which range from 0 to the sum of the reference currents IR0 to IR2. As a result, it is possible to render eight tone levels on the light-emitting devices. The same holds for the reference currents IG0 to IG2 (green) and the reference currents IB0 to IB2 (blue).

As shown in FIG. 6, each one-output D/I conversion unit 230 has a data creation circuit 232. The data creation circuit 232 receives the digital data signals D0 to D2 and the current selector signals ISEL1 and ISEL2. Based on these signals, the data creation circuit 232 generates digital data signals D0A to D2A and digital data signals D0B to D2B. The one-output D/I conversion unit 230 is also provided with six 1-bit D/I conversion units 231*a* to 231*f*, which are grouped in three into two output blocks. More specifically, the 1-bit D/I conversion units 231*a* to 231*c* constitute an output block 235*a*, and the 1-bit D/I conversion units 231*d* to 231*f* constitute an output block 235*b*.

Each 1-bit D/I conversion unit receives a single bit of digital data signal and one of the reference currents. The 1-bit D/I conversion unit stores this reference current, and outputs a current having the same intensity as that of the one reference current when the digital data signal is "selected" (for example, at high level), and stops outputting the current when "not selected" (for example, at low level). More specifically, the 1-bit D/I conversion unit 231*a* receives the digital data signal D0A and the reference current I0, and outputs the current having the same intensity as that of the reference current I0 when the digital data signal D0A is "selected." The 1-bit D/I conversion unit 231*b* receives the digital data signal D1A and the reference current I1, and outputs the current having the same intensity as that of the reference current I1 when the digital data signal D1A is "selected." The 1-bit D/I conversion unit 231*c* receives the digital data signal D2A and the reference current I2, and outputs the current having the same intensity as that of the reference current I2 when the digital data signal D2A is "selected." The sum of the output currents of the 1-bit D/I conversion units 231*a* to 231*c* is the current signal Iout to be output from the output block 235*a*.

Similarly, the 1-bit D/I conversion unit 231*d* receives the digital data signal D0B and the reference current I0, and outputs the current having the same intensity as that of the reference current I0 when the digital data signal D0B is "selected." The 1-bit D/I conversion unit 231*e* receives the digital data signal D1B and the reference current I1, and outputs the current having the same intensity as that of the reference current I1 when the digital data signal D1B is "selected." The 1-bit D/I conversion unit 231*f* receives the digital data signal D2B and the reference current I2, and outputs the current having the same intensity as that of the reference current I2 when the digital data signal D2B is "selected." The sum of the output currents of the 1-bit D/I conversion units 231*d* to 231*f* is the current signal Iout to be output from the output block 235*b*.

The one-output D/I conversion unit 230 also has switches SW31 and SW32 for switching which block to output the current signal Iout from, the output block 235*a* or 235*b*.

As shown in FIG. 8, each 1-bit D/I conversion unit 231 has an N-channel transistor (TFT) T101 intended for current storage and output, switches SW1 to SW3, and a capacitor C101. The switch SW1 is connected to the drain of the N-channel transistor T101, and is controlled by the digital data signal D*. The output current Iout is output from the other end of the switch SW1. The switch SW2 is connected to the node between the switch SW1 and the N-channel transistor T101, and to between one end of the capacitor C101 and the gate of the N-channel transistor T101. The switch SW2 is controlled by the signal MSWA or MSWB. An end of the switch SW3 is connected to a signal line to which the reference current I* is supplied. The other end is connected to between the one end of the capacitor C101 and the node between the switch SW1 and the N-channel transistor T101. The switch SW3 is controlled by the signal MSWA or MSWB. The source of the N-channel transistor T101 and the other end of the capacitor C101 are grounded, for example. Nevertheless, a voltage higher than the ground potential GND may be supplied thereto unless any problem occurs in operation. Incidentally, the digital data signal D* and the reference current signal I* correspond to any one of the pairs of the digital data signal D0 and the reference current I0, the digital data signal D1 and the reference current I1, and the digital data signal D2 and the reference current I2.

As shown in FIG. 7, the data creation circuit 232 has NAND circuits NAND0A to NAND2A and inverters IV0A to IV2A. Each of the NAND circuits NAND0A to NAND2A receives one of the digital data signals D0 to D2 and the current selector signal ISEL1. The output signals of the NAND circuits NAND0A to NAND2A are input to the inverters IV0A to IV2A, respectively. The outputs of the inverters IV0A to IV2A are the digital data signals D0A to D2A. The data creation circuit 232 also has NAND circuits NAND0B to NAND2B and inverters IV0B to IV2B. Each of the NAND circuits NAND0B to NAND2B receives one of the digital data signals D0 to D2 and the current selector signal ISEL2. The output signals of the NAND circuits NAND0B to NAND2B are input to the inverters IV0B to IV2B, respectively. The outputs of the inverters IV0B to IV2B are the digital data signals D0B to D2B. Consequently, as shown in FIG. 6, the digital data signal D0A to D2A are output to the output block 235*a* when the current selector signal ISEL1 is "selected" and the current selector signal ISEL2 is "not selected." The digital data signals D0B to D2B are output to the output block 235*b* when the current selector signal ISEL1 is "not selected" and the current selector signal ISEL2 is "selected."

As shown in FIG. 9, each pixel 100 has a pixel circuit in which a P-channel transistor T21 intended for current storage, a P-channel transistor T24 intended for switching, and an organic EL device 130 are connected in series in this order between the supply voltage Ve1 and the ground potential GND. The P-channel transistor T21 serves as a current controlling transistor, and the organic EL device 130 as a light-emitting device. The gate of the current storing P-channel transistor T21 is connected to a data line 120 through N-channel transistors T22 and T23 intended for switching. The gates of the switching transistors T22 to T24 are connected to a control line 110. A capacitor C1 is arranged between the gate of the current storing transistor T21 and the supply voltage Ve1. The node between the switching transistors T22 and T23 is connected to the node between the current storing transistor T21 and the switching transistor T24, whereby the gate of the current storing P-channel transistor T21 is connected to the source of the transistor T21 through the switching transistor T22. A parasitic capacitance Cp1 lies between the data line 120 and the ground potential.

Moreover, as shown in FIG. 9, each precharge circuit 250 undergoes the supply voltage Ve1. For a potential generating circuit, a P-channel transistor T35 intended for driving and an N-channel transistor T31 intended for switching are connected in series in this order between the terminal to which the supply voltage Ve1 is applied and a one-output D/I conversion unit 230. More specifically, either one of the source and drain (hereinafter, referred to as one terminal) of the N-channel transistor T31 is connected to the driving P-channel transistor T35. The other of the source and drain (hereinafter, referred to as the other terminal) is connected to the ground potential through the one-output D/I conversion unit 230. Incidentally, the driving P-channel transistor T35 has the same size as that of the current storing P-channel transistor T21 of the pixel 100. The two transistors thus have substantially the same characteristics. There are also provided N-channel transistors T32 and T33 and a P-channel transistor T34 which are intended for switching. The gates of these switching transistors T31 to T34 are connected to wiring 252. The precharge signal PC2 is input to the wiring 252 from exterior.

Then, the node A between the driving P-channel transistor T35 and the switching N-channel transistor T31 is connected to one terminal of the N-channel transistor T33 intended for switching. The other terminal of this transistor T33 is connected to the gate of the driving P-channel transistor T35. A voltage follower amplifier 251 is arranged between the node A and the switching transistor T32. The node A is connected to the noninverting input terminal of this voltage follower amplifier 251. The output of the amplifier 251 is connected to one terminal of the transistor T32 and the inverting input terminal of the amplifier 251. The other terminal of the transistor T32 is connected to the data line 120. Moreover, one terminal of the switching P-channel transistor T34 is connected to the one-output D/I conversion unit 230. The other terminal of the transistor T34 is connected to the data line 120. Incidentally, as shown in FIG. 9, the present embodiment provides the switching N-channel transistor T33 for switching whether or not to establish a short circuit between the gate and drain of the driving P-channel transistor T35. This transistor T33 may be omitted, however, so that the gate and drain of the driving P-channel transistor T35 are shorted directly.

The precharge circuit 250 also has an N-channel transistor T1 intended for switching as an initialization circuit. Either one of the source and drain (one terminal) of this N-channel transistor T1 receives a reference potential Vb, and the other (the other terminal) is connected to the node A. The gate receives a precharge signal PC1 from exterior of the precharge circuit 250. Incidentally, the reference potential Vb is equal to the potential at the source and gate of the driving P-channel transistor T35 (precharge output potential) when the pixel 100 displays a tone level of 0 (black). More specifically, the reference potential Vb is a potential at which the current signal Iout falls to its minimum and thus the P-channel transistor T35 comes closest to an off state. In terms of the precharge output potential, it is the highest potential among those for all the tone levels. Moreover, the reference potential Vb is applied commonly to all the precharge circuits 250 in the horizontal driving circuits 200. Incidentally, in the present embodiment, the organic EL devices 130 correspond to the current-driven devices. The pixel circuits of the pixels 100 excluding the organic EL devices 130, and the horizontal driving circuit 200 and the vertical scanning circuit 300 correspond to the driving circuit for driving the organic EL devices 130.

Figure 10:
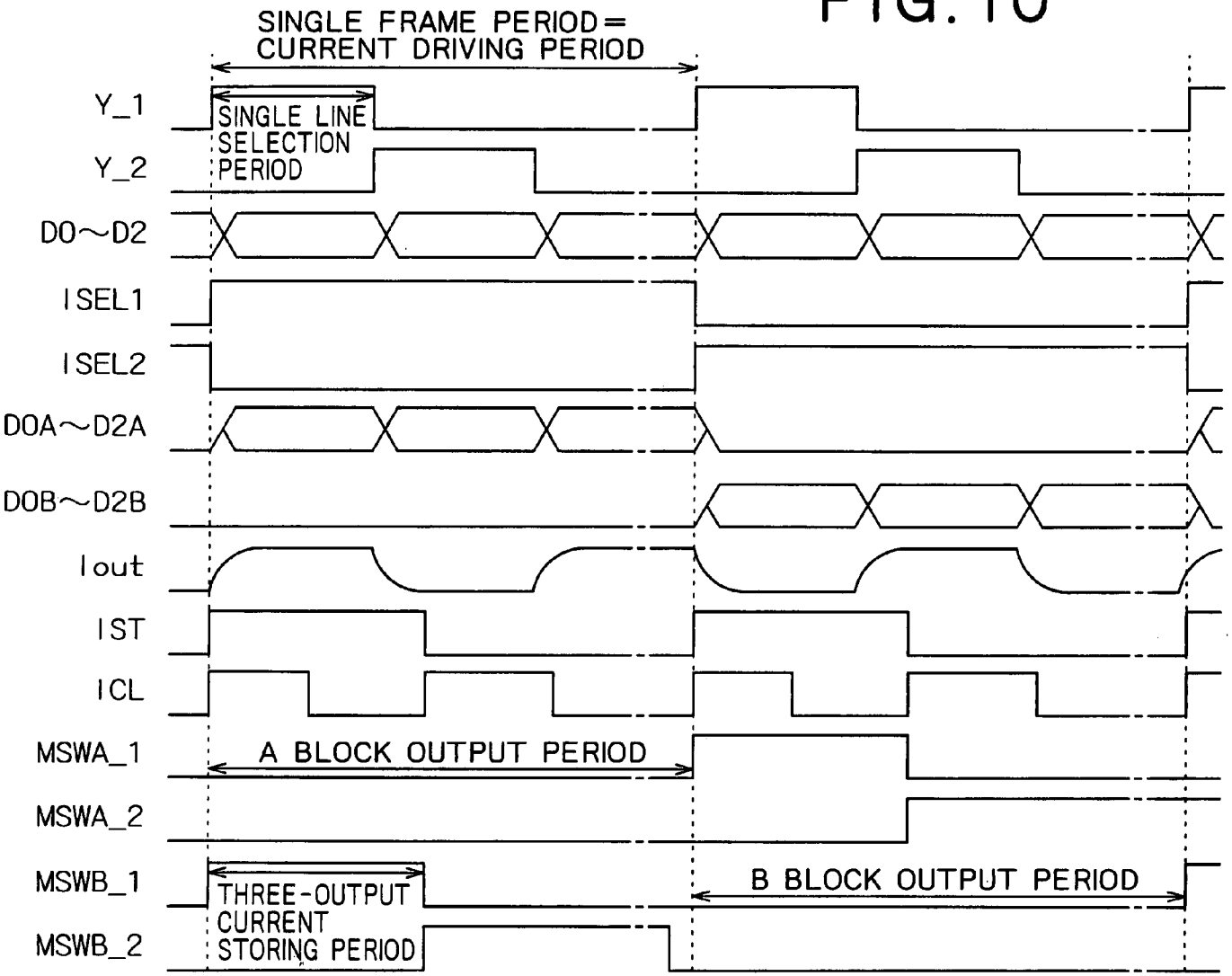
FIG. 10 is a timing chart for showing the operation of the organic EL display according to the present embodiment.
Figure 11:
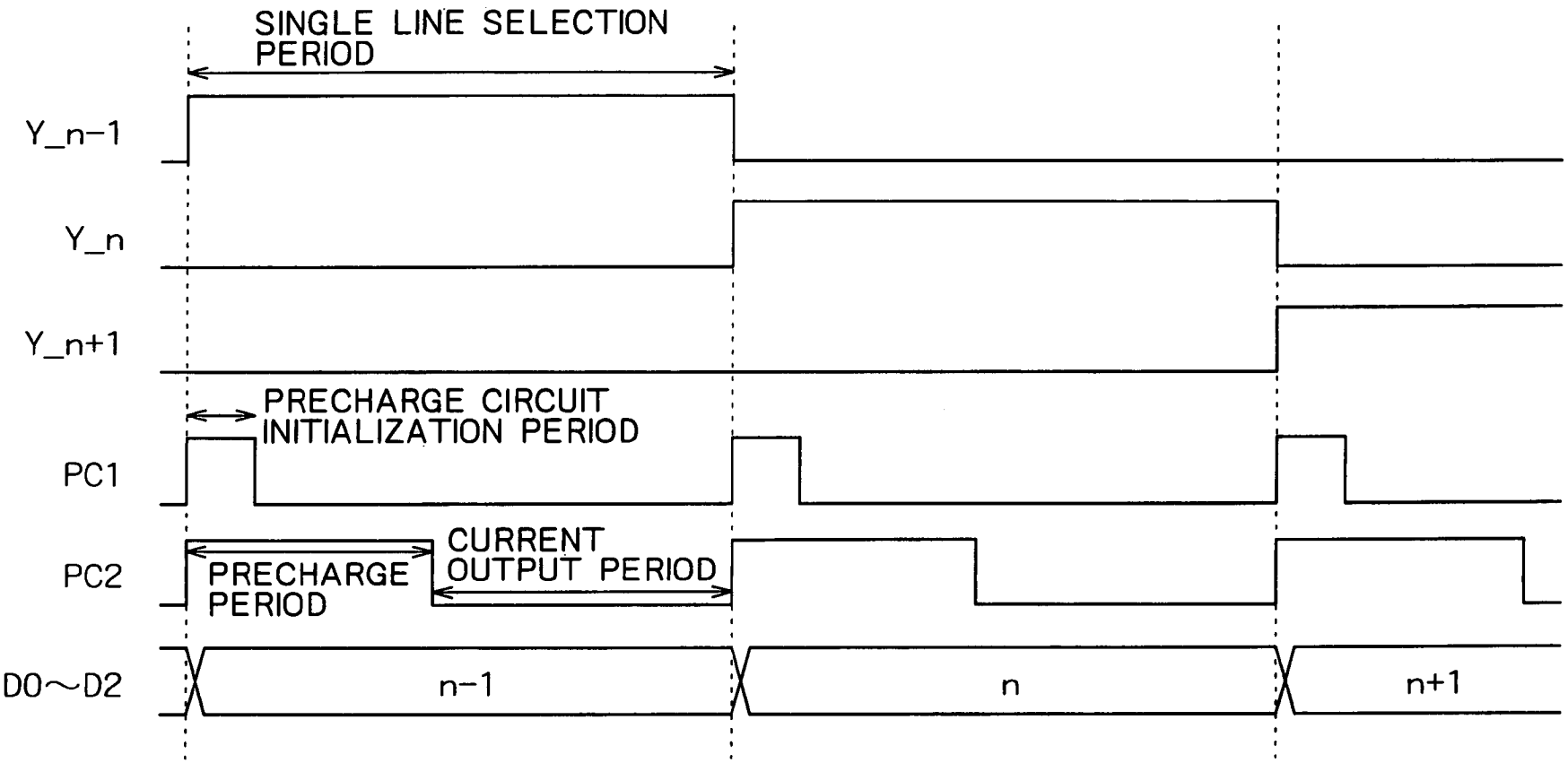
FIG. 11 is a timing chart for showing the operation for a single horizontal period (single line selection period) shown in FIG. 10.

Next, description will be given of the operation of the driving circuit according to the present embodiment which is configured as described above, i.e., the method of driving the organic EL display according to the present embodiment. FIG. 10 is a timing chart for showing the operation of the organic EL display according to the present embodiment. FIG. 11 is a timing chart for showing the operation for a single horizontal period (single line selection period) shown in FIG. 10. In FIG. 11, the operations of three control lines Y_n−1, Y_n, and Y_n+1 are shown as the operations of the control lines 110.

As shown in FIG. 10, a single frame period shall refer to the period between when the vertical scanning circuit 300 shown in FIG. 1 starts a vertical scan over the display unit 400 and when it starts the next vertical scan. That is, one frame period is the basic cycle for the display unit 400 to display a single image. In the present embodiment, two types of frame periods, or an A block output period and a B block output period, occur alternately. In each of the periods, either one of the current selector signals ISEL1 and ISEL2, which are complementary signals, is turned to high level and the other low level. In the two types of frame periods, either one of the output block 235*a* (A block) and 235*b* (B block) shown in FIG. 6 stores the reference currents while the reference currents stored in the other are used to generate a current signal and this current signal is output. More specifically, in the A block output period, the reference currents stored by the output block 235*a* (A block) in the previous frame period are used to generate a current signal based on the digital data signals. This current signal is output to the display unit 400 through the precharge circuit 250 while the output block 235*b* (B block) stores the reference currents. This A block output period is followed by the B block output period, in which the output block 235*b* (B block) outputs a current signal while the output block 235*a* (A block) stores the reference currents to be used in the next A block output period.

Next, description will be given of the operation in a single frame period. As shown in FIG. 10, during a single frame period, two types of operations having different operating cycles are performed in parallel. For example, in the A block output period, the two types of operations refer to one in which the output block 235*a* (A block) outputs the current signal, and one in which the output block 235*b* (B block) stores the reference currents. The basic cycle of the signal output operation of the A block is determined by the number of rows of the pixels 100 on the display unit 400, i.e., the number of control lines 110. This basic cycle is the time equivalent to a single frame period divided by the number of rows of the pixels 100. On the other hand, the basic cycle of the signal storing operation of the B block is determined by the number of columns of the groups consisting of the pixels in R, G, and B colors arranged in the column direction on the display unit 400, i.e., the number of RGB-D/I conversion units 240. This basic cycle is the time equivalent to a single frame period divided by (⅓) the number of columns of the pixels 100. Incidentally, the current selector signals ISEL1 and ISEL2 shown in FIG. 10 are intended to switch the storing operation and output operation of each output block. The control signals Y_1 and Y_2, and the digital data signals D0 to D2, D0A to D2A, and D0B to D2B pertain to the output operation. The start signal IST, the clock signal ICL, and the signals MSWA_1, MSWA_2, MSWB_1, and MSWB_2 pertain to the storing operation.

Initially, as shown in FIG. 4, in the horizontal driving circuit 200, the data shift register control signal is input to the data shift register 202. The data shift register 202 outputs the scanning signal to the data register 203. Next, the data register 203 accepts the digital data signal indicating the image contents in synchronization with this scanning signal, and outputs it to the data latches 204 in association with the data lines 120 successively. Note that the digital data signal is a voltage signal having three bits for each of R, G, and B colors. Next, the latch signal is input to the data latch 204. The data latch 204 accepts the output signal of the data register 203 in synchronization with this latch signal, and outputs a lineful of output signals to the D/I conversion unit 201 together. The signals to be output to each line here are the digital data signals D0 to D2. In addition, the reference current source 212 supplies the reference currents I0 to I2 to the D/I conversion unit 210.

Then, as shown in FIG. 5, the digital data signals D0 to D2 are input to the one-output D/I conversion units 230 of the D/I conversion unit 210. The reference currents I0 to I2 are also input to the one-output D/I conversion units 230. To be more specific, the one-output D/I conversion units 230 for outputting reference currents to the red pixels receive red reference currents IR0 to IR2. The one-output D/I conversion units 230 for outputting reference currents to the green pixels receive green reference currents IG0 to IG2. The one-output D/I conversion units 230 for outputting reference currents to the blue pixels receive blue reference currents IB0 to IB2.

In the meantime, among the F/Fs 290 constituting the shift register in the D/I conversion unit 210, the F/F 290 in the forefront stage receives the start signal IST, the clock signal ICL, and the inverted clock signal ICLB. As shown in FIG. 10, when the start signal IST turns to high level, the F/F 290 in the forefront stage outputs the signal MSWB_1 to the one-output D/I conversion units 230 that belong to the same RGB-D/I conversion unit 240 as this F/F 290 does, in synchronization with the clock signal ICL. That is, the signal MSWB_1 turns to high level, and the signal MSWA_1 turns to low level. At the next clock cycle, the signal MSWB_1 turns to low level, and the F/F 290 in the next stage outputs the signal MSWB_2 of high level to the 1-bit D/I conversion units 231 that belong to the same RGB-D/I conversion unit 240. In this way, after the start signal IST turns to high level, the plurality of F/Fs 290 constituting the shift register successively turn their output signals MSWB to high level in synchronization with the clock signal.

At this time, as shown in FIG. 6, in the one-output D/I conversion unit 230, the data creation circuit 232 receives the digital data signals D0 to D2 and the current selector signals ISEL1 and ISEL2. In the A block output period, the current selector signal ISEL1 is at high level, and the current selector signal ISEL2 is at low level. Then, as shown in FIG. 7, in the data creation circuit 232, the NAND circuits NAND0A to NAND2A output the inverted signals of the digital data signals D0 to D2 to the inverters IV0A to IV2A, respectively, since the current selector signal ISEL1 is at high level. The inverters IV0A to IV2A output the signals D0A to D2A having the same levels as those of the digital data signal D0 to D2 to the 1-bit D/I conversion units 231*a* to 231*c*, respectively. Meanwhile, since the current selector signal ISEL2 is at low level, the NAND circuits NAND0B to NAND2B output high level regardless of the levels of the digital signals D0 to D2. The inverters IV0B to IV2B output the digital data signals D0B to D2B of low level to the 1-bit D/I conversion units 231*d* to 231*f* all the time.

Consequently, as shown in FIG. 6, each of the 1-bit D/I conversion units 231*a* to 231*c* belonging to the output block 235*a* (A block) receives one of the digital data signals D0A to D2A, one of the reference currents I0 to I2, and the signal MSWA. Specifically, the 1-bit D/I conversion unit 231*a* receives the digital data signal D0A, the reference current I0, and the signal MSWA. The 1-bit D/I conversion unit 231*b* receives the digital data signal D1A, the reference current I1, and the signal MSWA. The 1-bit D/I conversion unit 231*c* receives the digital data signal D2A, the reference current I2, and the signal MSWA. During the A block output period, the signal MSWA remains at low level.

In the mean time, each of the 1-bit D/I conversion units 231*d* to 231*f* belonging to the output block 235*b* (B block) receives one of the digital data signals D0B to D2B, one of the reference currents I0 to I2, and the signal MSWB. During the A block output period, the digital data signals D0B to D2B are always at low level, and the signal MSWB at high level.

Next, the operation of the individual 1-bit D/I conversion units 231 will be described with reference to FIG. 8. Initially, description will be given of the storing operation of the 1-bit D/I conversion units 231*d* to 231*f* which belong to the output block 235*b* (B block). In the 1-bit D/I conversion units 231*d* to 231*f*, the switches SW2 and SW3 turn on and the switch SW1 turns off since the signal MSWB_1 (in FIG. 8, represented by MSW) is at high level and the digital data signals D0B to D2B (in FIG. 8, represented by D*) are at low level. As a result, the capacitor C101 is charged with the reference current I*. Besides, the gate and drain of the N-channel transistor T101 intended for current storage and output are short-circuited, so that the transistor T101 operates in a saturation region. In the stabilized state of this operation, the gate voltage of the N-channel transistor T101 is set in accordance with the current capacity thereof so that the reference current I* flows between the drain and source of the N-channel transistor T101.

After the gate voltage of the N-channel transistor T101 reaches a stable state, the signal MSWB_1 turns to low level, and the output signal MSWB_2 of the F/F 290 in the second stage turns to high level. This turns off the switches SW2 and SW3 of the 1-bit D/I conversion units 231*d* to 231*f* in the RGB-D/I conversion unit 240 that includes the F/F 290 of the first stage. At this time, the capacitors C101 hold the gate voltages of the N-channel transistors T101 so that the reference currents flow between the respective sources and drains. Consequently, the N-channel transistors T101 store the reference currents regardless of the current capacities. Incidentally, as shown in FIG. 10, the period during which the signal MSW is thus at high level will be referred to as a three-output current storing period of the RGB-D/I conversion unit 240. Next, the signal MSWB_2 turns to high level. This turns on the switches SW2 and SW3 of the 1-bit D/I conversion units 231*d* to 231*f* in the RGB-D/I conversion unit 240 that includes the F/F 290 of the second stage, whereby the reference currents are stored. In this way, the reference currents are stored into the RGB-D/I conversion units 240 successively.

Next, description will be given of the storing operation of the 1-bit D/I conversion units 231*a* to 231*c* which belong to the output block 235*a* (A block). Note that the 1-bit D/I conversion units 231*a* to 231*c* have stored the reference currents in the immediately previous frame period. In the 1-bit D/I conversion units 231*a* to 231*c*, the switches SW2 and SW3 turn off since the signal MSWA_1 (in FIG. 8, represented by MSW) is at low level. Thus, the reference current I* is not applied to the N-channel transistor T101. Since the digital data signals D0A to D2A (in FIG. 8, represented by D*) are signals of high level or low level, indicating the display data, the switch SW1 is turned on or off based on this signal D*. That is, when the digital data signal D* is at high level, the switch SW1 is turned on to output the current signal. At this time, the gate voltage of the N-channel transistor T101 is held at a predetermined value by the capacitor C101. The output current thus has the same intensity as that of the reference current I*. On the other hand, if the digital data signal D* is at low level, the switch SW1 is turned off and no current signal is output. Then, as shown in FIG. 6, the total sum of the output currents from the 1-bit D/I conversion units 231*a* to 231*c* belonging to the output block 235*a* (A block) is output to the precharge circuit 250 (see FIG. 5) as the output current Iout.

Next, description will be given of the operation of the precharge circuits 250 and the display unit 400. As shown in FIG. 11, the vertical scanning circuit 300 selects the control lines 110 in succession, turning the signals to be applied to the control lines Y_n−1, Y_n, and Y_n+1 to high level (select) successively. The period in which a signal of high level is applied to a single control line is referred to as a single line selection period. The single line selection period is equivalent to a write period for writing a lineful of signals to the display unit 400. For example, when the control line Y_n−1 is selected, the pixels in connection with this control line Y_n−1 are in a write period. The pixels in connection with the other control lines are in a display period (drive period) for displaying an image based on signals written in write periods. A single line selection period includes a precharge period and a current output period in this order. The precharge period has a precharge circuit initialization period in its initial stage.

Initially, the vertical scanning circuit 300 (see FIG. 1) scans the control lines 110. Then, the vertical scanning circuit 300 turns the signal to be applied to the control line Y_n−1 to high level, thereby starting a single line selection period of the control line Y_n−1. In synchronization with this, the precharge signals PC1 and PC2 are turned to high level to start the precharge circuit initialization period in the precharge period. At this time, as shown in FIG. 9, the switching N-channel transistor T1 turns on, whereby the potential at the source and gate of the driving P-channel transistor T35, i.e., the input potential of the voltage follower amplifier is set to the reference potential Vb. This reference potential Vb is set equal to the precharge potential in displaying a tone level of 0 (black). At this time, the switching N-channel transistors T31 to T33 are on, and the switching P-channel transistor T34 is off.

In the meantime, the one-output D/I conversion units 230 of the horizontal driving circuit 200 generate the current signals Iout based on the display data, or digital data signals, and output the current signals Iout to the data lines 120. As described previously, the display data has three bits, i.e., of eight tone levels for each of R, G, and B colors, for example.

Subsequently, as shown in FIG. 9, the precharge signal PC1 is turned to low level (not selected) to end the precharge circuit initialization period. At this time, the precharge signal PC2 is kept at high level (selected). Consequently, the transistor T1 is switched from on to off while the switching N-channel transistors T31 to T33 remain on and the switching P-channel transistor T34 off. As a result, the current signal Iout output from the one-output D/I conversion unit 230 is supplied to the gate and source of the driving P-channel transistor T35 through the transistors T31 and T33. This determines the amount of the current to flow through the driving P-channel transistor T35, and sets the potential of the node A to the potential corresponding to the current signal Iout.

Note that the current signal Iout is one on which the tone level to be rendered on the pixel 100 is reflected, and the tone level is not limited to the tone level of 0. Thus, when the tone level to be displayed on the pixel 100 is other than 0, the potential at the node A once rises to the reference potential Vb in the precharge circuit initialization period. After the end of the precharge circuit initialization period, the node A is lowered to a predetermined potential determined by the current signal Iout, i.e., the potential corresponding to the tone level (hereinafter, also referred to as tone level potential). On the other hand, if the tone level to be displayed on the pixel 100 is 0, the potential at the source and gate of the P-channel transistor T35 (precharge output potential), determined by the current signal Iout, is almost the same as the reference potential Vb. The node A thus makes little change in potential after the end of the precharge circuit initialization period.

Then, the potential of the node A is applied to the noninverting input terminal of the voltage follower amplifier 251. The same potential as that of the node A is output from the output terminal of the voltage follower amplifier 251 to the data line 120, whereby the data line 120 is precharged.

At this time, in each of the pixels 100 selected by the vertical scanning circuit 300 (see FIG. 1), the control line 110 is undergoing the signal of high level. This turns on the switching N-channel transistors T22 and T23. As a result, the data lines 120 is connected to the gate of the current storing P-channel transistor T21 and one end of the capacitor C1 through the transistors T23 and T22. Besides, the switching P-channel transistor T24 is turned off. This determines the amount of current to flow through the current storing P-channel transistor T21, and charges the capacitor C1. The potential corresponding to the current signal Iout can thus be written to the gate of the current storing P-channel transistor T21. More specifically, since the current storing P-channel transistor T21 of the pixel 100 has the same size and characteristics as those of the driving P-channel transistor T35 of the precharge circuit 250, the same currents flow between the respective sources and drains if the gate potentials are the same. The transistors can thus be given flat Id-Vd saturation characteristics, so that the currents of the same intensities flow.

Next, the precharge signal PC2 is switched to low level to end the precharge period and start the current output period. Since the precharge signal PC2 is switched to low level, the switching N-channel transistors T31 and T32 turn off, and the switching P-channel transistor T34 turns on. As a result, the current signal Iout is supplied from the one-output D/I conversion unit 230 to the data line 120 through the transistor T34. In this way, the current signals Iout are output from the horizontal driving circuit 200 to the data lines 120.

As a result, the pixels 100 are written with the current signals Iout. At this time, the data lines 120 are already precharged to a potential near the target values, and the current signals Iout have only to correct precharge-time errors in the potentials of the data lines 120. The current signals Iout are thus written to the pixels 100.

When the current output period ends and the vertical scanning circuit 300 selects the next control line Y_n, the signal applied to the control line Y_n−1 is turned to low level. Consequently, currents having the same intensities as those of the written current signals Iout flow through the current paths, each consisting of the current storing P-channel transistor T21, the switching P-channel transistor T24, and the organic EL device 130 connected in series in this order. The organic EL devices 130 emit light in tone levels corresponding to these currents.

The vertical scanning circuit 300 scans the control lines 110 to select the Y control lines 110 one by one in succession. Upon each selection, the horizontal driving circuit 200 outputs the current signals Iout corresponding to intended tone levels to the pixels 100 that are in connection with the control line 110 selected by the vertical scanning circuit 300. An image is displayed on the display unit 400 in this way.

In the present embodiment, the precharge circuit initialization period is arranged in the initial stage of the precharge period. During the precharge circuit initialization period, the potentials at the gates and sources of the driving P-channel transistors T35 in the precharge circuits 250, i.e., the input potentials of the voltage follower amplifiers are once raised to the potential Vb corresponding to a level-zero display (black display). Thus, rendering a tone level of 0 on the pixels 100 requires little time to settle the input potentials of the voltage follower amplifiers in the precharge period after the end of the precharge circuit initialization period. Consequently, the level-zero display (black display) can be rendered accurately. Moreover, it is possible to the settling time in rendering a tone level of 0, which requires the longest time to settle the input potentials of the voltage follower amplifiers among all the tone levels. The settling time can thus be reduced on the whole. As a result, it is possible to shorten the precharge period. The current output period can thus be increased accordingly, which allows sufficient correction on precharge-time errors in the potentials of the data lines 120. Consequently, the accuracy in writing the current signals Iout to the pixels 100 improves for higher image quality.

Figure 12:
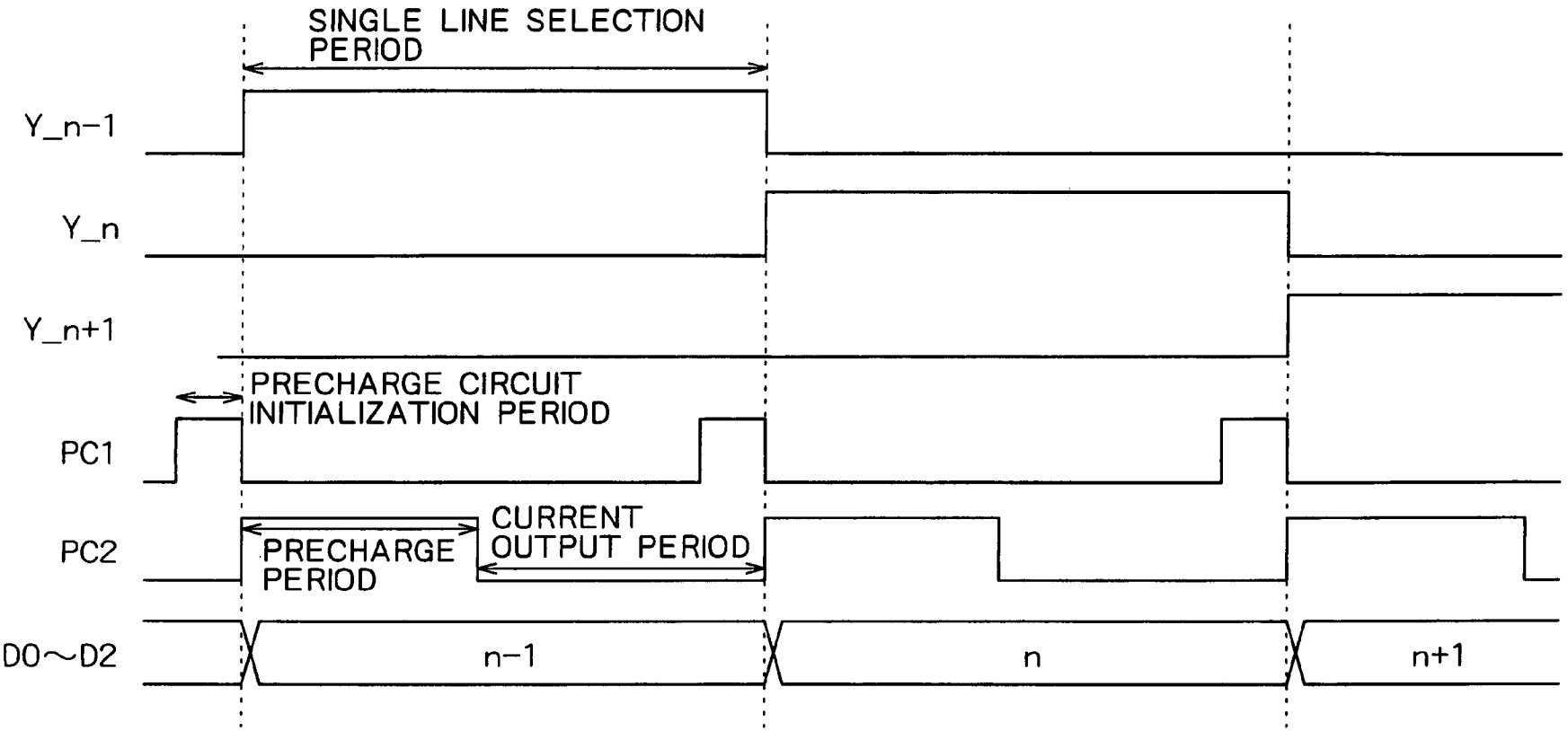
FIG. 12 is a timing chart for showing the operation of the organic EL display according to a modification of the first embodiment.

Now, description will be given of a modification of the first embodiment. FIG. 12 is a timing chart for showing the operation of the organic EL display according to this modification. As shown in FIG. 12, in this modification, the precharge circuit initialization period is arranged at the end of the current output period in the last single line selection period, not in the initial stage of the precharge period. In terms of configuration and operation other than described above, the organic EL display according to this modification is the same as that of the foregoing first embodiment.

In this modification, the precharge output potentials can be set to the reference potential Vb to initialize the precharge circuits while writing current signals on the last line. This allows a further reduction in the precharge period. The effects of this modification other than described above are the same as those of the foregoing first embodiment. Incidentally, the switching N-channel transistor T33 may be omitted to short-circuit the gate and drain of the driving P-channel transistor T35 directly. The logical OR (OR output) signal of the precharge signals PC1 and PC2 may be input to the gate of the transistor T33. In FIG. 12, this logical OR (OR output) signal of the precharge signals PC1 and PC2 turns to high level at the rise of the precharge signal PC1, and turns to low level at the fall of the precharge signal PC2.

Figure 13:
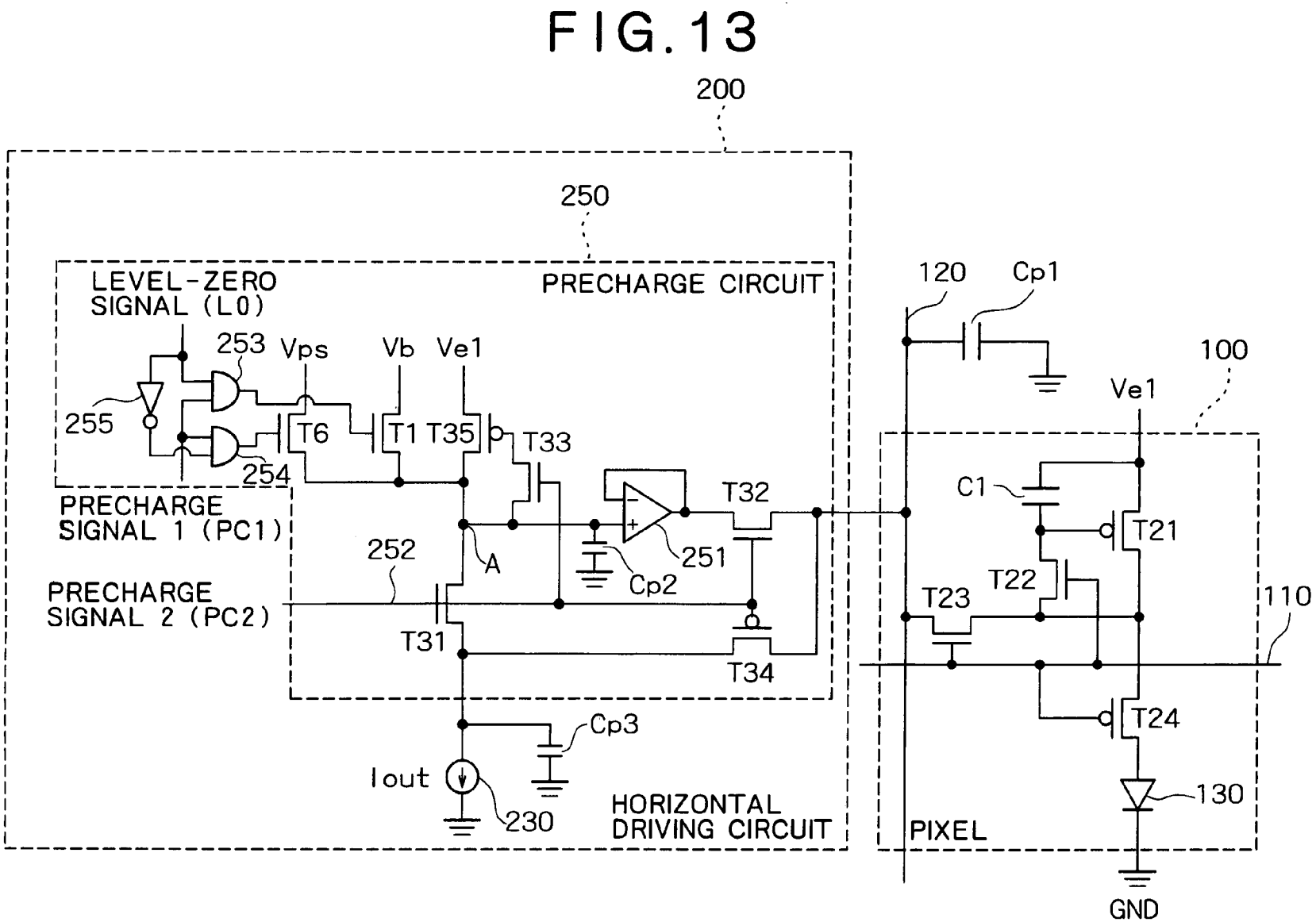
FIG. 13 is a circuit diagram showing a D/I conversion unit and a precharge circuit for each single data line, and a pixel circuit for each single pixel in the organic EL display according to a second embodiment of the present invention.
Figure 14:
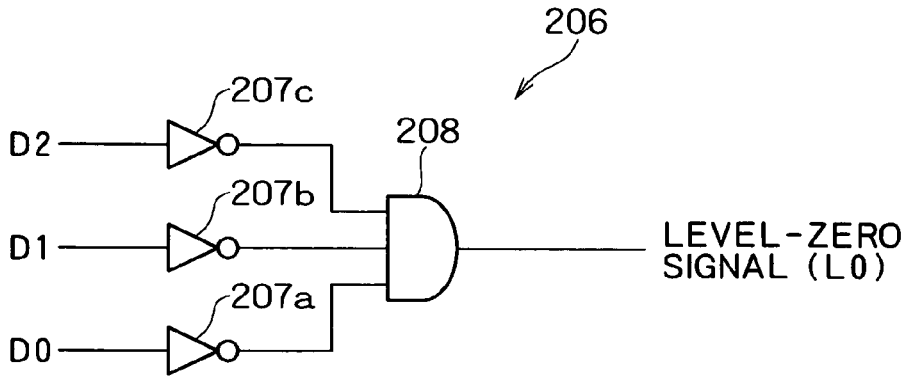
FIG. 14 is a circuit diagram showing a level-zero signal generating unit of the organic EL display according to the present embodiment.

Now, description will be given of a second embodiment of the present invention. FIG. 13 is a circuit diagram showing a D/I conversion unit and a precharge circuit for each single data line, and a pixel circuit for each single pixel in the organic EL display according to the present embodiment. FIG. 14 is a circuit diagram showing a level-zero signal generating unit of the organic EL display according to the present embodiment. As shown in FIG. 13, the organic EL display according to the present embodiment differs from the organic EL display according to the foregoing first embodiment (see FIG. 9) in that each precharge circuit 250 includes a switching N-channel transistor T6, AND circuits 253 and 254, and an inverter 255 additionally. Then, the precharge circuit 250 receives a level-zero signal L0 from exterior. The level-zero signal L0 is a binary signal which turns to high level when the tone level to be displayed on the pixel is zero, and turns to low level with any other tone level.

This level-zero signal L0 is input to the AND circuit 253 and the inverter 255. Aside from the level-zero signal L0, the AND circuit 253 receives the precharge signal PC1. The AND circuit 254 receives the output signal of the inverter 255 and the precharge signal PC1. The output signal of the AND circuit 253, i.e., the logical AND between the level-zero signal L0 and the precharge signal PC1 is input to the gate of the switching N-channel transistor T1. The output signal of the AND circuit 254, i.e., the logical AND between the inverted signal of the level-zero signal L0 and the precharge signal PC1 is input to the gate of the switching N-channel transistor T6. A reference potential Vps is applied to one terminal of this transistor T6. The other terminal is connected to the node A. The reference potential Vps is equal to a level-one potential, i.e., the gate potential of the transistor T21 when the darkest tone level next to the tone level of 0 is displayed on the pixel. The reference potential Vps is thus slightly lower than the reference potential Vb which is equal to the level-zero potential. The reference potential Vps is applied commonly to all the precharge circuits 250.

In such a configuration, when the precharge signal PC1 is at high level and the level-zero signal L0 is at high level, the transistor T1 turns on and the transistor T6 turns off. The potential of the node A is thus set to the potential Vb. When the precharge signal PC1 is at high level and the level-zero signal L0 is at low level, the transistor T1 turns off and the transistor T6 turns on. The potential of the node A is thus set to the potential Vps. When the precharge signal PC1 is at low level, both the transistors T1 and T6 turn off regardless of the value of the level-zero signal. At this time, the potential of the node A is determined by the current signal Iout.

The horizontal driving circuit 200 is also provided with a level-zero signal generating unit 206 as shown in FIG. 14. The level-zero signal generating unit 206 comprises inverters 207*a* to 207*c* to which the digital data signals D0 to D2 are input, respectively, and an AND circuit 208 to which the output signals of the inverters 207*a* to 207*c* are input. The output signal of this AND circuit 208 is the level-zero signal L0. Note that the digital data signals D0 to D2 are the voltage signals to be input to the data creation circuits 232 (see FIG. 6), indicating display data. In other respects than those described above, the organic EL display according to the present embodiment has the same configuration as that of the organic EL display according to the foregoing first embodiment.

Next, description will be given of the operation of the driving circuit according to the present embodiment which is configured as described above, i.e., the method of driving the organic EL display according to the present embodiment. The timing chart for the organic EL display of the present embodiment is the same as that shown in FIG. 11. That is, a single line selection period consists of a precharge period and a current output period. A precharge circuit initialization period is arranged in the initial stage of the precharge period. Hereinafter, description will be given with reference to FIGS. 11, 13, and 14.

At the precharge circuit initialization period in each single line selection period, the precharge signals PC1 and PC2 both are at high level as in the foregoing first embodiment. In rendering a level-zero display (black display) on a pixel selected in this single line selection period, the level-zero generating unit 206 shown in FIG. 14 receives a total of three bits of digital data signals D0 to D2 all of which are at low level. Consequently, all the output signals of the inverters 207*a* to 207*c* to be input to the AND circuit 208 turn to high level. The output signal of the AND circuit 208, i.e., the level-zero signal L0 turns to high level.

As shown in FIG. 13, when the precharge signal PC1 is at high level and the level-zero signal L0 is at high level, the transistor T1 turns on and the transistor T6 turns off. The potential of the node A is thus initialized to the potential Vb. This potential Vb is set equal to the level-zero potential. Then, after the precharge signal PC1 falls to low level to end the precharge circuit initialization period, the potential of the node A is determined by the current signal Iout. At this time, the potential of the node A is set to the level-zero potential through the transistor T1 in advance. Thus, the potential of the node A, i.e., the input potential of the voltage follower amplifier can be settled in an extremely short time since it is only necessary to correct a potential error occurring in the precharge circuit initialization period.

Moreover, when the digital data signals indicate a tone level other than the tone level of 0, i.e., any one of the tone levels of 1 to 6, at least one signal out of the digital data signals D0 to D2 shown in FIG. 14 is at high level. As a result, the output signal of the AND circuit 208, i.e., the level-zero signal L0 turns to low level. Then, in the precharge circuit 250 shown in FIG. 13, when the precharge signal PC1 is at high level and the level-zero signal L0 is at low level, the transistor T1 turns off and the transistor T6 turns on. The potential of the node A is thus initialized to the potential Vps. Then, after the precharge signal PC1 falls to low level to end the precharge circuit initialization period, the potential of the node A is determined by the current signal Iout. At this time, the potential of the node A is set to the potential Vps corresponding to a level-one display through the transistor T6 in advance. Thus, the current signal Iout has only to lower the potential of the node A from the potential Vps corresponding to the level-one display to the tone level potential corresponding to one of the tone levels of 1 to 7. This reduces the amount of change of the potential as compared to the case where the potential of the node A is lowered from the potential Vb corresponding to the tone level of 0 to the tone level potential corresponding to the one of the tone levels of 1 to 7. It is therefore possible to settle the input potential of the voltage follower amplifier in a shorter time. In other respects than those described above, the operation of the present embodiment is the same as that of the foregoing first embodiment.

As above, according to the present embodiment, when the tone level to be displayed on a pixel is the tone level of 0, the potential of the node A can be set to the potential Vb, which corresponds to a level-zero display, during the precharge circuit initialization period as in the foregoing first embodiment. It is therefore possible to settle the input potential of the voltage follower amplifier quickly. Moreover, when the tone level to be displayed on the pixel is other than the tone level of 0, or any one of the tone levels of 1 to 7, for example, the potential of the node A can be set to the potential Vps corresponding to a level-one display during the precharge circuit initialization period. As compared to the case of the potential Vb as in the foregoing first embodiment, it is possible to settle the input potential of the voltage follower amplifier more quickly.

Figure 15:
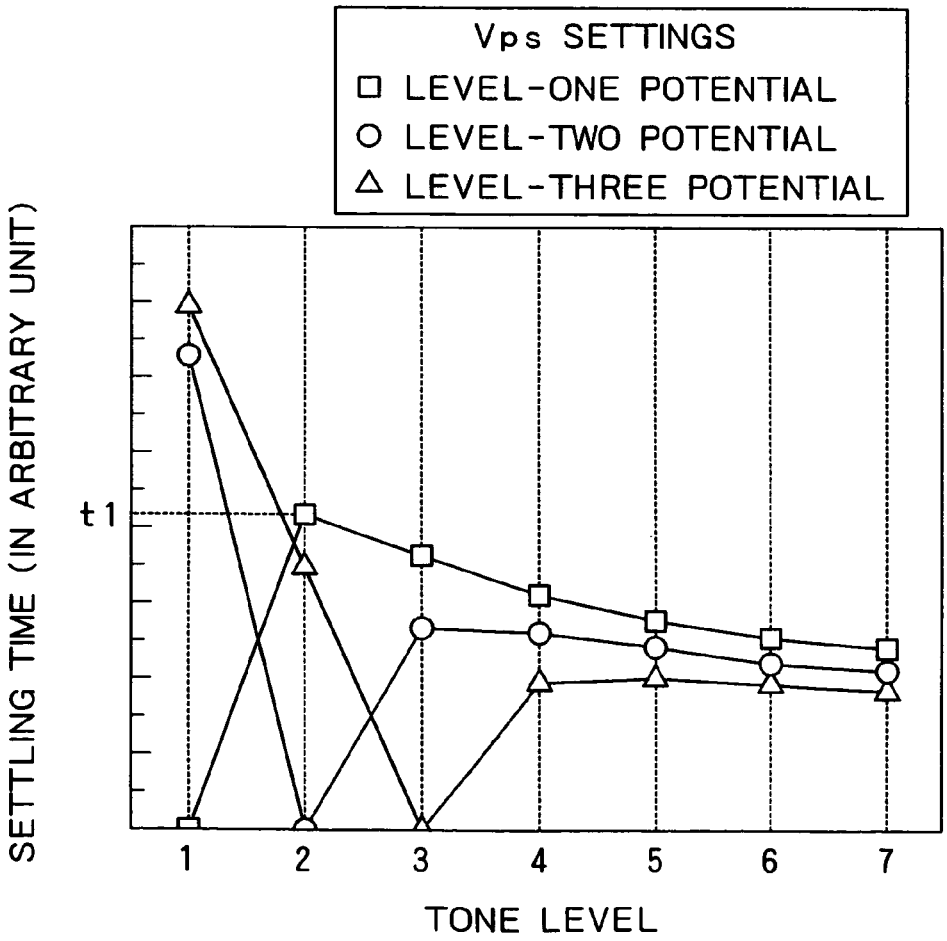
FIG. 15 is a chart for showing the settling times in changing the input potential of the voltage follower amplifier from the reference voltage Vps to respective tone level potentials, where the abscissa indicates the tone level and the ordinate the settling time of the input potential of the voltage follower amplifier.

Now, the foregoing effects of the present embodiment will be described concretely in conjunction with the results of simulation. FIG. 15 is a chart for showing the settling times in changing the input potential of the voltage follower amplifier from the reference voltage Vps to respective tone level potentials. In the chart, the abscissa indicates the tone level, and the ordinate indicates the settling time of the input potential of the voltage follower amplifier. In FIG. 15, the square points (□) represent the case where the reference potential Vps is a level-one potential. The circle points (○) represent the case where the reference potential Vps is a level-two potential. The triangle points (Δ) represent the case where the reference potential Vps is a level-three potential. In this simulation, the parasitic capacitances Cp2 and Cp3 are given a total value of 0.2 pF. The current signal Iout for each single tone level is set at 100 nA. More specifically, the current signal Iout corresponding to the tone level of 0 is 0 nA. The current signal Iout corresponding to the tone level of 1 is 100 nA. The current signal Iout is then increased by 100 nA for each increment of the tone level, so that the current signal Iout corresponding to the tone level of 7 is 700 nA.

As shown in FIG. 15, provided that the reference potential Vps is the level-one potential, the settling time for settling the input potential of the voltage follower amplifier to the level-one potential is zero. The settling time for settling to the level-two potential is time t1. For level-two and higher potentials, the settling time decreases as the tone level increases. The reason for this is that while higher tone levels require greater amounts of change in potential, the parasitic capacitances can be charged by the higher current signals Iout, so that the higher tone levels reduce the settling time eventually. More specifically, when the reference potential Vps is the level-one potential, the maximum settling time of t1 is required in settling the input potential of the voltage follower amplifier to the level-two potential. Now, if the reference potential Vps is the level-two potential, the settling time for settling the input potential of the voltage follower amplifier to the level-two potential is zero. For level-three and higher potentials, the settling time decreases with an increasing tone level, falling within t1 in any case. Nevertheless, the settling time for settling the input potential of the voltage follower amplifier to the level-zero potential is longer than the time t1. Furthermore, provided that the reference potential Vps is the level-three potential, the settling time for settling the input potential of the voltage follower amplifier to the level-three potential is zero. For level-four and higher potentials, the settling time decreases with an increasing tone level, falling within t1 in any case. Nevertheless, the settling time for settling the input potential of the voltage follower amplifier to the level-zero potential is longer than the time t1. Now, suppose the case where a level-zero display is rendered without initializing the potential of the node A to the potential Vb, though not shown in FIG. 15. At this time, the settling time for settling the input potential of the voltage follower amplifier from the reference potential Vps to the level-zero potential is longer than to the tone level potentials for any other tone levels.

Thus, from the results of simulation of FIG. 15, it can be seen that the settling time of the input potential of the voltage follower amplifier becomes the shortest when the reference potential Vps is set at the level-one potential. In other words, for the reference potential to be applied to the wiring through which the current signal Iout flows in the precharge circuit during the precharge circuit initialization period, it is the most effective to set the reference potential Vb to the level-zero potential and then set the reference potential Vps to the level-one potential.

While the present embodiment has dealt with the case of setting one single level of reference potential Vps, the present invention is not limited thereto. It is possible to set a plurality of reference potentials and provide switching transistors for the reference potentials, respectively, so that the reference potentials are applied to the node A by the operation of the respective transistors. In this case, the results of simulation of FIG. 15 show that it is effective to set the reference potentials in ascending order of the tone level potentials. For example, if two levels of reference potentials are set aside from the reference potential Vb, the reference potential Vb is set at the level-zero potential. The other reference potentials are set at the level-one potential and the level-two potential. Then, when a pixel renders a level-zero display, the reference potential Vb (level-zero potential) is applied to the node A during the precharge circuit initialization period. When the pixel renders a level-one display, the level-one potential is applied to the node A during the precharge circuit initialization period. When the pixel renders a tone level of two or higher, the level-two potential is applied to the node A during the precharge circuit initialization period.

Moreover, in the present embodiment, the precharge circuit initialization period may be arranged at the end of the last single line selection period as shown in the modification of the foregoing first embodiment. This can be achieved by changing the timing for latching the display data, and generating new digital data signals to be latched at the rise of the precharge signal PC1. Moreover, as in the modification of the foregoing first embodiment, the switching N-channel transistor T33 may be omitted here so that the gate and drain of the driving P-channel transistor T35 are short-circuited directly. The logical OR (OR output) signal of the precharge signals PC1 and PC2 may be input to the gate of the transistor T33. In FIG. 12, this logical OR (OR output) signal of the precharge signals PC1 and PC2 turns to high level at the rise of the precharge signal PC1, and turns to low level at the fall of the precharge signal PC2.

Figure 16:
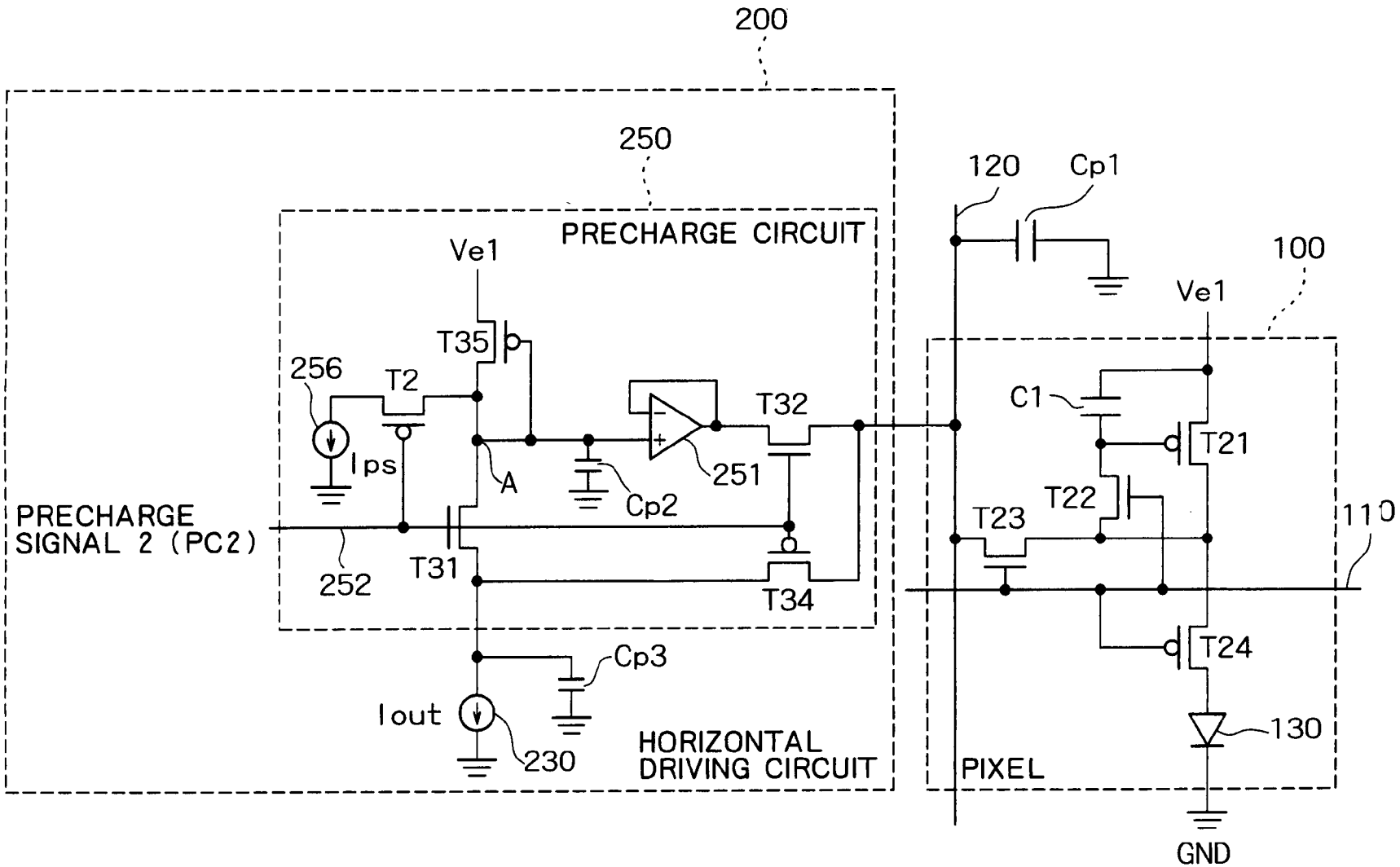
FIG. 16 is a circuit diagram showing a D/I conversion unit and a precharge circuit for each single data line, and a pixel circuit for each single pixel in the organic EL display according to a third embodiment of the present invention.

Now, description will be given of a third embodiment of the present invention. FIG. 16 is a circuit diagram showing a D/I conversion unit and a precharge circuit for each single data line, and a pixel circuit for each single pixel in the organic EL display according to the present embodiment. As shown in FIG. 16, the organic EL display according to the present embodiment differs from the organic EL display according to the foregoing first embodiment in that each precharge circuit 250 is not provided with the transistor T1, but a reference current source 256 instead. Another difference lies in the provision of a switching P-channel transistor T2 which is connected to the reference current source 256 at one terminal, to the node A at the other terminal, and to the wiring 252 at the gate. The reference current source 256 is one for supplying a current Ips having the same intensity as that of the current that flows through the current storing P-channel transistor T21 of a pixel 100 when the pixel 100 renders a level-one display (hereinafter, referred to as level-one current). The precharge circuit 250 receives the precharge signal PC2 alone, not the precharge signal PC1. In other respects than those described above, the organic EL display according to the present embodiment has the same configuration as that of the organic EL display according to the foregoing first embodiment.

Figure 17:
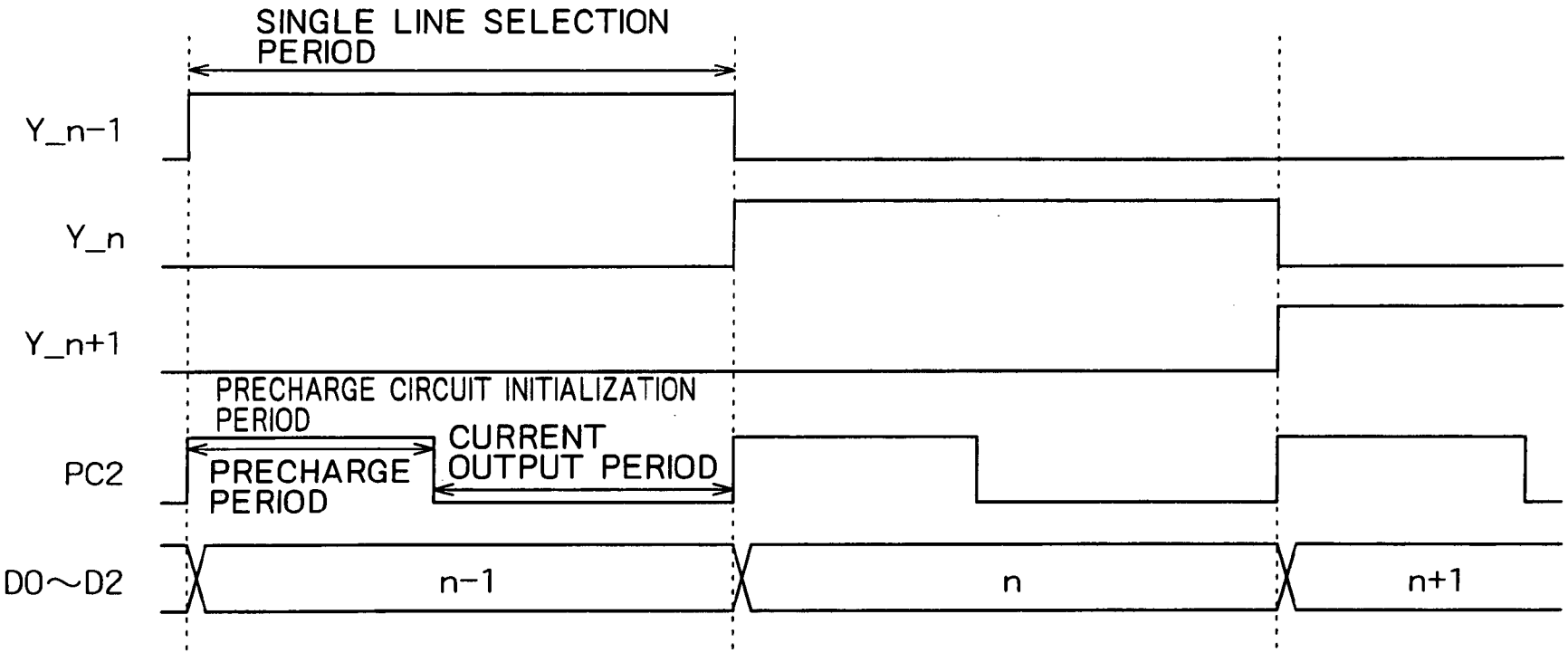
FIG. 17 is a timing chart for showing the operation of the organic EL display according to the present embodiment.

Next, description will be given of the operation of the driving circuit according to the present embodiment which is configured as described above, i.e., the method of driving the organic EL display according to the present embodiment. FIG. 17 is a timing chart for showing the operation of the organic EL display according to the present embodiment. As shown in FIG. 17, in the present embodiment, a single line selection period includes a precharge period and a current output period. The current output period also serves as a precharge circuit initialization period. Hereinafter, description will be given with reference to FIGS. 16 and 17.

Figure 2:
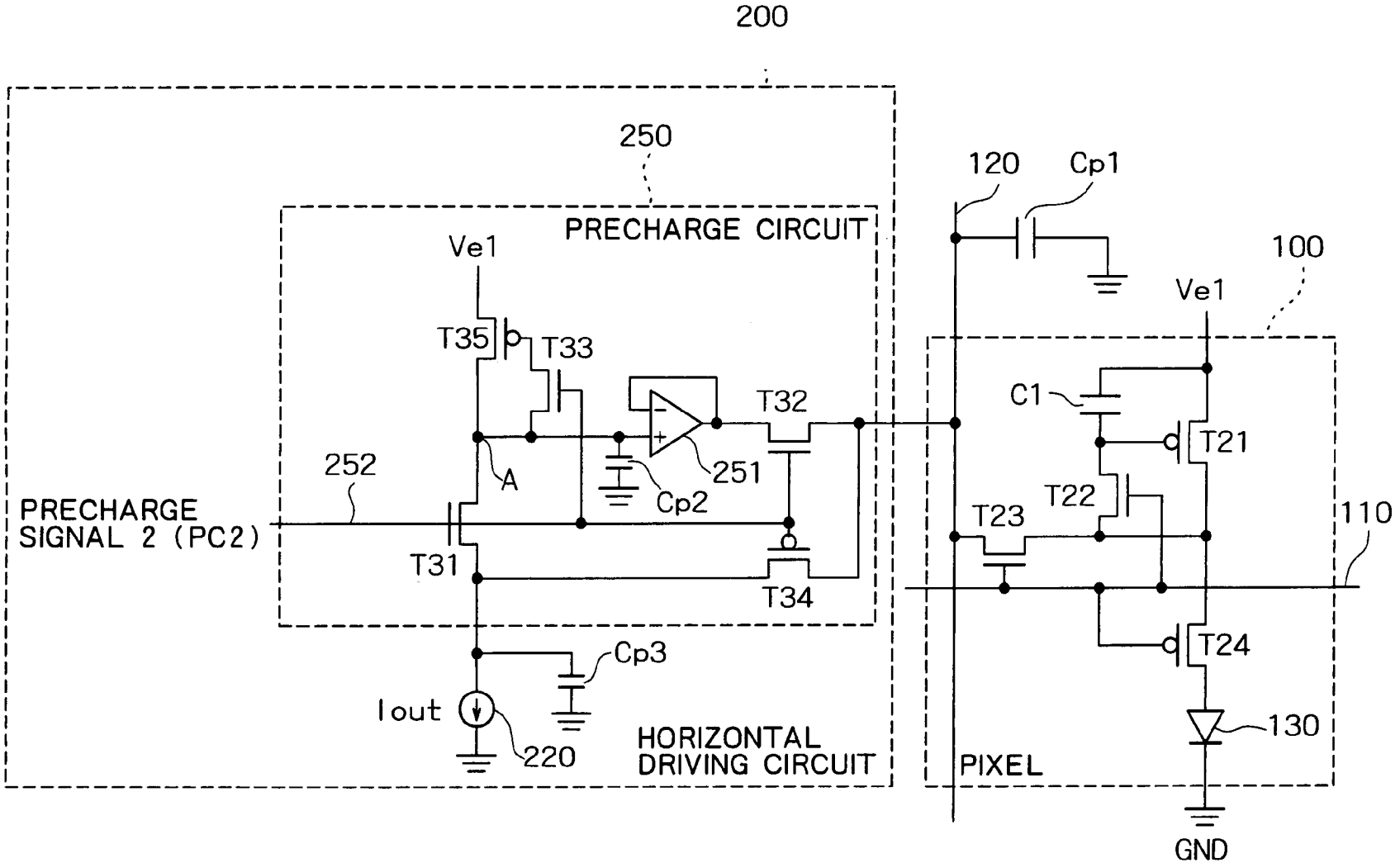
FIG. 2 (PRIOR ART)
FIG. 2 is a circuit diagram showing a current source and a precharge circuit for each single data line, and a pixel circuit for each single pixel in the organic EL display shown in FIG. 1.
Figure 3:
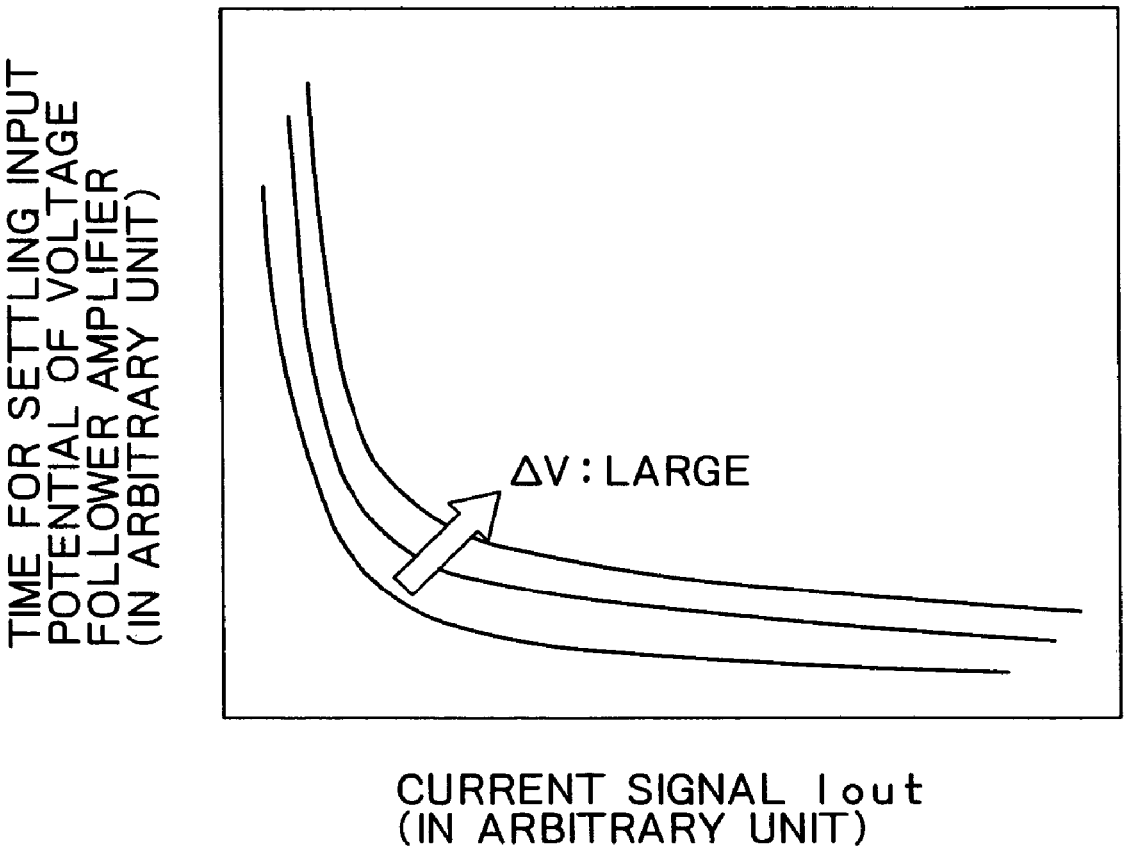
FIG. 3 (PRIOR ART)
FIG. 3 is a chart for showing the effect of a current signal Iout on the settling time of the input potential of a voltage follower amplifier, in which the abscissa indicates the intensity of the current signal Iout and the ordinate the settling time of the input potential of the voltage follower amplifier.

Initially, in the precharge period of the single line selection period, the precharge signal PC2 turns to high level. This turns off the switching P-channel transistors T2 and T34, and turns on the switching N-channel transistors T31 and T32. The current signal Iout flows from the supply voltage Ve1 to the ground potential GND through the path which consists of the driving P-channel transistor T35, the switching N-channel transistor T31, and the one-output D/I conversion unit 230. As a result, by the same operation as in the conventional organic EL display described previously (see FIG. 2), the value of the current flowing through the driving P-channel transistor T35 is determined by the current signal Iout. The potential of the node A thus coincides with the gate potential of the driving P-channel transistor T35 when the current signal Iout is passed through. This potential is applied to the data line 120 through the voltage follower amplifier 251. At this time, the parasitic capacitance Cp1 accompanying the data line 120 is charged and discharged to precharge the data line 120.

Next, the precharge signal PC2 is changed from high level to low level to end the precharge period and start the current output period. This turns off the switching N-channel transistors T31 and T32, and turns on the switching P-channel transistor T34. The current signal Iout is supplied from the one-output D/I conversion unit 230 to the data line 120. At this time, in the pixel circuit selected by the control line 110, the switching N-channel transistors T22 and T23 turn on. The precharge output potential is thus applied to the source and gate of the current storing P-channel transistor T21 and the capacitor C1. The pixel 100 is thus written with the current signal Iout.

In the current output period, the precharge signal PC2 of low level turns on the switching P-channel transistor T2. Then, the current Ips corresponding to a level-one display flows through the path consisting of the supply voltage Ve1, the driving P-channel transistor T35, the switching P-channel transistor T2, and the reference current source 256. As a result, the value of the current flowing between the source and drain of the driving P-channel transistor T35 is determined by the current Ips, whereby the potential of the node A is initialized to a potential determined by the current Ips. In other respects than those described above, the operation of the present embodiment is the same as that of the foregoing first embodiment.

In the present embodiment, the potential of the node A is initialized to the level-one potential in the current output period. Consequently, when the next single line selection period is started, it is possible to set the precharge output potential to the potential of a predetermined tone level quickly.

In the foregoing second embodiment, the potential of the node A is initialized to the level-one potential by means of the reference potential Vps. In this method, however, the initialization potential may be affected by characteristic variations of the driving transistor T35. More specifically, even if the reference potential Vps is set equal to the level-one potential determined by the design value of the driving transistor T35, the level-one potential of the driving transistor T35 may deviate from the design value in actual products. In such cases, the level-one potential of the actual driving transistor T35 can deviate from the reference potential Vps. Then, in the precharge circuit initialization period, the potential of the node A is initialized to the reference potential Vps. When the precharge output potential is the level-one potential, this deviation must therefore be corrected, requiring time for settlement. Incidentally, the characteristic variations tend to increase significantly when the transistors are formed as polysilicon TFTs (Thin Film Transistors) on the surface of a glass substrate or the like. The variations of the transistors include lot-by-lot variations, and product-by-product variations in each identical lot.

In contrast, according to the present embodiment, the level-one potential of the driving transistor T35 is set by using the current Ips which is set equal to the level-one current. Consequently, even if the driving transistor T35 has characteristic variations, the potential of the node A can be set to the actual level-one potential of this driving transistor T35 itself. This precludes the foregoing problem. As a result, the precharge output potential can be set to the level-one potential without requiring the time for correcting a potential error. The settling time can thus be reduced with reliability. This effect of the present embodiment becomes particularly high when the parasitic capacitance Cp2, or the total sum of the gate capacitor of the driving P-channel transistor T35 and the input capacitor of the voltage follower amplifier 251, exceeds the parasitic capacitance Cp3, or the capacitor occurring between the laid wiring and other wiring.

While the present embodiment has dealt with the case where the reference current Ips has the same intensity as that of the level-one current, the present invention is not limited thereto. Level-two and higher currents are also applicable.

Figure 18:
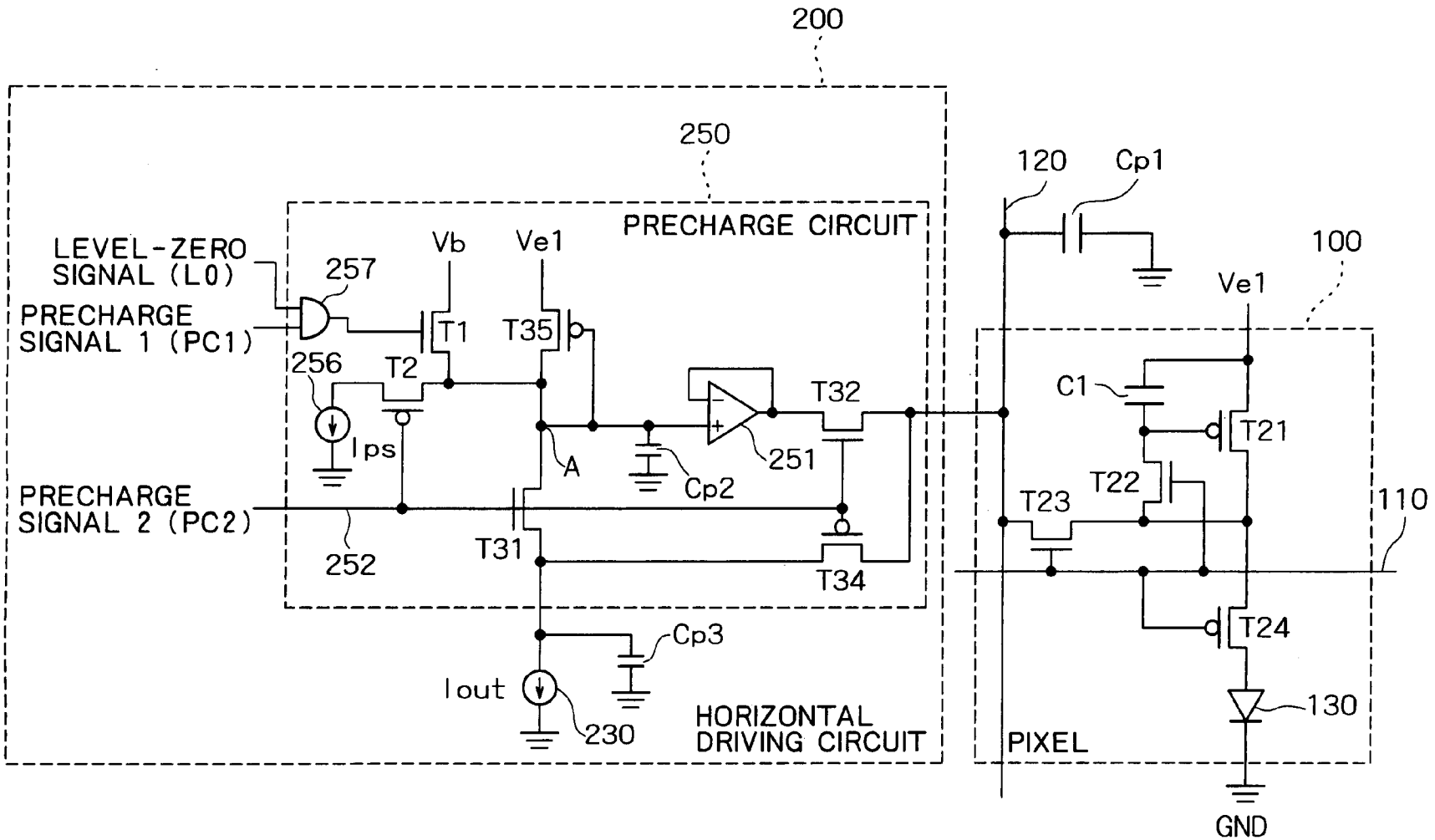
FIG. 18 is a circuit diagram showing a D/I conversion unit and a precharge circuit for each single data line, and a pixel circuit for each single pixel in the organic EL display according to a fourth embodiment of the present invention.

Now, description will be given of a fourth embodiment of the present invention. FIG. 18 is a circuit diagram showing a D/I conversion unit and a precharge circuit for each single data line, and a pixel circuit for each single pixel in the organic EL display according to the present embodiment. As shown in FIG. 18, the present embodiment is a combination of the foregoing first and third embodiments. The organic EL display according to the present embodiment differs from the organic EL display according to the foregoing first embodiment in the provision of the switching P-channel transistor T2, the reference current source 256, and an AND circuit 257. The positions of connection of the switching P-channel transistor T2 and the reference current source 256 are the same as in the foregoing third embodiment. The AND circuit 257 receives the level-zero signal L0 and the precharge signal PC1. The logical AND of the two signals is output to the gate of the switching N-channel transistor T1. Incidentally, the level-zero signal L0 is generated by the level-zero signal generating unit 206 which has been described in the foregoing second embodiment (see FIG. 14). In other respects than those described above, the present embodiment has the same configuration as that of the foregoing first embodiment.

Next, description will be given of the operation of the driving circuit according to the present embodiment which is configured as described above, i.e., the method of driving the organic EL display according to the present embodiment. The timing chart for showing the operation of the organic EL device according to the present embodiment is the same as FIG. 11. That is, a single line selection period includes a precharge period and a current output period. A precharge circuit initialization period is arranged at the beginning of the precharge period. Incidentally, as shown in FIG. 12, the precharge circuit initialization period may be provided at the end of the last single line selection period.

In the present embodiment, if the level-zero signal L0 is at high level during the precharge circuit initialization period, the output signal of the AND circuit 257 turns to high level and the switching N-channel transistor T1 turns on. As a result, the potential of the node A is initialized to the level-zero potential, or the reference potential Vb. If the level-zero signal L0 is at low level, the output signal of the AND circuit 257 turns to low level and the switching N-channel transistor T1 turns off. As a result, the potential of the node A is initialized to a level-one potential, i.e., a potential determined by the reference current Ips, the level-one current. In other respects than those described above, the operation of the present embodiment is the same as that of the foregoing first embodiment.

According to the present embodiment, the potential of the node A is initialized to the level-zero potential or the level-one potential in the current output period. Consequently, when the next single line selection period is started, it is possible to set the precharge output potential to a predetermined tone level potential quickly. In addition, since the precharge circuit is initialized to the level-one potential by means of the reference current Ips, it is possible to prevent the occurrence of a potential error during initialization.

Figure 19:
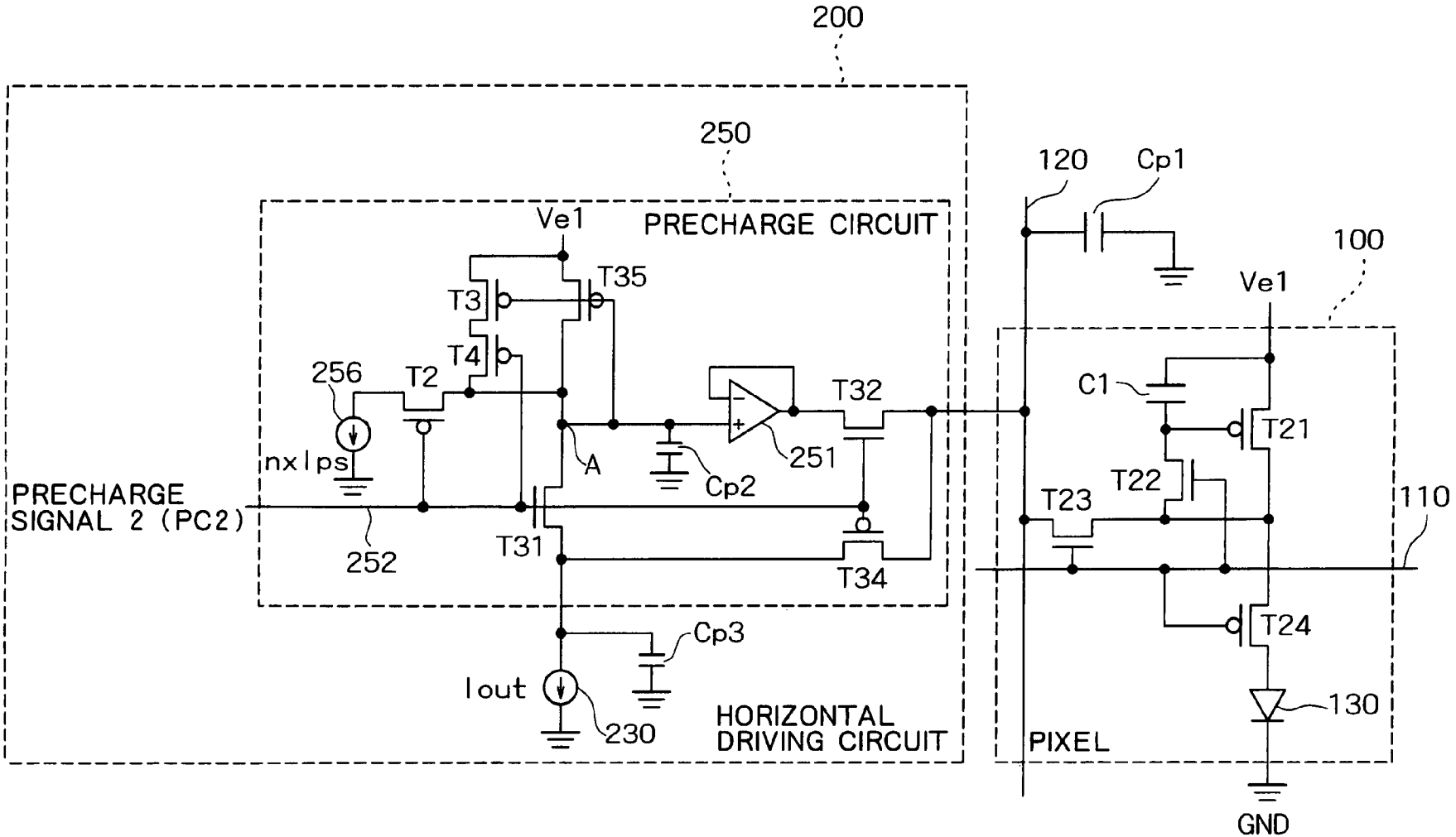
FIG. 19 is a circuit diagram showing a D/I conversion unit and a precharge circuit for each single data line, and a pixel circuit for each single pixel in the organic EL display according to a fifth embodiment of the present invention.

Now, description will be given of a fifth embodiment of the present invention. FIG. 19 is a circuit diagram showing a D/I conversion unit and a precharge circuit for each single data line, and a pixel circuit for each single pixel in the organic EL display according to the present embodiment. As shown in FIG. 19, the organic EL display according to the present embodiment differs from the organic EL display according to the foregoing third embodiment in the provision of a driving P-channel transistor T3 and a switching P-channel transistor T4. The supply voltage Ve1 is applied to the drain of the driving P-channel transistor T3. The driving P-channel transistor T3 is connected to one terminal of the switching P-channel transistor T4 at the source, and to the node A at the gate. The switching P-channel transistor T4 is connected to the reference current source 256 at the other terminal, and to the wiring 252 at the gate. The driving P-channel transistor T3 has the same channel length as that of the driving P-channel transistor T35. The channel width of the driving P-channel transistor T3 is (n−1) times that of the driving P-channel transistor T35. In this case, n is a real number no smaller than 1. For example, n is an integer greater than or equal to 2. Consequently, when the same potential is applied to their gates, the driving P-channel transistor T3 can pass a current (n−1) times as high as the driving P-channel transistor T35 does. In other words, the driving P-channel transistor T3 has a driving capability (n−1) times that of the driving P-channel transistor T35. Moreover, the reference current source 256 is set at a current value n times that of the level-one current. In other respects than those described above, the present embodiment has the same configuration as that of the foregoing third embodiment.

Next, description will be given of the operation of the driving circuit according to the present embodiment which is configured as described above, i.e., the method of driving the organic EL display according to the present embodiment. The timing chart for showing the operation of the organic EL device according to the present embodiment is the same as FIG. 17. More specifically, a single line selection period includes a precharge period and a current output period. The current output period also serves as a precharge circuit initialization period.

In the current output period, i.e., the precharge circuit initialization period, the precharge signal PC2 is at low level. This turns off the switching N-channel transistors T31 and T32, and turns on the driving P-channel transistor T3 and the switching P-channel transistors T2, T4, and T34. As a result, a current having an intensity of (n×Ips) flows through the path leading from the supply voltage Ve1 to the ground potential, i.e., the path which consists of the P-channel transistors T35, T3, and T4, the switching P-channel transistor T2, and the reference current source 256. At this time, currents flow through the driving P-channel transistor T35 and the driving P-channel transistor T3 in parallel. The current flowing through the driving P-channel transistor T35 has an intensity of Ips. The current flowing through the driving P-channel transistor T3 has an intensity of {(n−1)×Ips}. As a result, the value of the current flowing through the driving P-channel transistor T35 is determined by the current Ips, whereby the potential of the node A is initialized to a potential determined by the current Ips.

Then, in the precharge period, the precharge signal PC2 is at high level. This turns off the switching P-channel transistors T2 and T4, so that a current flows through the driving P-channel transistor T35 alone, not the driving P-channel transistor T3. In other respects than those described above, the operation of the present embodiment is the same as that of the foregoing third embodiment.

According to the present embodiment, the node A is initialized by the current having an intensity of (n×Ips). As compared to the foregoing third embodiment, the initialization can thus be performed more quickly. The effects of the present embodiment other than described above are the same as those of the foregoing third embodiment.

Incidentally, in the present embodiment, n driving P-channel transistors T35 may be provided in parallel instead of the driving P-channel transistor T3 which has a driving capability (n−1) times that of the driving P-channel transistor T35. Moreover, as in the foregoing fourth embodiment, a switching N-channel transistor T1 may be provided so that the reference voltage Vb is applied to the node A through the operation of this transistor T1. In this case, the precharge circuit 250 can be initialized by the reference potential Vb, or the level-zero potential, when rendering a level-zero display. The level-zero display can thus be effected with higher reliability.

Figure 20:
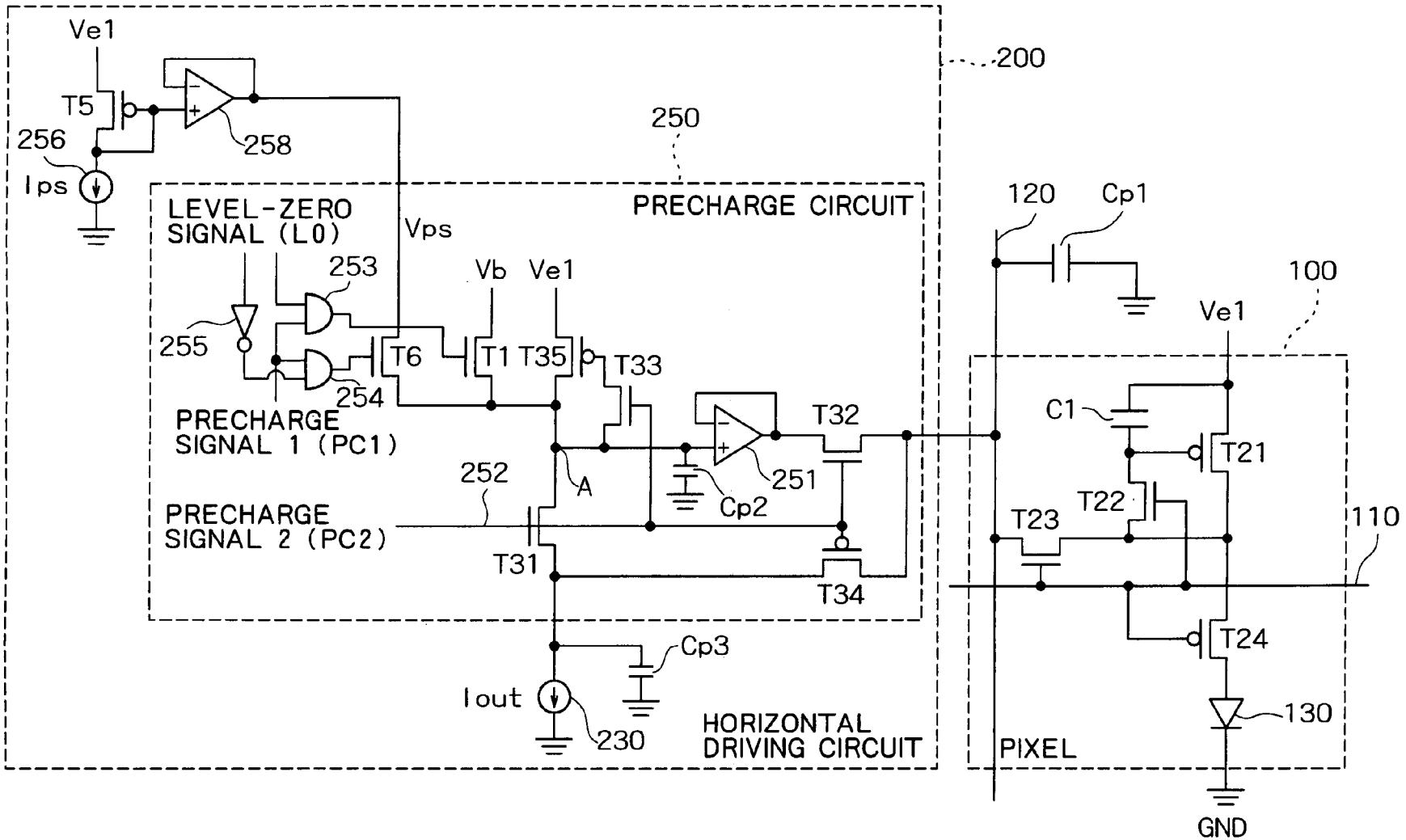
FIG. 20 is a circuit diagram showing a D/I conversion unit and a precharge circuit for each single data line, and a pixel circuit for each single pixel in the organic EL display according to a sixth embodiment of the present invention.

Now, description will be given of a sixth embodiment of the present invention. FIG. 20 is a circuit diagram showing a D/I conversion unit and a precharge circuit for each single data line, and a pixel circuit for each single pixel in the organic EL display according to the present embodiment. As shown in FIG. 20, the organic EL display according to the present embodiment differs from the organic EL display according to the foregoing second embodiment (see FIG. 13) in that the reference potential Vps is generated by an initialization potential generating P-channel transistor T5, the reference current source 256, and a voltage follower amplifier 258. More specifically, in the horizontal driving circuit 200, the initialization potential generating P-channel transistor T5 and the reference current source 256 are connected in series between the supply voltage Ve1 and the ground potential GND. The supply voltage Ve1 is applied to the drain of the transistor T5. The source and gate of the transistor T5 are connected to the reference current source 256. The ground potential GND is applied to the reference current source 256. The gate of the transistor T5 is connected to the noninverting input terminal of the voltage follower amplifier 258. The output terminal of the voltage follower amplifier 258 is connected to the inverting input terminal of the voltage follower amplifier 258 and one terminal of the transistor T6 in the precharge circuit 250. The reference current source 256 is one for outputting the same reference current Ips as the level-one current of the current storing P-channel transistors T21 and T35. The initialization potential generating P-channel transistor T5 is formed by the same process step as the driving P-channel transistor T35 is. The initialization potential generating P-channel transistor T5 is given the same size and characteristics as those of the driving P-channel transistor T35. Incidentally, the transistor T5, the reference current source 256, and the voltage follower amplifier 258 constitute a potential generating circuit. In other respects than those described above, the present embodiment has the same configuration as that of the foregoing second embodiment.

Next, description will be given of the operation of the driving circuit according to the present embodiment which is configured as described above, i.e., the method of driving the organic EL display according to the present embodiment. The timing chart for showing the operation of the organic EL device according to the present embodiment is the same as FIG. 11. That is, a single line selection period includes a precharge period and a current output period. A precharge circuit initialization period is arranged in the initial stage of the precharge period.

In the present embodiment, the reference current Ips output from the reference current source 256 flows through the initialization potential generating P-channel transistor T5, whereby the source and drain of the transistor T5 are set to the potential determined by the reference current Ips. Since the reference current Ips is set at the level-one current, the potential of the drain and gate of the transistor T5 becomes approximately the same as the level-one potential. Then, this potential is input to the noninverting input terminal of the voltage follower amplifier 258, so that the same potential is output from the output terminal of the voltage follower amplifier 258 and input to the one end of the switching N-channel transistor T6.

At this time, when the pixel 100 renders any tone level other than zero, the switching N-channel transistor T6 is turned on. The output of the voltage follower amplifier 258 is thus applied to the node A through the transistor T6. Since the size and characteristics of the driving P-channel transistor T35 are set equal to those of the initialization potential generating P-channel transistor T5, the output of the voltage follower amplifier 258 becomes the same as the level-one potential of the driving P-channel transistor T35. In other respects than those described above, the operation of the present embodiment is the same as that of the foregoing second embodiment.

In the present embodiment, the initialization potential generating P-channel transistor T5 and the driving P-channel transistor T35 are formed by the same process step. Thus, it is highly possible for the two transistors to develop the same tendency in variation. Consequently, even if the initialization potential generating P-channel transistor T5 and the driving P-channel transistor T35 suffer manufacturing variations, it is highly possible that the two transistors exhibit variations of the same tendency and end up with near equal characteristics. The potential at the source and gate of the initialization potential generating P-channel transistor T5, determined by the reference current Ips, thus becomes approximately equal to the potential at the source and gate of the driving P-channel transistor T35 when the current signal Iout indicates a level-one display. This reduces potential deviations ascribable to initialization. Consequently, it is possible to cancel lot-by-lot deviations of the driving P-channel transistor T35. The effects of the present embodiment other than described above are the same as those of the foregoing second embodiment.

Moreover, in the present embodiment, the precharge circuit initialization period may be arranged at the end of the last single line selection period as in the modification of the foregoing first embodiment (see FIG. 12). This can be achieved by changing the timing for latching the display data, and generating new digital data signals to be latched at the rise of the precharge signal PC1. In this case, as in the modification of the foregoing first embodiment, the switching N-channel transistor T33 may be omitted so that the gate and drain of the driving P-channel transistor T35 are short-circuited directly. The logical OR (OR output) signal of the precharge signals PC1 and PC2 may be input to the gate of the transistor T33. In FIG. 12, this logical OR (OR output) signal of the precharge signals PC1 and PC2 turns to high level at the rise of the precharge signal PC1, and turns to low level at the fall of the precharge signal PC2. Moreover, the initialization potential generating P-channel transistor T5, the reference current source 256, and the voltage follower amplifier 258 may be arranged either outside or inside the precharge circuit 250.

Figure 21:
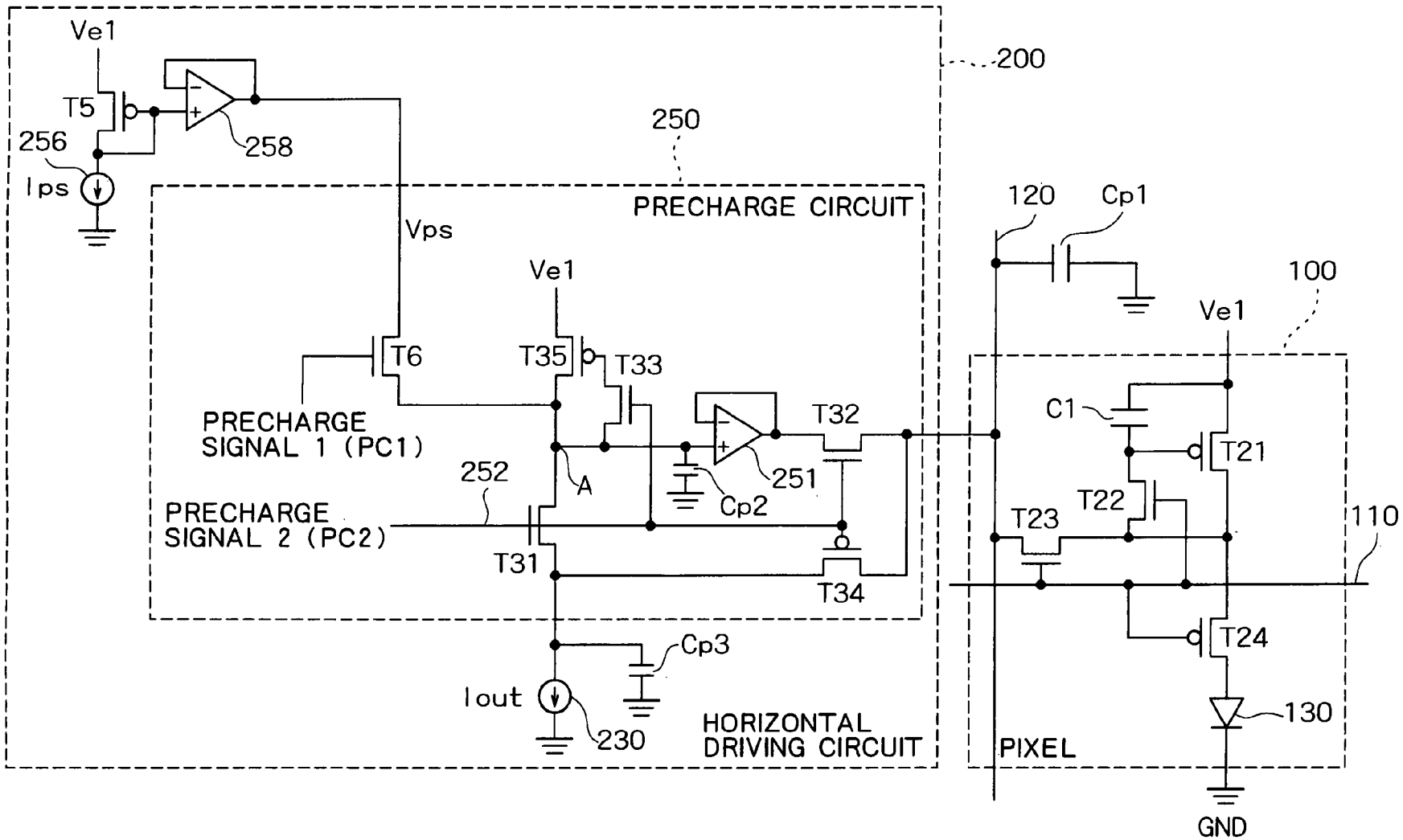
FIG. 21 is a circuit diagram showing a D/I conversion unit and a precharge circuit for each single data line, and a pixel circuit for each single pixel in the organic EL display according to a seventh embodiment of the present invention.

Now, description will be given of a seventh embodiment of the present invention. FIG. 21 is a circuit diagram showing a D/I conversion unit and a precharge circuit for each single data line, and a pixel circuit for each single pixel in the organic EL display according to the present embodiment. As shown in FIG. 21, the organic EL display according to the present embodiment differs from the organic EL display according to the foregoing sixth embodiment (see FIG. 20) in that the switching N-channel transistor T1, the AND circuits 253 and 254, and the inverter 255 are omitted, and the precharge signal PC1 is input to the gate of the switching N-channel transistor T6. In other respects than those described above, the configuration and operation of the present embodiment are the same as those of the foregoing sixth embodiment.

In the present embodiment, during the precharge circuit initialization period, the potential of the node A is initialized to the level-one potential even when rendering a level-zero display. On this account, as compared to the foregoing sixth embodiment, the time for settling the input potential of the voltage follower amplifier increases when a level-zero display is rendered. It is possible, however, to simplify the circuit configuration with a reduction in layout area as compared to the foregoing sixth embodiment. Note that even in the present embodiment, initializing the potential of the node A to the level-one potential in the precharge circuit initialization period can reduce the setting time of the input potential of the voltage follower amplifier as compared to the conventional organic EL display. It is therefore possible to improve the write accuracy. The effects of the present embodiment other than described above are the same as those of the foregoing sixth embodiment.

Figure 22:
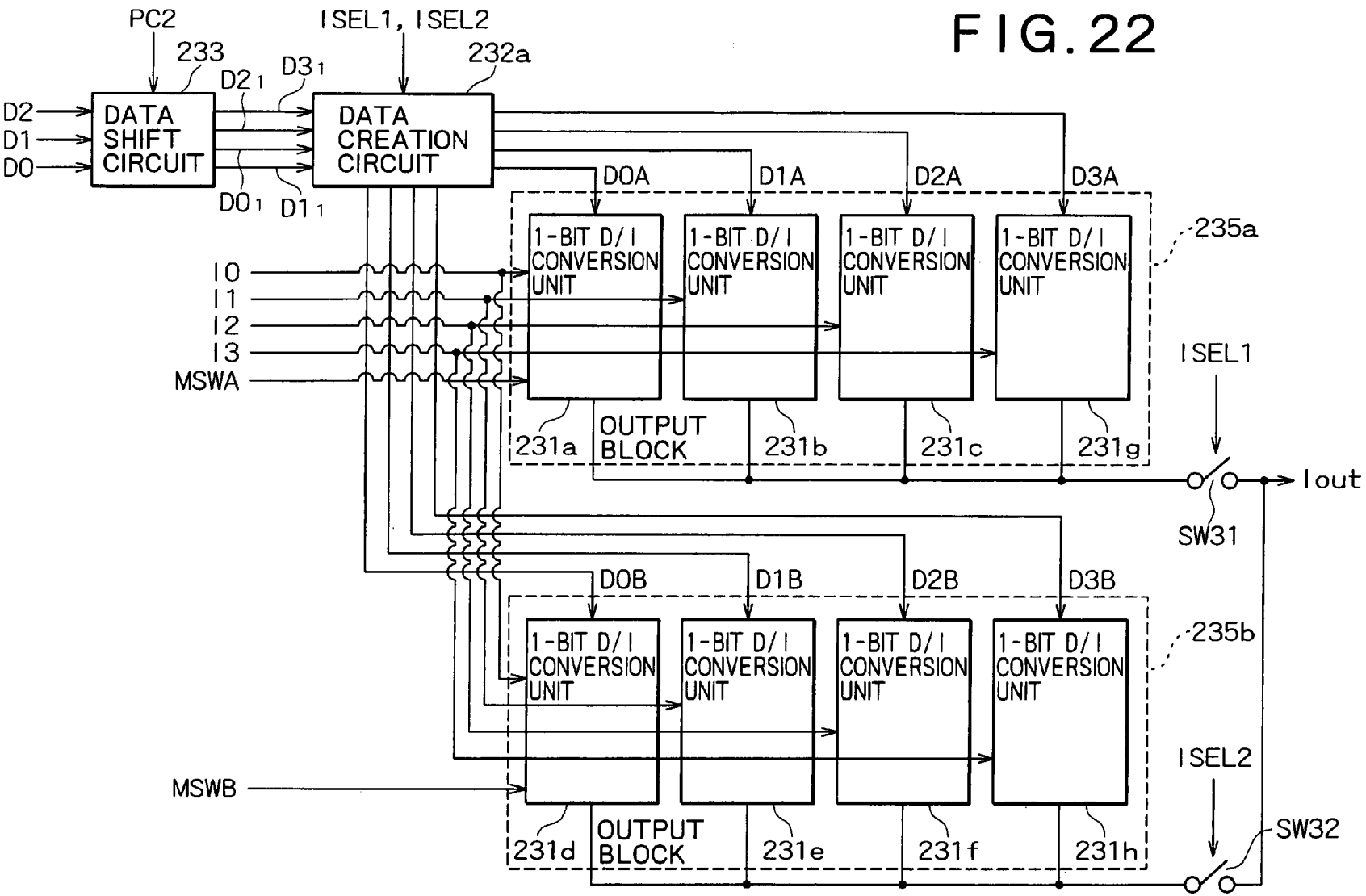
FIG. 22 is a block diagram showing a one-output D/I conversion unit of the organic EL display according to an eighth embodiment of the present invention.
Figure 23:
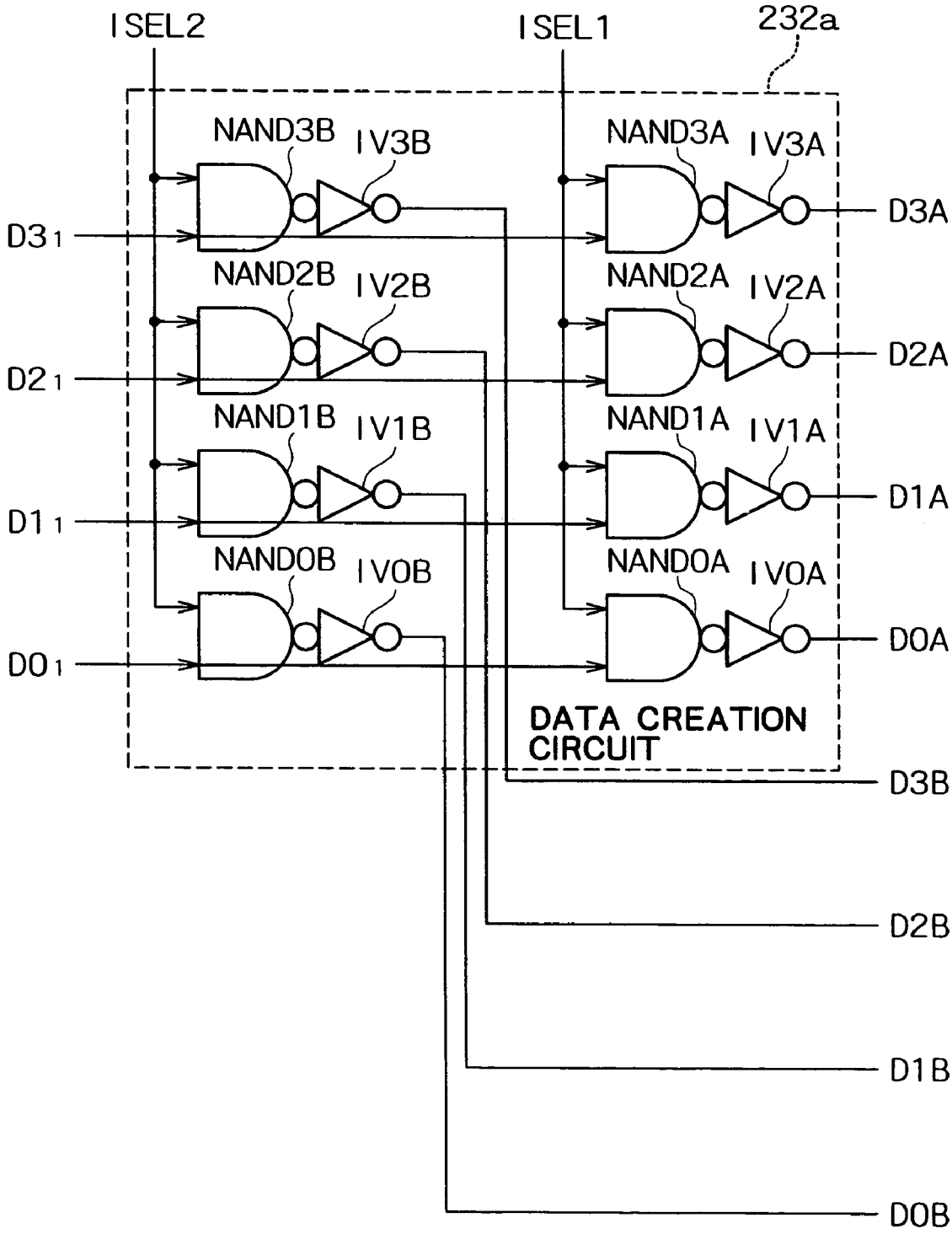
FIG. 23 is a circuit diagram showing the data creation circuit of the one-output D/I conversion unit shown in FIG. 22.
Figure 24:
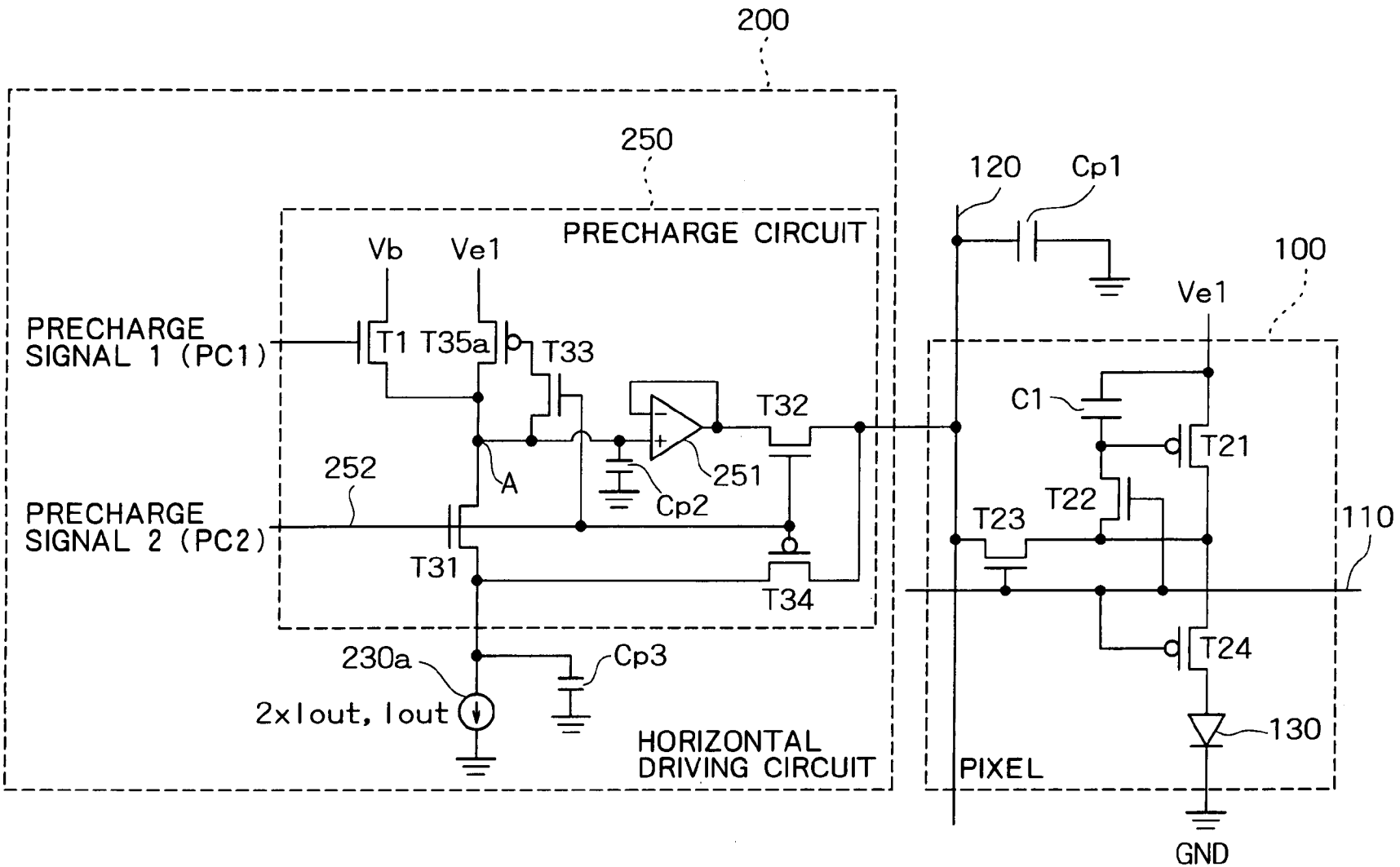
FIG. 24 is a circuit diagram showing a D/I conversion unit and a precharge circuit for each single data line, and a pixel circuit for each single pixel in the organic EL display according to the present embodiment.

Now, description will be given of an eight embodiment of the present invention. FIG. 22 is a block diagram showing a one-output D/I conversion unit of the organic EL display according to the present embodiment. FIG. 23 is a circuit diagram showing the data creation circuit of the one-output D/I conversion unit shown in FIG. 22. FIG. 24 is a circuit diagram showing a D/I conversion unit and a precharge circuit for each single data line, and a pixel circuit for each single pixel. As shown in FIG. 22, the one-output D/I conversion unit 230*a* according to the present embodiment has a data shift circuit 233 to which the precharge signal PC2 is input. Based on this precharge signal PC2, the data shift circuit 233 converts three bits of digital data signals D0 to D2 into four bits of digital data signals $D0_1$ to $D3_1$. Table 1 shows the input and output data of the data shift circuit 233.

TABLE 1

| TONE | INPUT SIGNAL | | | OUTPUT SIGNAL | | | | | | | |
|---|---|---|---|---|---|---|---|---|---|---|---|
| | | | | PRECHARGE PERIOD | | | | CURRENT OUTPUT PERIOD | | | |
| LEVEL | D2 | D1 | D0 | $D3_1$ | $D2_1$ | $D1_1$ | $D0_1$ | $D3_1$ | $D2_1$ | $D1_1$ | $D0_1$ |
| LEVEL 7 | 1 | 1 | 1 | 1 | 1 | 1 | 0 | 0 | 1 | 1 | 1 |
| LEVEL 6 | 1 | 1 | 0 | 1 | 1 | 0 | 0 | 0 | 1 | 1 | 0 |

TABLE 1-continued

| TONE | INPUT SIGNAL | | | OUTPUT SIGNAL | | | | | | | |
|---|---|---|---|---|---|---|---|---|---|---|---|
| | | | | PRECHARGE PERIOD | | | | CURRENT OUTPUT PERIOD | | | |
| LEVEL | D2 | D1 | D0 | $D3_1$ | $D2_1$ | $D1_1$ | $D0_1$ | $D3_1$ | $D2_1$ | $D1_1$ | $D0_1$ |
| LEVEL 5 | 1 | 0 | 1 | 1 | 0 | 1 | 0 | 0 | 1 | 0 | 1 |
| LEVEL 4 | 1 | 0 | 0 | 1 | 0 | 0 | 0 | 0 | 1 | 0 | 0 |
| LEVEL 3 | 0 | 1 | 1 | 0 | 1 | 1 | 0 | 0 | 0 | 1 | 1 |
| LEVEL 2 | 0 | 1 | 0 | 0 | 1 | 0 | 0 | 0 | 0 | 1 | 0 |
| LEVEL 1 | 0 | 0 | 1 | 0 | 0 | 1 | 0 | 0 | 0 | 0 | 1 |
| LEVEL 0 | 0 | 0 | 0 | 0 | 0 | 0 | 0 | 0 | 0 | 0 | 0 |

As shown in Table 1, when the precharge signal PC2 is at high level, the data shift circuit 233 shifts the digital data signals D0 to D2 to higher order by one digit to generate the digital data signals $D1_1$ to $D3_1$. The data shift circuit 233 also sets the digital data signal $D0_1$ to 0, and outputs the four bits of digital data signals $D0_1$ to $D3_1$. The data expressed by the four bits of signals $D0_1$ to D3, has a value twice that of the data expressed by the digital data signals D0 to D2. On the other hand, when the precharge signal PC2 is at low level, the data shift circuit 233 outputs the digital data signals D0 to D2 simply as the digital data signals $D0_1$ to $D2_1$, and outputs the digital data signal $D3_1$ of 0.

The data creation circuit 232*a* receives the foregoing four bits of digital signals $D0_1$ to $D3_1$, and outputs them as digital data signals D0A to D3A and digital data signals D0B to D3B, both of which are of four bits.

Aside from the reference currents I0 to I2, a reference current I3 having the intensity twice that of the reference current I2 is input to the one-output D/I conversion unit 230. Then, in the one-output D/I conversion unit 230, the output blocks 235*a* and 235*b* have four 1-bit D/I conversion units 231 each. More specifically, as compared to the one-output D/I conversion unit 230 according to the foregoing first embodiment (see FIG. 6), the output block 235*a* has a 1-bit D/I conversion unit 231*a* aside from the 1-bit D/I conversion units 231*a* to 231*c*. The output block 235*b* has a 1-bit D/I conversion unit 231*h* aside from the 1-bit D/I conversion units 231*d* to 231*f*. The 1-bit D/I conversion unit 231*g* receives the digital data signal D3A and the reference current I3. It stores this reference current signal I3, and outputs a current having the same intensity as that of the reference current I3 when the digital data signal D3A has a value of high level. The 1-bit D/I conversion unit 231*h* receives the digital data signal D3B and the reference current I3. It stores this reference current signal I3, and outputs a current having the same intensity as that of the reference current I3 when the digital data signal D3B has a value of high level. Consequently, according to the present embodiment, the one-output D/I conversion unit 230 can output a current signal twice as high as in the foregoing first embodiment (2×Iout).

Moreover, as shown in FIG. 23, the data creation circuit 232*a* has NAND circuits NAND3A and NAND3B, and inverters IV3A and IV3B aside from the components of the data creation circuit 232 according to the foregoing first embodiment (see FIG. 7). The NAND circuit NAND3A receives the current selector signal ISEL1 and the digital data signal $D3_1$. The inverter IV3A receives the output of this NAND circuit NAND3A, and outputs the digital data signal D3A. The NAND circuit NAND3B receives the current selector signal ISEL2 and the digital data signal $D3_1$. The inverter IV3B receives the output of this NAND circuit NAND3B, and outputs the digital data signal 3B.

Furthermore, as shown in FIG. 24, the precharge circuit 250 is provided with a driving P-channel transistor T35*a* instead of the driving P-channel transistor T35 (see FIG. 9) according to the foregoing first embodiment. The driving P-channel transistor T35*a* has a driving capability twice as high as that of the driving P-channel transistor T35. This driving P-channel transistor T35*a* may be formed by connecting two of the driving transistor T35 according to the foregoing first embodiment in parallel, or may be formed as a single transistor having a channel width twice that of the transistor T35. In other respects than those described above, the present embodiment has the same configuration as that of the foregoing first embodiment.

Figure 25:
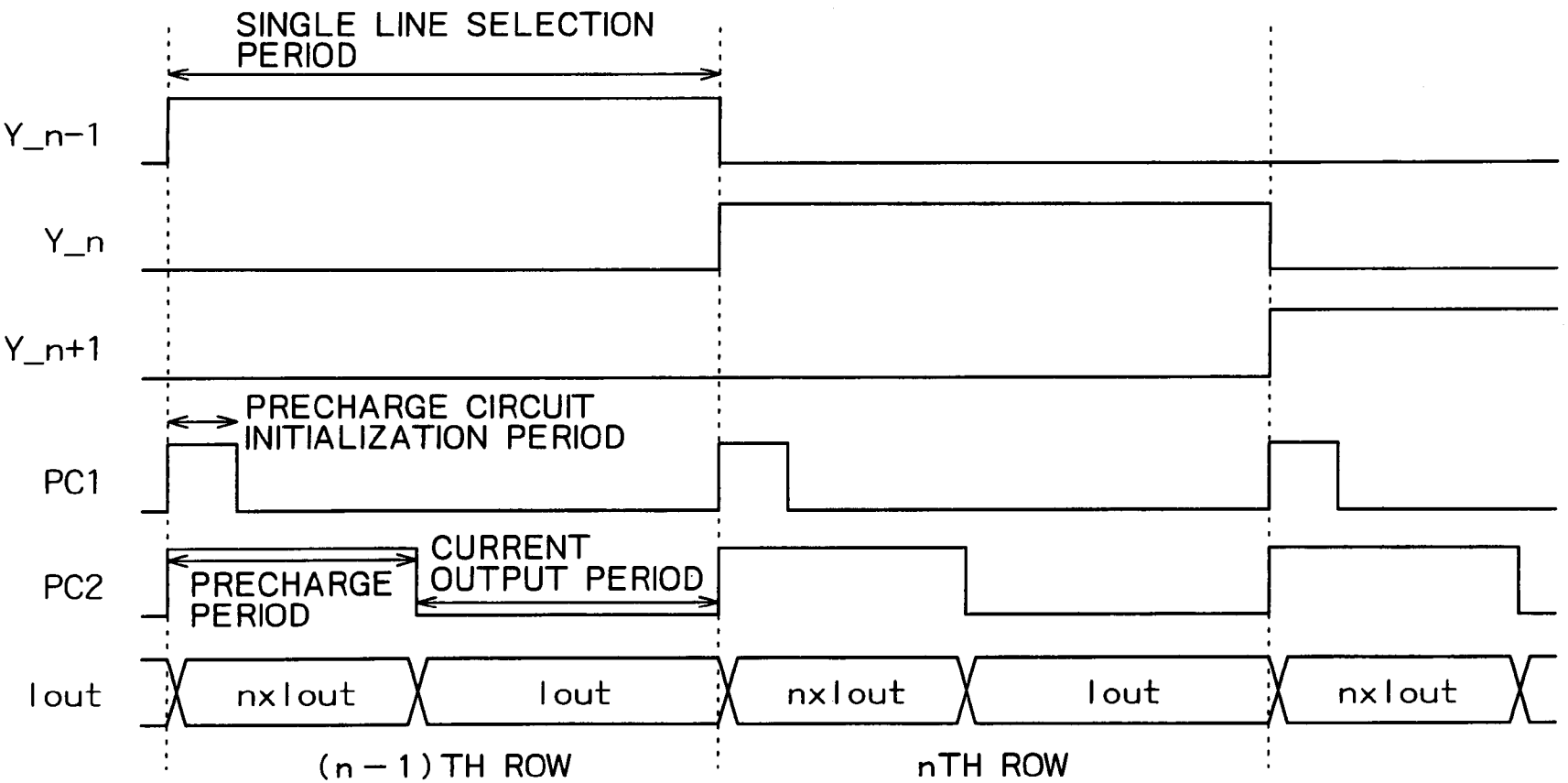
FIG. 25 is a timing chart for showing the operation of the organic EL display according to the present embodiment.

Next, description will be given of the operation of the driving circuit according to the present embodiment which is configured as described above, i.e., the method of driving the organic EL display according to the present embodiment. FIG. 25 is a timing chart for showing the operation of the organic EL display according to the present embodiment. As shown in FIG. 25, in the present embodiment, the one-output D/I conversion unit 230*a* outputs a current n times as high as the current signal Iout (twice, in the present embodiment) during the precharge period. In the current output period, on the other hand, the one-output D/I conversion unit 230*a* outputs the current signal Iout as in the foregoing first embodiment. Hereinafter, the operation of the present embodiment will be described below in detail.

Initially, description will be given of the operation during the precharge period. In the precharge period, three bits of digital data signals D0 to D2 are input from the data latch 204 (see FIG. 4) to the data shift circuit 233 (see FIG. 22). At this time; the precharge signal PC2 is at high level. Thus, as shown in Table 1, the data shift circuit 233 shifts the digital data signals D0 to D2 to higher order by one digit to generate the digital data signals $D1_1$ to $D3_1$, and sets the digital data signal $D0_1$ to 0. The data shift circuit 233 thereby generates the four bits of digital data signals $D0_1$ to $D3_1$, and outputs them to the data creation circuit 232*a*. The data expressed by the four bits of signals $D0_1$ to $D3_1$ has a value twice that of the data expressed by the digital data signals D0 to D2.

Next, as shown in FIG. 23, if the current selector signal ISEL1 is at high level and the current selector signal ISEL2 is at low level, the data creation circuit 232*a* generates the digital data signals D0A to D3A based on the digital data signals $D0_1$ to $D3_1$, and outputs them to the output block 235*a*. On the other hand, if the current selector signal ISEL1 is at low level and the current selector signal ISEL2 is at high level, the data creation circuit 232*a* generates the digital data signals D0B to D3B based on the digital data signals $D0_1$ to $D3_1$, and outputs them to the output block 235*b*.

Suppose that the data creation circuit 232*a* outputs the digital data signals D0A to D3A to the output block 235*a*. As shown in FIG. 22, the output block 235*a* then selects one or some of the four levels of currents equivalent to the reference currents I0 to I3, respectively, based on the digital data signals D0A to D3A. The sum of the currents selected is output to the precharge circuit 250 (see FIG. 5) as the current signal. Suppose, on the other hand, that the data creation circuit 232*a* outputs the digital data signals D0B to D3B to the output block 235*b*. The output block 235*b* then selects one or some of the four levels of currents equivalent to the reference currents I0 to I3, respectively, based on the digital data signals D0B to D3B. The sum of the currents selected is output to the precharge circuit 250 as the current signal. In either case, the current signal input to the precharge circuit 250 is twice as high as the current signal Iout that is input to the precharge circuit 250 in the foregoing first embodiment.

Then, as shown in FIG. 24, in the precharge circuit 250, the current signal (2×Iout) output from the one-output D/I conversion unit 230*a* flows through the driving P-channel transistor T35*a* since the precharge signal PC2 is at high level. In the present embodiment, the current signal having the intensity twice that of the current signal Iout of the foregoing first embodiment flows through the driving transistor T35*a* which has the driving capability twice that of the driving transistor T35 of the foregoing embodiment. Thus, the potential of the node A, which corresponds to the tone level, becomes the same as that of the node A in the foregoing first embodiment.

Now, description will be given of the operation during the current output period. Again, in the precharge period, three bits of digital data signals D0 to D2 are input from the data latch 204 (see FIG. 4) to the data shift circuit 233 (see FIG. 22). At this time, the precharge signal PC2 is at low level. Thus, the data shift circuit 233 uses the digital data signals D0 to D2 simply as the digital data signals $D0_1$ to $D2_1$, and sets the digital data signal $D3_1$ to 0. The data shift circuit 233 thereby generates the four bits of digital data signals $D0_1$ to $D3_1$, and outputs them to the data creation circuit 232*a*. The data expressed by the four bits of signals $D0_1$ to $D3_1$ has the same value as that of the data expressed by the digital data signals D0 to D2.

Next, as shown in FIG. 23, if the current selector signal ISEL1 is at high level and the current selector signal ISEL2 is at low level, the data creation circuit 232*a* outputs the digital data signals D0A to D3A to the output block 235*a* based on the digital data signals $D0_1$ to $D3_1$. The output block 235*a* outputs the current signal Iout based on these signals D0A to D3A. On the other hand, if the current selector signal ISEL1 is at low level and the current selector signal ISEL2 is at high level, the data creation circuit 232*a* outputs the digital data signals D0B to D3B to the output block 235*b* based on the digital data signals $D0_1$ to $D3_1$. The output block 235*b* outputs the current signal Iout based on these signals D0B to D3B. This current signal Iout is a current having the same intensity as that of the current signal Iout according to the foregoing first embodiment.

Then, as shown in FIG. 24, in the precharge circuit 250, the current signal output from the one-output D/I conversion unit 230*a* is not passed through the driving P-channel transistor T35*a* but supplied to the data line 120 directly since the precharge signal PC2 is at low level. In other respects than those described above, the operation of the present embodiment is the same as that of the foregoing first embodiment.

According to the present embodiment, during the precharge period, the current twice as high as the current signal Iout can be passed through the driving transistor T35*a* so that the potential of the node A is settled more quickly. The effects of the present embodiment other than described above are the same as those of the foregoing first embodiment.

While the present embodiment has dealt with the case where the current to be passed through the driving transistor T35*a* during the precharge period is twice as high as the current signal Iout, the present invention is not limited thereto. That is, the current to be passed through the driving transistor during the precharge period may be n times as high as the current signal Iout. Here, n is a real number no smaller than 1. If n is a power of 2, such as 2, 4, 8, 16, . . . , or in other words, a number that can be expressed as $2^m$ (m is a natural number), then the data shift circuit shall convert the three bits of digital data signals into (3+m) bits of digital data signals. In this case, the data creation circuit is configured to handle (3+m bits of digital data signals. Each output block is provided with (3+m) 1-bit D/I conversion units, and the driving transistor in the precharge circuit is given a driving capability $2^m$ times that of the driving transistor T35 according to the first embodiment. If n is a number other than the powers of 2, the D/I conversion unit 210 (see FIG. 4) shall be provided with one-output D/I conversion units dedicated to the precharge period. Then, the reference currents I0 to I2 to be input to these one-output D/I conversion units are made n times as high as the reference currents I0 to I2 of the present embodiment, respectively.

Figure 26:
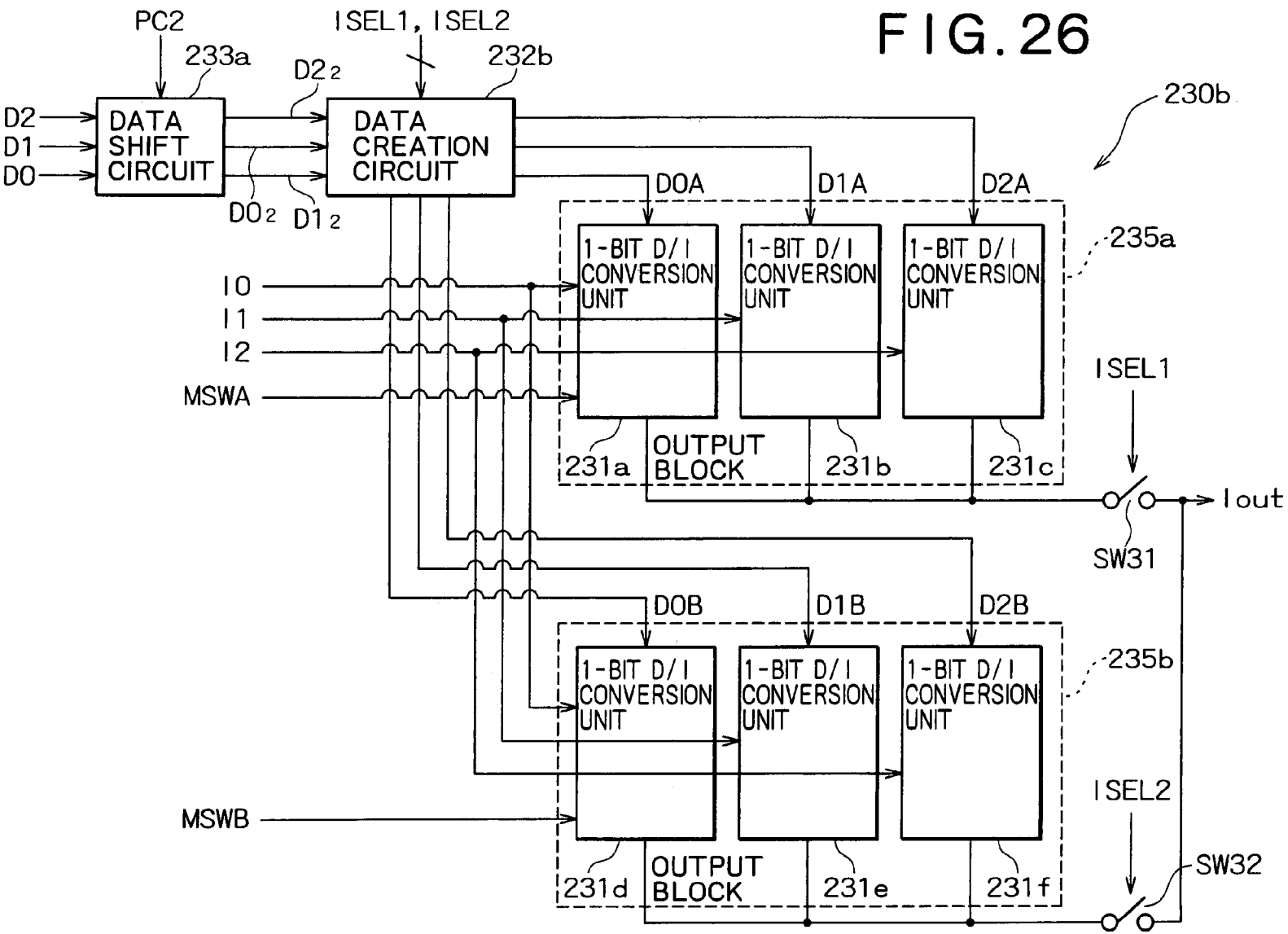
FIG. 26 is a block diagram showing a one-output D/I conversion unit of the organic EL display according to a ninth embodiment of the present invention.
Figure 27:
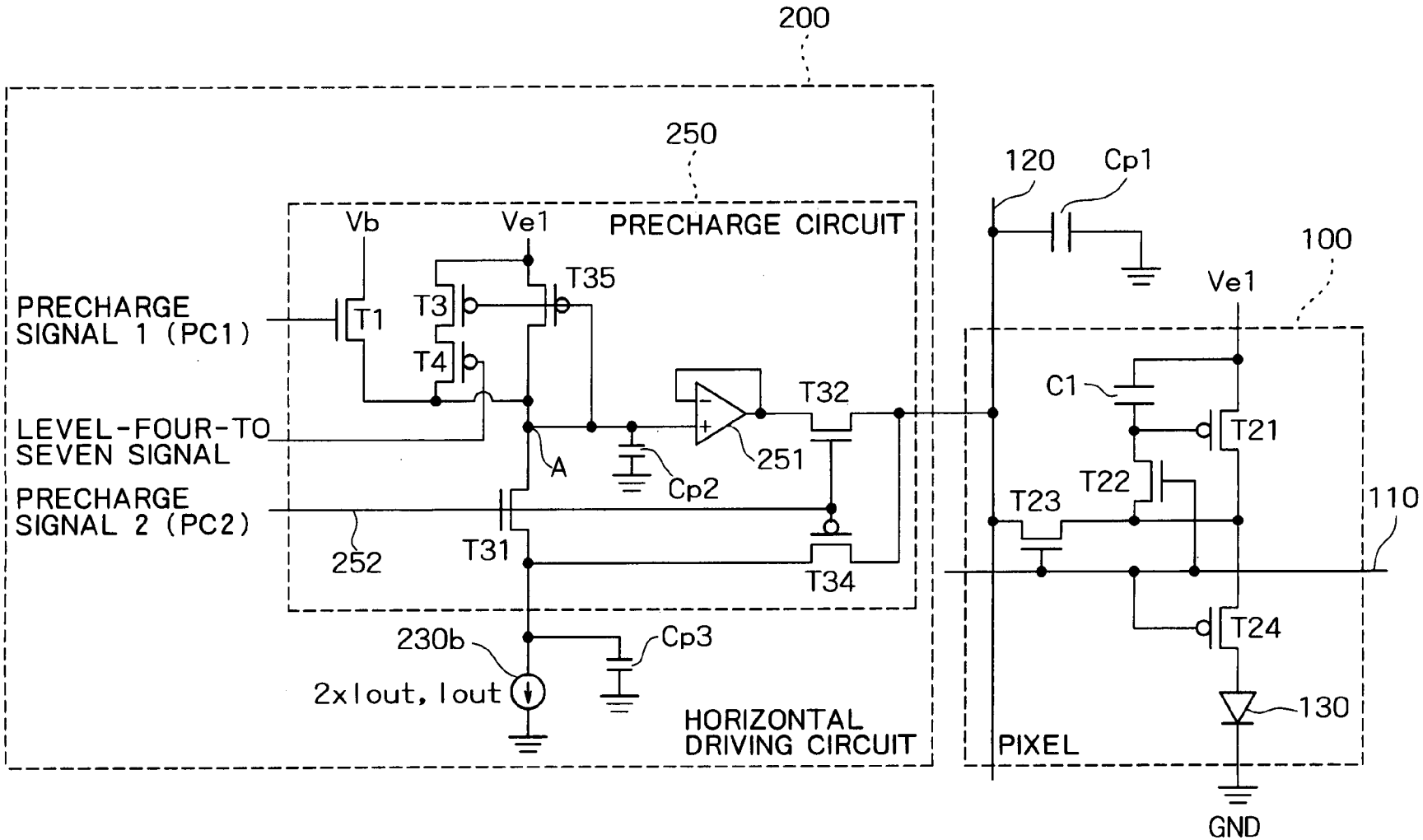
FIG. 27 is a circuit diagram showing a D/I conversion unit and a precharge circuit for each single data line, and a pixel circuit for each single pixel.

Now, description will be given of a ninth embodiment of the present invention. FIG. 26 is a block diagram showing a one-output D/I conversion unit of the organic EL display according to the present embodiment. FIG. 27 is a circuit diagram showing a D/I conversion unit and a precharge circuit for each single data line, and a pixel circuit for each single pixel. As shown in FIG. 26, the one-output D/I conversion unit 230*b* according to the present embodiment differs from the one-output D/I conversion unit 230 according to the foregoing first embodiment (see FIG. 6) in the provision of a data shift circuit 233*a*. Table 2 shows the input and output data of the data shift circuit 233*a*.

TABLE 2

| TONE | INPUT SIGNAL | | | OUTPUT SIGNAL: PRECHARGE PERIOD | | | OUTPUT SIGNAL: CURRENT OUTPUT PERIOD | | | |
|---|---|---|---|---|---|---|---|---|---|---|
| LEVEL | D2 | D1 | D0 | $D2_1$ | $D1_1$ | $D0_1$ | $D2_1$ | $D1_1$ | $D0_1$ | REMARKS |
| LEVEL 7 | 1 | 1 | 1 | 1 | 1 | 1 | 1 | 1 | 1 | NO SHIFT |
| LEVEL 6 | 1 | 1 | 0 | 1 | 1 | 0 | 1 | 1 | 0 | |
| LEVEL 5 | 1 | 0 | 1 | 1 | 0 | 1 | 1 | 0 | 1 | |
| LEVEL 4 | 1 | 0 | 0 | 1 | 0 | 0 | 1 | 0 | 0 | |
| LEVEL 3 | 0 | 1 | 1 | 1 | 1 | 0 | 0 | 1 | 1 | SHIFT TO |
| LEVEL 2 | 0 | 1 | 0 | 1 | 0 | 0 | 0 | 1 | 0 | HIGHER |
| LEVEL 1 | 0 | 0 | 1 | 0 | 1 | 0 | 0 | 0 | 1 | ORDER |
| LEVEL 0 | 0 | 0 | 0 | 0 | 0 | 0 | 0 | 0 | 0 | BY ONE BIT |

Referring to Table 2, take the cases where the digital data signals D0 to D2 indicate any one of the lower four levels, or level zero to level three, out of the eight possible tone levels for pixel display. During the precharge period, the data shift circuit 233*a* shifts the signals D0 and D1 to higher order by one bit to generate signals $D1_2$ and $D2_2$, and inserts 0 as a signal $D0_2$ which indicates the least significant bit. The three bits of digital data signals D0 to D2 are thus converted into the three bits of digital data signals $D0_2$ to $D2_2$. Here, the data expressed by the signals $D0_2$ to $D2_2$ has a value twice that of the data expressed by the signals D0 to D2.

Now, in the cases where the digital data signals D0 to D2 indicate any one of the higher four levels, or level four to level seven, out of the eight possible tone levels for pixel display, the signals D0 to D2 are output simply as the signals $D0_2$ to $D2_2$, respectively, without being shifted. The three bits of digital data signals D0 to D2 are thus converted into the three bits of digital data signals $D0_2$ to $D2_2$. Here, the data expressed by the signals $D0_2$ to $D2_2$ has the same value as that of the data expressed by the signals D0 to D2.

Now, during the current output period, the digital data signals D0 to D2 are not shifted but output simply as the signals $D0_2$ to $D2_2$, respectively, regardless of the display tone level.

As shown in FIG. 27, the configuration of the precharge circuit 250 according to the present embodiment differs from that of the precharge circuit 250 according to the foregoing first embodiment (see FIG. 9) in the provision of a driving P-channel transistor T3 and a switching P-channel transistor T4. The supply voltage Ve1 is applied to the source of the driving P-channel transistor T3. The driving P-channel transistor T3 is connected to one terminal of the switching P-channel transistor T4 at the drain, and to the node A at the gate. The switching P-channel transistor T4 is connected to the node A at the other terminal, and receives a level-four-to-seven signal at the gate. The level-four-to-seven signal is a signal which turns to high level when the tone level to display is level four to seven, and turns to low level when level zero to three. The driving P-channel transistor T3 has the same driving capability as that of the driving P-channel transistor T35. In other respects than those described above, the present embodiment has the same configuration as that of the foregoing first embodiment.

Next, description will be given of the operation of the driving circuit according to the present embodiment which is configured as described above, i.e., the method of driving the organic EL display according to the present embodiment. During the precharge period, as shown in FIG. 26, the digital data signals D0 to D2 are input to the data shift circuit 233*a* of the one-output D/I conversion unit 230*b*. Suppose here that the digital data signals D0 to D2 indicate any one tone level out of level zero to level three. As shown in Table 2, the data shift circuit 233*a* shifts the signals D0 and D1 to higher order by one bit to generate the signals $D1_2$ and $D2_2$, and sets the signal $D0_2$ to 0. The data shift circuit 233*a* thereby generates the three bits of digital data signals $D0_2$ to $D2_2$, and output them to the data creation circuit 232*b*. Then, the output block 235*a* or 235*b* generates the current signal on the basis of these digital data signals $D0_2$ to $D2_2$, and outputs the resultant to the precharge circuit 250. Here, the current signal output from the one-output D/I conversion unit 230*b* to the precharge circuit 250 has the intensity twice that of the current signal Iout which is output when the data signal shift 233*a* makes no data shift.

Then, as shown in FIG. 27, in the precharge circuit 250, the switching P-channel transistor T4 turns on since the level-four-to-seven signal is at low level. As a result, currents flow through the driving transistors T35 and T3 in parallel. Here, the driving transistor T3 has the same driving capability as that of the driving transistor T35. The driving transistors T35 and T3 thus undergo currents equal to each other, and the current flowing through the driving transistor T35 has the same intensity as that of the current signal Iout.

Now, suppose that the digital data signals D0 to D2 indicate any one tone level out of level four to level seven. As shown in Table 2, the data shift circuit 233*a* does not shift but simply outputs the signals D0 to D2 to the data creation circuit 232*b* as the digital data signals $D0_2$ to $D2_2$. Then, the output block 235*a* or 235*b* generates the current signal on the basis of these digital data signals $D0_2$ to $D2_2$, and outputs the resultant to the precharge circuit 250. Here, the current signal output from the one-output D/I conversion unit 230*b* to the precharge circuit 250 has the same intensity as that of the current signal Iout which is output when the data signal shift 233*a* makes no data shift.

As shown in FIG. 27, in the precharge circuit 250, the switching P-channel transistor T4 turns off since the level-four-to-seven signal is at high level. As a result, no current flows through the driving transistor T3 but through the driving transistor T35 alone. This current has the same intensity as that of the current signal Iout. As seen from above, the driving transistor T35 always undergoes the same current as the current signal Iout in displaying any tone level. Then, the potential necessary to pass the current signal Iout through the current controlling transistor T21 in the pixel circuit can be applied to the gate of this transistor T21.

In other respects than those described above, the operation of the present embodiment is the same as that of the foregoing first embodiment.

According to the present embodiment, at lower tone levels where the lower current signal requires particularly long time for potential settlement, i.e., at level one to level three, the current signal is given an intensity twice that of the current signal Iout. It is therefore possible to settle the potential of the node A more quickly. Moreover, in the present embodiment, the one-output conversion unit does not require additional 1-bit D/I conversion units like in the foregoing eighth embodiment. Besides, the data creation circuit need not be provided with additional NAND circuits or inverters. Consequently, as compared to the foregoing eighth embodiment, it is possible to simplify the circuits with a reduction in cost and in area. The effects of the present embodiment other than described above are the same as those of the foregoing first embodiment.

While the present embodiment has dealt with the case where the current to be passed through the driving transistor T35*a* during the precharge period is twice as high as the current signal Iout, the present invention is not limited thereto. The intensity of the current to be supplied to the precharge circuit may be n times that of the current signal Iout (n is a real number no smaller than 1). Here, the driving transistor T3 is given a driving capability (n−1) times that of the driving transistor T35. For example, in the case of a level-one display (D0=1, D1=0, D2=0), the signal D0 may be shifted to higher order by two bits (D0=0, D1=0, D2=1) to pass a current as high as four times. Here, the driving transistor T3 is given a driving capability three times that of the driving transistor T35. According to the method described in the present embodiment, it is possible to pass a current $n=2^m$ times, or within the range of twice and (s/2) times, as high as the current signal Iout through the driving transistor of the precharge circuit, where s is the number of tone levels to display.

Incidentally, in the foregoing third to seventh embodiments, a plurality of levels of reference potentials Vps or reference currents Ips may be provided as described in the foregoing second embodiment. Here, a switching transistor for applying a potential to the node A is provided for each of the potentials determined by the reference potentials Vps or the reference currents Ips. As discussed in conjunction with the results of simulation shown in FIG. 15, it is preferable to set the potentials in ascending order of the corresponding tone levels.

While the foregoing embodiments have dealt with the cases where the reference voltage Vps and the reference current Ips are provided in a single level each, the present invention is not limited thereto. A plurality of reference voltages Vps or reference currents Ips may be provided and selected according to the tone level to display.

The foregoing embodiments have dealt with the cases where the current-driven apparatus is an organic EL display. The present invention is not limited thereto, however, and may be applied to any apparatus as long as the apparatus includes a current-driven device or devices which are controlled in operation depending on the intensities of input currents. For example, the present invention may be applied to such current-driven displays as an inorganic EL display and a light-emitting diode (LED). A magneto resistive random access memory (MRAM) and other current-driven storage devices are also applicable.

Figure 28:
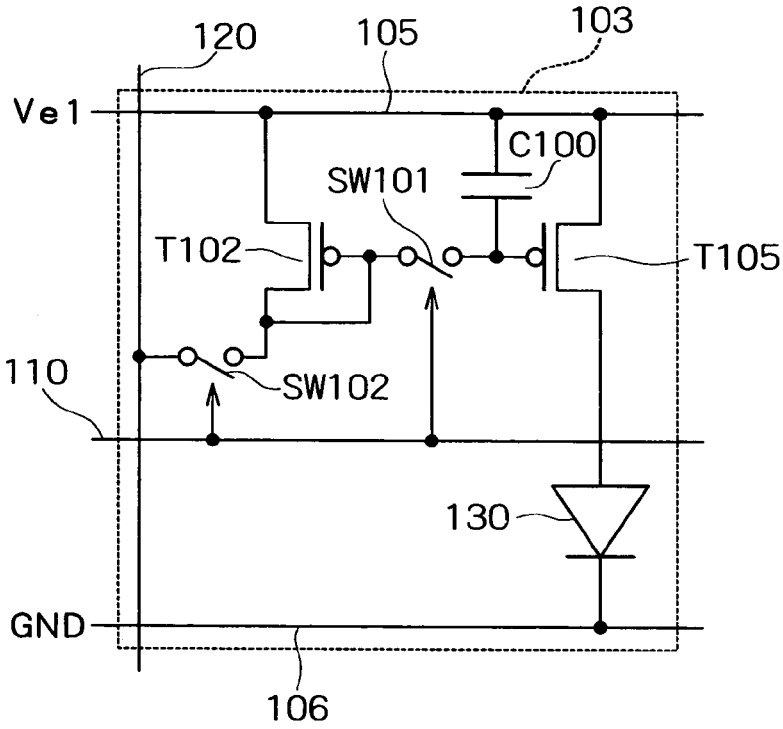
FIG. 28 is a circuit diagram showing another pixel circuit available for the organic EL displays of the present invention.

In the present invention, any pixel circuits other than those shown in the foregoing first through ninth embodiments (see FIG. 9) may also be used. FIG. 28 is a circuit diagram showing another pixel circuit available for the organic EL display of the present invention. As shown in FIG. 28, the pixel circuit 103 includes a P-channel transistor T105 intended for current driving and an organic EL device 130 which are connected between a supply voltage line 105 and a ground potential line 106. A supply voltage Ve1 is applied to the supply voltage line 105, and a ground potential is applied to the ground potential line 106. The P-channel transistor T105 and the organic EL device 130 are connected in series in order from the supply voltage line 105 to the ground potential line 106. More specifically, the P-channel transistor T105 is connected to the supply voltage line 105 at the source, and to the organic EL device 103 at the drain. The pixel circuit 103 also has a current storing P-channel transistor T102. The P-channel transistor T102 is connected to the supply voltage line 105 at the source, to the data line 102 through a switch SW102 at the drain, and to the gate of the P-channel transistor T105 through a switch SW101 at the gate. The P-channel transistors T105 and T102 have the same driving capability. A current mirror is formed by the P-channel transistors T105 and T102. The switches SW101 and SW102 are controlled on/off by the potential of the control line 110 so that they are closed when the potential of the control line 110 is at high level, and opened when at low level. In addition, a capacitor C100 is arranged between the supply voltage line 105 and the gate of the P-channel transistor T101.

Next, description will be given of the operation of the organic EL display having this pixel circuit. When the Kth control line 110 is selected by the vertical scanning circuit 300 (see FIG. 1) and its potential is turned to high level, the switches SW101 and SW102 shown in FIG. 28 turn on. This determines the gate voltage of the P-channel transistor T102 so that the Lth output current of the horizontal driving circuit 200 flows from the supply voltage line 105 to the horizontal driving circuit 200 through the P-channel transistor T102, the switch SW102, and the data line 120. Since the P-channel transistors T102 and T105 constitute a current mirror, the P-channel transistor T105 undergoes the same current as that flowing through the P-channel transistor T102, or a current having the same value as that of the output current of the horizontal driving circuit 200. As a result, the organic EL device 130 emits light with an intensity corresponding to the current value. Note that the gate voltage of the P-channel transistor T105 is maintained by the capacitor C100 even after the control line 110 is deselected and the switches SW101 and SW102 turn off. The pixel circuit shown in FIG. 28 may be used in any of the foregoing embodiments.

Figure 29:
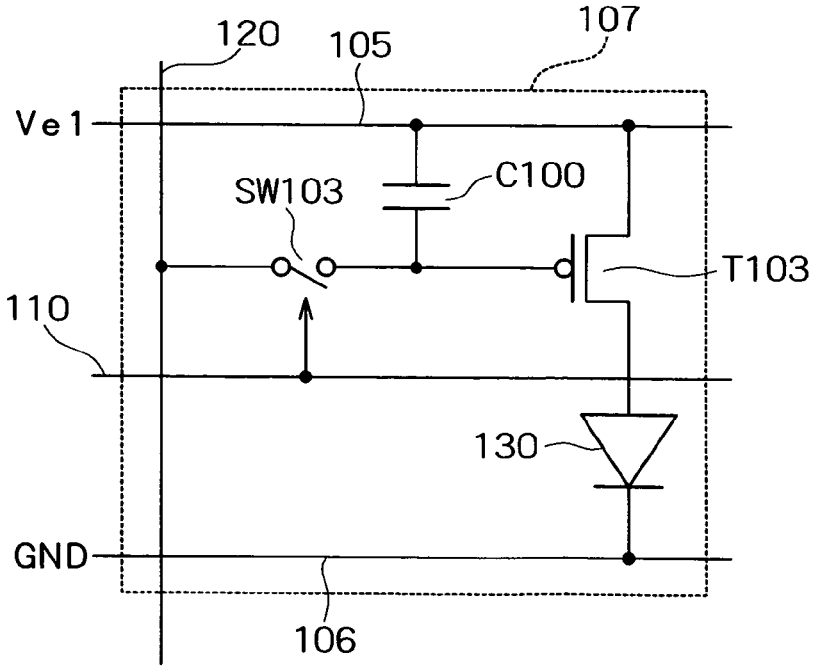
FIG. 29 is a circuit diagram showing still another pixel circuit available for the organic EL displays of the present invention.

Next, description will be given of still another pixel circuit applicable to the present invention. FIG. 29 is a circuit diagram showing the still another pixel circuit available for the organic EL display of the present invention. The foregoing embodiments have dealt with the cases where the transistor connected in series with the organic EL device stores a current signal. In the pixel circuit shown in FIG. 29, the transistor connected in series with the organic EL devices stores a voltage signal. As shown in FIG. 29, the pixel circuit 107 includes a P-channel transistor T103 intended for voltage driving and an organic EL device 130 which are connected between a supply voltage line 105 and a ground potential line 106. A supply voltage Ve1 is applied to the supply voltage line 105, and a ground potential is applied to the ground potential line 106. The P-channel transistor T103 and the organic EL device 130 are connected in series in order from the supply voltage line 105 to the ground potential line 106. More specifically, the P-channel transistor T103 is connected to the supply voltage line 105 at the source, to the organic EL device 130 at the drain, and to the data line 120 through a switch SW103 at the gate. In addition, a capacitor C100 is arranged between the power supply voltage line 105 and the gate of the P-channel transistor T103. The switch SW103 is controlled on/off by the potential of the control line 110 so that it is closed when the potential of the control line 110 is at high level, and opened when at low level. When this pixel circuit is used, the vertical scanning circuit 300 (see FIG. 1) outputs a voltage signal output from the precharge circuit to the data line 120, not a current signal.

Next, description will be given of the operation of the organic EL display having this pixel circuit. When the Kth control line 110 is selected by the vertical scanning circuit 300 (see FIG. 1) and its potential is turned to high level, the switch SW103 shown in FIG. 29 turns on. The Lth output voltage of the horizontal driving circuit 200 is thus applied from the horizontal driving circuit 200 to the gate of the P-channel transistor T103 through the switch SW103. Consequently, the P-channel transistor T103 operates in its saturation region. A current corresponding to the gate voltage thus flows between the source and drain of the P-channel transistor T103, and the same current flows through the organic EL device 130. As a result, the organic EL device 130 emits light with an intensity corresponding to the current value. The pixel circuit 107 shown in FIG. 29 may be used as a substitute for the pixel circuit 100 (see FIG. 9) in the foregoing first to ninth embodiments.

What is claimed is:

1. A driving circuit of a current-driven device for driving a current-driven device to be controlled in operation depending on the intensity of a current input thereto, the driving circuit comprising:

a current controlling transistor for determining said intensity of the current to be supplied to said current-driven device based on its gate potential, said current controlling transistor being connected in series with said current-driven device; and a potential output circuit for setting a gate potential of said current controlling transistor to a potential so that said current flows through said current-driven device, said potential output circuit comprising:

a potential generating circuit for generating said potential; and an initialization circuit for initializing said potential generating circuit to an initialization potential before said potential generating circuit generates said potential.

2. The driving circuit of a current-driven device according to claim 1, wherein the gate potential of said current controlling transistor is determined by input of a current signal, and said potential output circuit is a precharge circuit for precharging the gate potential of said current controlling transistor to a potential determined by the input of said current signal to the current controlling transistor before said current signal is input to said current controlling transistor.

3. The driving circuit of a current-driven device according to claim 2, wherein a plurality of levels of said current signals are provided, said precharge circuit is one for precharging the gate potential of said current controlling transistor to a plurality of potentials determined by said plurality of levels of current signals, and said initialization potential is at least one potential selected from among said plurality of potentials.

4. The driving circuit of a current-driven device according to claim 3, wherein said initialization potential is selected from among said plurality of potentials in ascending order of said corresponding current signals.

5. The driving circuit of a current-driven device according to claim 4, wherein said initialization potential is a potential determined by the smallest current signal among said plurality of levels of current signals.

6. The driving circuit of a current-driven device according to claim 1, further comprising an initialization potential generating circuit for generating said initialization potential to be input to said initialization circuit, and wherein said initialization potential generating circuit comprises:

a reference current source; and an initialization potential generating transistor; said initialization circuit has a switch for receiving said initialization potential and switching whether or not to apply said initialization potential to said potential generating circuit, and said initialization potential generating transistor, when supplied with a current from said reference current source, causes the gate potential equal to said initialization potential, and supplies said initialization potential to said switch.

7. The driving circuit of a current-driven device according to claim 2, wherein said precharge circuit generates said potential based on a current signal equal to said current signal or a current signal in proportion to said current signal.

8. The driving circuit of a current-driven device according to claim 2, wherein said initialization circuit initializes said potential generating circuit at the beginning of a period in which said precharge circuit precharges the gate potential of said current controlling transistor.

9. The driving circuit of a current-driven device according to claim 2, wherein said initialization circuit initializes said potential generating circuit before a period in which said precharge circuit precharges the gate potential of said current controlling transistor.

10. The driving circuit of a current-driven device according to claim 2, wherein a plurality of said current-driven devices are arranged in a matrix, and said precharge circuit precharges the gate potentials of said current-controlling transistors through each of data lines provided for respective rows of said current-driven devices.

11. The driving circuit of a current-driven device according to claim 10, wherein said current-driven device is an organic EL device.

12. A driving circuit of a current-driven device for driving a current-driven device to be controlled in operation depending on the intensity of a current determined by a current controlling transistor, the driving circuit comprising:

a driving transistor having its gate and drain short-circuited, causing a gate potential equal to a gate potential of said current controlling transistor when a current signal is passed between its source and drain;

a current source for outputting said current signal to said driving transistor;

an operational amplifier having a noninverting input terminal connected to the drain of said driving transistor, and an output terminal connected to its inverting input terminal and the gate of said current controlling transistor;

an input terminal for receiving a predetermined initialization potential; and a switch connected between the input terminal and the noninverting input terminal of said operational amplifier.

13. The driving circuit of a current-driven device according to claim 12, further comprising an initialization potential generating circuit for generating said initialization potential, and wherein said initialization potential generating circuit comprises:

a reference current source; and an initialization potential generating transistor for causing the gate potential equal to said initialization potential when supplied with a current from said reference current source, and supplying said initialization potential to said switch.

14. The driving circuit of a current-driven device according to claim 12, wherein said current source receives a digital signal, and converts said digital signal into a current signal to generate said current signal.

15. A driving circuit of a current-driven device for driving a current-driven device to be controlled in operation depending on the intensity of a current determined by a current controlling transistor, the driving circuit comprising:

a driving transistor having its gate and drain short-circuited, causing a gate potential equal to a gate potential of said current controlling transistor when a current signal is passed between its source and drain;

a current source for outputting said current signal to said driving transistor;

an operational amplifier having a noninverting input terminal connected to the drain of said driving transistor, and an output terminal connected to its inverting input terminal and the gate of said current controlling transistor;

another current source for outputting an initialization current to be passed through said driving transistor so that the gate potential of said driving transistor is initialized to an initialization potential; and a switch connected between the another current source and the drain of said driving transistor.

16. The driving circuit of a current-driven device according to claim 15, wherein said current source receives a digital signal, and converts said digital signal into a current signal to generate said current signal.

17. A driving circuit of a current-driven device for driving a current-driven device to be controlled in operation depending on the intensity of a current determined by a current controlling transistor, the driving circuit comprising:

a driving transistor having its gate and drain short-circuited, causing a gate potential equal to a gate potential of said current controlling transistor when a current signal is passed between its source and drain;

a current source for outputting said current signal to said driving transistor;

an operational amplifier having a noninverting input terminal connected to the drain of said driving transistor, and an output terminal connected to its inverting input terminal and the gate of said current controlling transistor;

another current source for outputting a current n times (n is a real number no smaller than 1) as high as an initialization current to be passed through said driving transistor so that the gate potential of said driving transistor is initialized to an initialization potential;

another driving transistor connected to the another current source in parallel with said driving transistor, having a driving capability (n−1) times that of said driving transistor; and a switch connected between said another current source and the drains of said driving transistor and said another driving transistor.

18. The driving circuit of a current-driven device according to claim 17, wherein said current source receives a digital signal, and converts said digital signal into a current signal to generate said current signal.

19. A driving circuit of a current-driven device for driving a current-driven device to be controlled in operation depending on the intensity of a current determined by a current controlling transistor, the driving circuit comprising:

a driving transistor having its gate and drain short-circuited, causing a gate potential equal to a gate potential of said current controlling transistor when a current higher than a current signal supplied from said current controlling transistor to said current-driven device is passed between its source and drain;

a current source for outputting said higher current to said driving transistor;

an operational amplifier having a noninverting input terminal connected to the drain of said driving transistor, and an output terminal connected to its inverting input terminal and the gate of said current controlling transistor;

an input terminal for receiving a predetermined initialization potential; and a switch connected between the input terminal and the noninverting input terminal of said operational amplifier.

20. The driving circuit of a current-driven device according to claim 19, wherein said high current is $2^m$ times (m is a natural number) as high as said current signal, and said current source receives a digital signal, converts said digital signal into a current signal to generate said current signal, and converts another digital signal into a current signal to generate the $2^m$-fold current, said another digital signal being obtained by shifting the data of said digital signal to higher order by m bits.

21. The driving circuit of a current-driven device according to claim 19, wherein said current source receives a digital signal, and converts said digital signal into a current signal to generate said current signal.

22. A current-driven apparatus comprising:

a current-driven device to be controlled in operation depending on the intensity of a current input thereto; and the driving circuit according to claim 1, for supplying said current to said current-driven device.

23. The current-driven apparatus according to claim 22, being any one of a current-driven display and a current driven memory.

24. The current-driven apparatus according to claim 23, wherein the apparatus is an organic EL display, and the current-driven device is an organic EL device.

25. A current-driven apparatus comprising:

a current-driven device to be controlled in operation depending on the intensity of a current input thereto; and the driving circuit according to claim 12, for supplying said current to said current-driven device.

26. The current-driven apparatus according to claim 25, being any one of a current-driven display and a current driven memory.

27. The current-driven apparatus according to claim 26, wherein the apparatus is an organic EL display, and the current-driven device is an organic EL device.

28. A current-driven apparatus comprising:

a current-driven device to be controlled in operation depending on the intensity of a current input thereto; and the driving circuit according to claim 15, for supplying said current to said current-driven device.

29. The current-driven apparatus according to claim 28, being any one of a current-driven display and a current driven memory.

30. The current-driven apparatus according to claim 29, wherein the apparatus is an organic EL display, and the current-driven device is an organic EL device.

31. A current-driven apparatus comprising:

a current-driven device to be controlled in operation depending on the intensity of a current input thereto; and the driving circuit according to claim 17, for supplying said current to said current-driven device.

32. The current-driven apparatus according to claim 31, being any one of a current-driven display and a current driven memory.

33. The current-driven apparatus according to claim 32, wherein the apparatus is an organic EL display, and the current-driven device is an organic EL device.

34. A method of driving a current-driven apparatus including a current-driven device to be controlled in operation depending on the intensity of a current input thereto, the method comprising the steps of:

writing a signal to a current controlling transistor for determining the intensity of said current to be supplied to said current-driven device; and supplying said current to said current-driven device based on said written signal, thereby driving said current-driven device, wherein the step of writing comprises:

setting a gate potential of said current controlling transistor by using a potential generating circuit so that said current flows through said current-driven device; and initializing said potential generating circuit to an initialization potential before the gate potential of said current controlling transistor is set to said potential.

35. The method of driving a current-driven apparatus according to claim 34, wherein said current controlling transistor is configured so that its gate potential is determined by input of a current signal, the step of writing includes a step of inputting said current signal to said current controlling transistor after said potential generating step, and the step of setting the gate potential is a step of precharging the gate potential of said current controlling transistor to a potential determined by the input of said current signal to the current controlling transistor.

36. The method of driving a current-driven apparatus according to claim 35, wherein the step of initializing is arranged at the beginning of said step of precharging pertaining to the same writing step as the initialization step does.

37. The method of driving a current-driven apparatus according to claim 35, wherein said initialization step is arranged before said step of precharging pertaining to the same writing step as the initialization step does.

38. The method of driving a current-driven apparatus according to claim 35, wherein a plurality of levels of said current signals are provided, said step of precharging is one for precharging the gate potential of said current controlling transistor to a plurality of potentials determined by said plurality of levels of current signals, and said initialization potential is at least one potential selected from among said plurality of potentials.

39. The method of driving a current-driven apparatus according to claim 38, wherein said initialization potential is selected from among said plurality of potentials, in ascending order of said corresponding current signals.

40. The method of driving a current-driven apparatus according to claim 39, wherein said initialization potential is a potential determined by the smallest current signal among said plurality of levels of current signals.

41. The method of driving a current-driven apparatus according to claim 35, wherein the step of initializing includes the step of passing a current between the source and drain of an initialization potential generating transistor, thereby setting the gate potential of the initialization potential generating transistor to said initialization potential.

42. The method of driving a current-driven apparatus according to claim 35, wherein said step of precharging includes the step of passing said current signal between source and drain of a driving transistor, thereby making the gate potential of the driving transistor equal to the gate potential of said current controlling transistor determined by the input of said current signal to said current controlling transistor, and the step of initializing includes the step of passing an initialization current between the source and the drain of said driving transistor, thereby setting the gate potential of said driving transistor to said initialization potential.

43. The method of driving a current-driven apparatus according to claim 35, wherein said step of precharging includes the step of passing a current higher than said current signal between source and drain of a driving transistor, thereby making the gate potential of the driving transistor equal to the gate potential of said current-controlling transistor determined by the input of said current signal to said current-controlling transistor, and said initialization step includes the step of passing an initialization current between the source and the drain of said driving transistor, thereby setting the gate potential of said driving transistor to said initialization potential.

44. The method of driving a current-driven apparatus according to claim 43, wherein said high current is $2^m$ times (m is a natural number) as high as said current signal, and said step of precharging comprises the steps of:

shifting data of a digital signal to be converted into a current signal to generate said current signal, to higher order by m bits to generate another digital signal; and converting the another digital into a current signal to generate the $2^m$-fold current.

45. The method of driving a current-driven apparatus according to claim 35, wherein said current-driven apparatus has a plurality of pixel circuits arranged in a matrix, said pixel circuits each including said current-driven device and said current controlling transistor, said step of inputting said current signal to said current controlling transistor is one for inputting said current signal to said current controlling transistors through each of data lines provided for respective rows of said pixel circuits, and step of precharging is one for precharging the gate potentials of said current controlling transistors through said data lines.

* * * * *